US008271241B2

(12) United States Patent
Akyurtlu et al.

(10) Patent No.: US 8,271,241 B2
(45) Date of Patent: Sep. 18, 2012

(54) CHIRAL METAMATERIALS

(75) Inventors: Alkim Akyurtlu, Arlington, MA (US); Kenneth A. Marx, Francestown, NH (US); Nantakan Wongkasem, Khon Kaen (TH)

(73) Assignee: University of Massachusetts Lowell, Lowell, MA (US)

( * ) Notice: Subject to any disclaimer, the term of this patent is extended or adjusted under 35 U.S.C. 154(b) by 1369 days.

(21) Appl. No.: 11/901,964

(22) Filed: Sep. 19, 2007

(65) Prior Publication Data

US 2010/0141358 A1 Jun. 10, 2010

Related U.S. Application Data

(63) Continuation-in-part of application No. 11/334,954, filed on Jan. 18, 2006, now abandoned.

(60) Provisional application No. 60/644,742, filed on Jan. 18, 2005.

(51) Int. Cl.
*G06G 7/48* (2006.01)

(52) U.S. Cl. ..... 703/5; 333/33; 333/203; 333/204; 333/219; 29/602.1; 343/909; 343/745

(58) Field of Classification Search ..... 428/824; 29/602.1; 423/151
See application file for complete search history.

(56) References Cited

U.S. PATENT DOCUMENTS 6,933,812 B2 8/2005 Sarabandi et al.
6,938,325 B2 * 9/2005 Tanielian ..... 29/602.1
7,163,667 B2 * 1/2007 Umemoto et al. ..... 423/151
2005/0073744 A1 4/2005 Zheludev et al.
2005/0221128 A1 * 10/2005 Kochergin ..... 428/824

OTHER PUBLICATIONS

Bulu, I., et al., "Experimental Demonstration of Labyrinth-Based-Left-Handed Metamaterials," *Optics Express 13*(25): pp. 10238-10247, Dec. 12, 2005.

(Continued)

*Primary Examiner* — Kamini S Shah
*Assistant Examiner* — Cuong Luu
(74) *Attorney, Agent, or Firm* — Hamilton, Brook, Smith & Reynolds, P.C.

(57) ABSTRACT

A metamaterial includes a dielectric substrate and an array of discrete resonators at the dielectric substrate, wherein each of the discrete resonators has a shape that is independently selected from: an F-type shape; an E-type shape; or a y-type shape. A parameter of a chiral metamaterial is determined and a chiral metamaterial having such a parameter is prepared by the use of a model of the chiral metamaterial. The metamaterial model includes an array of discrete resonators. In one embodiment, each of the discrete resonators has a shape that is independently selected from the group consisting of: an F-type shape; an E-type shape; and a y-type shape. To the metamaterial model, electromagnetic (EM) radiation, preferably plane-polarized EM radiation in a visible, ultraviolet or near-infrared region, having at least one wavelength that is larger than the largest dimension of at least resonator of the metamaterial model, is applied. Varying at least one characteristic of the metamaterial model and/or at least one wavelength of the applied EM radiation modulates EM interaction of the applied EM radiation with the metamaterial model, thereby determining a parameter of the chiral metamaterial. By the use of a model of the chiral metamaterial, a number of discrete resonators of a chiral metamaterial that are arrayed in a direction perpendicular to a propagation axis of EM radiation is also determined.

7 Claims, 37 Drawing Sheets

OTHER PUBLICATIONS

Ziolkowski, R.W., "Design, Fabrication and Testing of Double Negative Metamaterials," *IEEE Transactions on Antennas and Propagation 51*(7): pp. 1516-1529, Jul. 2003.
Smith, D.R., et al., "Determination of Effective Permittivity and Permeability of Metamaterials from Reflection and Transmission Coefficients," *Phys. Rev. B. 65*(195104): pp. 1-5, 2002.
Katsarakis, N., et al., "Electric Coupling to the Magnetic Resonance of Split Ring Resonators," *App. Phy. Lett, 84*(15): pp. 2943-2945 (Apr. 2004).
Chen, H., et al., "Left-Handed Material Composed of Only *S*-Shaped Resonators," *Physical Review E 70*(5): Nov. 2004.
Chen, X., et al. "Robust Method to Retrieve the Constitutive Effective Parameters of Metamaterials," *Phys. Rev. E. 70*(016608): pp. 1-7, 2004.
Ran, L., et al., "Experimental Study on Several Left-Handed Metamaterials," *Progress in Electromagnetic Research* (*PIER*) *51*: pp. 249-279, 2005.
Chen, H., et al., "Metamaterial Exhibiting Left-Handed Properties Over Multiple Frequency Bands," *Journal of Applied Physics 96*: pp. 5338-5340, Nov. 1, 2004.
Pendry, J.B., et al., "Extremely Low Frequency Plasmons in Metallic Mesostructures," *Phys. Rev. Lett. 76*: pp. 4773-4776, 1996.
Sievenpiper, D., et al., "3D Metallo-Dielectricphotonic Crystals with Strong Capacitive Coupling Between Metallicislands," *Phys. Rev. Lett. 80*: pp. 2829-2832, 1998.
Marques, R., et al., "Role of Bianisotropy in Negative Permeability and Left-Handed Metamaterials," *Phys. Rev. B. 65*(144440): pp. 1-6, 2002.
Aydin, K., et al., "Experimental Observation of True Left-Handed Transmission Peaks in Metamaterials," *Optics Letters 29*(22): pp. 2623-2625, Nov. 2004.
Wongkasem, N., "Computational and Theoretical Investigation of Micro- and Nano-Scale Chiral Electromagnetic Metamaterials;" Published doctoral dissertation, University of Massachusetts, Lowell, (Jun. 2007), (Abstract).

* cited by examiner without the slab (structure)

with the slab (structure)

Flow Chart for Determining a Parameter of Metamaterials

CHIRAL METAMATERIALS

RELATED APPLICATION

This application is a continuation-in-part application of U.S. application Ser. No. 11/334,954, filed Jan. 18, 2006 now abandoned, which claims the benefit of U.S. Provisional Application No. 60/644,742, filed Jan. 18, 2005. The entire teachings of the above-mentioned applications are incorporated herein by reference.

BACKGROUND OF THE INVENTION

"Chiral metamaterials" are chiral (i.e., right- or left-handed) artificial materials that include repeating array(s) of small conducting structures ("resonators") and exhibit a unique macroscopic property due to fine scale repetition of the small conducting structures (e.g., sizes smaller than a wavelength of applied radiation). In particular, chiral metamaterials possessing both negative effective electric permittivity and negative effective magnetic permeability within substantially the same frequency region are believed to behave in very unusual ways when interacting with electromagnetic (EM) radiation, for example: a) bend (refract) light in the 'wrong' way (i.e., not a way traditionally known for conventional materials found in nature); b) a flat plate of the material could focus light (act as a lens) instead of dispersing it; c) a light source behind the plate could appear to be in front of it; d) the Doppler effect would be reversed and/or e) surface plasmonic waves could couple to far greater distances from a metamaterial surface than to traditional surfaces such as optical fibers. Such metamaterials that have both negative effective electric permittivity and negative effective magnetic permeability in substantially the same frequency region are generally termed in the art as "double-negative (DNG) metamaterials."

Chiral metamaterials, especially chiral DNG metamaterials, can have numerous applications in the design of microwave transmission lines, antennas, mode-conversion devices, directional couplers and lenses. Left-handed chiral metamaterials can be of particular use when unusual phase velocity dispersion can be required. For instance, the backward wave couplers, the zero-order resonator, and the zero-order antenna all can utilize the frequency range in which the phase velocity can be very close to zero. Chiral metamaterials can also have a significant role in antireflection coating, microwave and optoelectronic technologies, chemical applications, biomedical imaging. Particularly, there is a need for new optical measurement technologies in biomedical imaging, biotechnology and the drug discovery industry that can benefit greatly from electromagnetic properties of novel chiral metamaterials. For example, drugs are usually sufficiently complex to typically contain one or more chiral centers that result in the existence of stereochemically distinct 3-D structures. For "n" chiral centers in a molecule, there can be $2^n$ different isomers possible and only one isomer of a drug typically has the correct activity. The drug industry has a need to make multiple wavelength optical measurements in order to understand how complex molecular systems, including living cells, can interact with chiral drugs. The unique electromagnetic properties of novel chiral metamaterials might overcome limitations of current optical instrumentation.

Although there have been extensive attention and activity by the optics and engineering community in this new area of materials, understanding of chiral metamaterials and their potential electromagnetic properties are still at a very early stage of development. Also, interest has mainly focused on potential applications in optical communications and signal transmission technology in the microwave region.

Therefore, there is a need to develop methods to understand the electromagnetic wave interaction of chiral metamaterials. There also is a need to develop methods for designing or providing a parameter of new chiral metamaterials, in particular DNG metamaterials, which can be used especially for opto-electromagnetic applications in a visible, ultraviolet or near-infrared region.

SUMMARY OF THE INVENTION

The present invention generally relates to a metamaterial that includes array(s) of "F-type," "E-type" or "y-type" shaped resonators. The present invention generally also relates to methods for designing and for producing metamaterials that can be chiral and have simultaneously negative effective electric permittivity and negative effective magnetic permeability in a given frequency region by the use of models of the metamaterials.

In one aspect, the present invention is directed to a metamaterial that includes a dielectric substrate and an array of discrete resonators at the dielectric substrate. Each of the discrete resonators has a shape that is independently selected from the group consisting of: an F-type shape; an E-type shape; and a y-type shape.

In another aspect, the present invention is directed to a method of determining a parameter of a metamaterial. The method includes the steps of: a) modeling a metamaterial, the model including an array of discrete resonators, wherein each of the discrete resonators has a shape that is independently selected from the group consisting of: an F-type shape; an E-type shape; and a y-type shape; and b) applying to the metamaterial model electromagnetic radiation having at least one wavelength that is larger than the largest dimension of at least one resonator of the metamaterial model. The method further includes the step of varying at least one member of the group consisting of: at least one characteristic of the metamaterial model; and at least one wavelength of the applied electromagnetic radiation, the wavelength being larger than the largest dimension of at least one resonator of the metamaterial model, to thereby modulate electromagnetic interaction of the metamaterial model with the applied electromagnetic radiation, thereby determining a parameter of the metamaterial.

In yet another aspect, the present invention is directed to a method of determining a parameter of a chiral metamaterial. The method includes the steps of: a) numerically modeling a chiral metamaterial, the model including an array of discrete resonators; b) applying to the chiral metamaterial model a simulated plane-polarized electromagnetic radiation in a visible, ultraviolet or near-infrared region and having at least one wavelength that is larger than the largest dimension of at least one resonator of the chiral metamaterial model; and c) varying at least one member of the group consisting of: at least one characteristic of the chiral metamaterial model; and at least one wavelength of the applied plane-polarized electromagnetic radiation, the wavelength being larger than the largest dimension of at least one resonator of the chiral metamaterial model, thereby causing the chiral metamaterial model to have simultaneously effective negative electric permittivity and effective negative magnetic permeability in substantially the same frequency region, thereby determining a parameter of the chiral metamaterial.

In yet another aspect, the present invention is directed to a method of preparing a metamaterial that includes an array of discrete resonators. In one embodiment, the method includes the steps described above for determining a parameter of a metamaterial; and further includes the step of forming a metamaterial having substantially the same parameter as the determined parameter. In another embodiment, the method includes the steps described above for determining a parameter of a chiral metamaterial; and further includes the step of forming a chiral metamaterial having substantially the same parameter as the determined parameter.

The present invention is also directed to a method of determining a number of discrete resonators of a chiral metamaterial that are arrayed in a direction perpendicular to a propagation axis of electromagnetic radiation. The method includes the steps of: a) numerically modeling a chiral metamaterial, the model including an array of discrete resonators; b) to the chiral metamaterial model, applying a simulated plane-polarized electromagnetic radiation in a visible, ultraviolet or near-infrared region and having at least one wavelength that is larger than the largest dimension of at least one resonator of the chiral metamaterial model; and c) varying the number of the resonators of the chiral metamaterial model that are arrayed in a direction perpendicular to a propagation axis of the applied electromagnetic radiation, to thereby obtain substantially the same electromagnetic interaction as electromagnetic interaction of the chiral metamaterial model having an infinite number of the resonators arrayed in the perpendicular direction, thereby determining said number of discrete resonators of the chiral metamaterial.

The present invention also discloses a method of forming a metamaterial of the invention, as described above. The method includes the steps of: a) preparing a dielectric substrate; and b) forming an array of discrete resonators at the dielectric substrate, where the discrete resonators are as described above.

A method of designing a chiral metamaterial that has simultaneously effective negative electric permittivity and effective negative magnetic permeability in a frequency region (i.e., a chiral DNG metamaterial) is also disclosed herein. The electromagnetic radiation is in a visible, ultraviolet or near-infrared region. The method includes the step of forming a circuit-equivalent of a resonator at a dielectric media. At least one characteristic of the resonator, such as the dimension and/or the shape of the resonator, is varied to thereby derive negative effective permittivity and negative effective permeability in a desired frequency region from the circuit equivalent. A numerical chiral metamaterial model is formed that includes an array of resonators having at least one characteristic that is substantially the same as the resonator of the circuit-equivalent, thereby designing a chiral DNG metamaterial.

The present invention also includes a method of splitting an incident electromagnetic radiation into two different angular paths. The method comprises applying, to a chiral metamaterial, electromagnetic radiation. The chiral metamaterial includes a dielectric substrate, and an array of discrete resonators at the dielectric substrate, wherein each of the discrete resonators has a shape that is independently selected from the group consisting of an F-type shape, an E-type shape and a y-type shape. The electromagnetic radiation has at least one wavelength that is larger than the largest dimension of at least one resonator of the chiral metamaterial.

With a method of the present invention, models of chiral metamaterials that include array(s) of discrete resonators with different orientations and shapes (e.g. F-type, E-type; and y-type shapes) can be built. Also, with the methods of the invention, theoretical predictions, including the double negative (DNG) aspects, of the response of the metamaterial models to EM radiation, particularly in a visible, ultraviolet or near-infrared region, can conveniently and effectively be made. The methods of the invention can also modify the EM interaction of the metamaterial models. In particular, the methods of the present invention can efficiently control DNG transmission band(s) by varying at least one characteristic of the metamaterial models, such as at least one characteristic of the resonators of the metamaterial models.

The methods and chiral metamaterials of the invention can be used in various opto-electromagnetic applications, including optical measurement technologies in biomedical imaging, biotechnology and the drug discovery industry. In particular, in some embodiments, the chiral metamaterials of the invention which have a negative refractive index property can be used to distinguish between right- and left-handed molecules, such as drugs. In addition, the chiral metamaterials of the invention can be used to enhance biomedical imaging, for example, in a near-IR (infrared) region where chiral electromagnetic radiation can penetrate human tissues and illuminate tumor masses. The chiral metamaterials of the invention can also be used for RF (microwave) and sensor applications.

Few non-optical methods for medical imaging exist in the art for the frequency range between ultrasound and x rays. Part of the difficulty is the opacity of human tissue through nearly all of the infrared, visible, and UV spectrum. There is a window in which light can penetrate into tissue: the near-IR wavelengths, from approximately 700 to 900 nm. But even at these wavelengths, scattering and absorption complicate the picture. Near-IR imaging of tissue is emerging as a way to quantify blood and water concentrations in tissue. One example of the major applications for this type of imaging is, breast cancer detection using near-infrared light and optical breast tomography scanners employing plane polarized light. These systems generally employ chiral optical components. The chiral metamaterials of the invention can provide unique novel paradigms for new instrument designs of such systems. The chiral metamaterials of the invention can also provide continuous, non-invasive, portable and low cost optical systems to enable more information-rich diagnostic measurements.

BRIEF DESCRIPTION OF DRAWINGS

FIGS. 1(a)-1(*e*) are schematic representations of resonators that can be used in a method of one embodiment of the invention: (a) a F-type shaped resonator; (b) a E-type shaped resonator; (c) a y-type shaped resonator; (d) an omega-type shaped resonator; and (e) a gammadion-type shaped resonator.

FIG. 3(*c*) is a flow chart for determining a parameter of a chiral metamaterial in one embodiment of the invention.

FIG. 4(*b*) is a schematic representation showing a y-type shaped resonator included in the FDTD model of FIG. 4(*a*) and showing the dimension of the y-type shaped resonator.

FIGS. 5(*c*)-5(*d*) are schematic representations of chiral metamaterials of the invention that include arrays of y-type shaped resonators.

FIG. 9(*c*) is a graph showing simulated transmission coefficients of chiral metamaterial models that include an array of F/E-type shaped resonators of FIGS. 9(*a*)-9(*b*), having the dimension of: (a) width=18 nm (solid line), (b) width=36 nm (dotted line), (c) width=60 nm (dash-dot line), (d) width=78 nm (dashed line), (e) width=96 nm (solid line).

FIG. 35(*b*) is a graph showing measured transmission spectrum of the chiral metamaterial of FIG. 35(*a*) and comparing the measured spectrum with that of simulated one.

FIG. 35(*c*) is a graph comparing the measured cross-polarized transmission coefficients for the chiral metamaterial of FIG. 35(*a*) with simulated ones for a chiral metamaterial model of the chiral metamaterial of FIG. 35(*a*).

FIG. 35(*d*) is a graph comparing the measured co-polarized transmission coefficients for the chiral metamaterial of FIG. 35(*a*) with simulated ones for a chiral metamaterial model of the chiral metamaterial of FIG. 35(*a*).

FIG. 40(*b*) is a graph showing simulations of transmission coefficients for perpendicular propagation of FIG. 40(*a*) wherein H2:H1 is: (a) 1:5, (b) 1:2, (c) 1:1, (d) 2:1, (e) 5:1, respectively.

FIG. 41(*b*) is a graph showing simulations of transmission coefficients for parallel propagation of FIG. 41(*a*) wherein H2:H1 is: (a) 1:5, (b) 1:2, (c) 1:1, (d) 2:1, (e) 5:1, respectively.

FIG. 45: (a) simulated numerical results and (b) experimental results.

DETAILED DESCRIPTION OF THE INVENTION

Figures 1A, 1B, 1C, 1D, 1E:
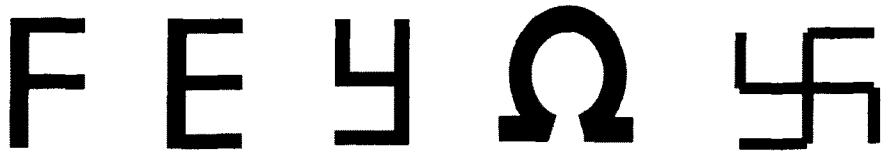

As used herein, the term "metamaterial" means an artificial material that includes repeating array(s) of resonators. As used herein "chiral metamaterial" means a chiral (i.e., right or left-handed) artificial material that includes repeating array(s) of resonators. Preferably, the chiral metamaterials of the invention are double-negative (DNG) metamaterials that simultaneously have both negative effective electric permittivity and negative effective magnetic permeability in a given frequency region.

As used herein, the term "resonator" means a conducting structure. Suitable examples of conducting materials for the resonator include Ag, Au, Al, Cu, Pt, Pd, Si and metal alloys thereof.

Typically, the largest dimension of the resonator is smaller than at least one wavelength of electromagnetic (EM) radiation that will be employed for various applications with the resonator(s), such as EM radiation in an X-ray, radio, microwave, visible, ultraviolet or infrared region. In one embodiment, the size of the largest dimension of the resonator is smaller than a wavelength of EM radiation in a wavelength of a microwave, visible, ultraviolet or infrared region. In another embodiment, the size of the largest dimension of the resonator is smaller than a wavelength of EM radiation in a wavelength of a microwave, visible, ultraviolet or near-infrared region. In yet another embodiment, the size of the largest dimension of the resonator is smaller than a wavelength of EM radiation in a wavelength of a visible, ultraviolet or near-infrared region. In a preferred embodiment, the size of the largest dimension of the resonator is smaller than a wavelength of EM radiation in a wavelength of a visible region. As used herein, the "radio region" means a region between about 0.05 meter and about 10 kilometer in wavelength. As used herein, the "microwave region" means a region between about 1 meter and about 1 millimeter. As used herein, the "visible region" means a region between about 0.4 micrometers and about 0.7 micrometers in wavelength. As used herein, the "ultraviolet region" means a region between about 1 nanometer and about 0.4 micrometers in wavelength. As used herein, the "X-ray region" means a region between about 10 nanometers and about 0.001 nanometers in wavelength. As used herein, the "infrared region" means a region between about 1 millimeter and about 0.7 micrometer. As used herein, the "near-infrared region" means a region between about 0.7 micrometers and about 5 micrometers.

As used herein, the term "parameter" of a metamaterial, such as a chiral metamaterial, means the effect of at least one characteristic of a metamaterial on the EM interaction of the metamaterial with an applied EM radiation.

As used herein, the EM interaction of a metamaterial with an applied EM radiation means electrical and/or magnetic response of the metamaterial to EM radiation. Examples of the EM interaction include electric permittivity, magnetic permeability, transmittance, reflection and refraction properties of the metamaterials. In general, the electric permittivity and magnetic permeability determine the response of metamaterials to EM radiation. Typically, transmittance (or reflection) properties of the metamaterials can be parameterized by half-power bandwidth, frequency position and intensity of a transmission passband, and the number of transmission passbands.

The characteristics of the metamaterials that include array(s) of discrete resonators include the dimension of at least one resonator; the shape of at least one resonator; orientation of resonators with respect to each other; orientation of at least one resonator with respect to a propagation axis of applied EM radiation; a distance between the discrete resonators; and the number of resonators, such as the number of resonators arrayed along a propagation axis of EM radiation or axis(axes) perpendicular to a propagation axis of EM radiation.

In general, characteristics of models of such metamaterials described above and their EM interaction features are as described above for the metamaterials.

Variation of one or more of the characteristics of metamaterials and metamaterial models can affect the response of the metamaterials and their models to electromagnetic radiation, respectively.

The metamaterials and their metamaterial models can include one or more arrays of discrete resonators, i.e., can be one-dimensional, two-dimensional or three-dimensional. In one embodiment, the metamaterials or the metamaterial models of the invention include three-dimensional arrays of discrete resonators, such as wedge-shaped or prism-shaped arrays. Preferably, the array(s) of discrete resonators is periodic array(s) along at least one axis (e.g., EM radiation propagation, electric or magnetic axis). Preferably, the distance between neighboring resonators is no greater than two times of the width of each resonator.

A variety of resonators can be used for the methods of the invention. For example, in some embodiments, the resonators employed in the methods of the invention, preferably arrayed in a periodic fashion, each independently have a shape of an omega-type shape; a gammadion-type shape; an F-type shape; and E-type shape; or a y-type shape, as shown in FIGS. 1(*a*)-1(*e*). Preferably, the resonators employed in the methods of the invention each independently have a shape of an F-type shape; and E-type shape; or a y-type shape.

Figure 2:
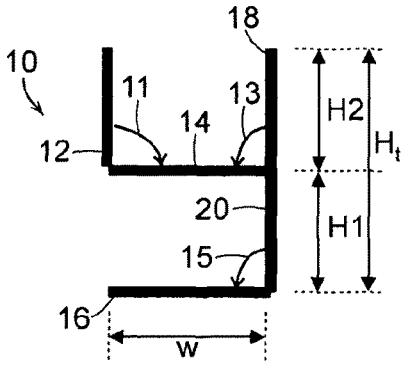
FIGS. 2(*a*)-2(*i*) are schematic representations of y-type shaped resonators of the invention: (a) a y-type shaped resonator; (b) the rotated image of FIG. 2(*a*) by 90°; (c) the rotated image of FIG. 2(*a*) by 180° (inversion image); (d) the rotated image of FIG. 2(*a*) by 270°; (e) the mirror (vertically-flipped over) image of FIG. 2(*a*); (f) the horizontally-flipped over image of FIG. 2(*a*); and (*g*)-(*i*) varied y-type shaped resonators of FIG. 2(*a*), where one or more horizontal components of the y-type shaped resonator of FIG. 2(*a*) are stretched out.
Figures 2A, 2B, 2C, 2D, 2E, 2F:
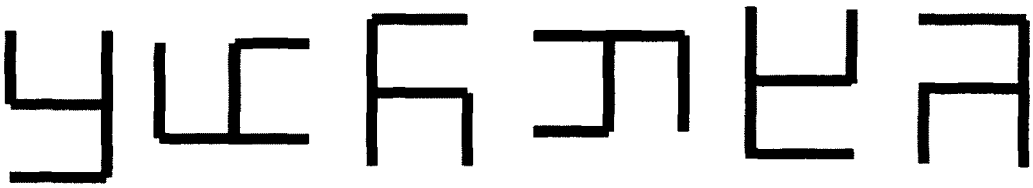
Figures 2G, 2H, 2I:
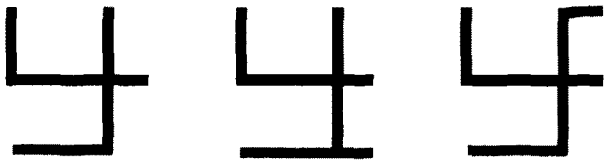

Typically, the shape of a resonator that can be used in the methods of the invention is characterized by relative orientation and relative ratio of components of the resonator. For example, as shown in FIGS. 2(*a*)-2(*i*), resonator 10 having a "y-type shape" includes components 12, 14, 16, 18 and 20. Components 12, 14, 16, 18 and 20 and their relative ratio with each other characterize the "y-type shape" of resonator 10. As used herein, the "relative ratio" includes both relative ratio in length (e.g., H1:H2 or w:$H_t$), and in orientation (or angle) (e.g., angle 11, 13 or 15). It is noted that the "shape" of the resonator that can be used in the invention encompasses its rotated shapes (e.g., by 90°, 180° (inversion image) or) 270° and their vertically-flipped over (mirror) and horizontally-flipped over images. For example, as described above, the "y-type shape" of resonator 10 of FIG. 2(*a*) includes its vertically-flipped over image (FIG. 2(*e*)), horizontally-flipped over image (FIG. 2(*f*); rotated images (e.g., by 90° (FIG. 2(*b*)); 180° (FIG. 2(*c*)); 270° (FIG. 2(*d*)). Also, each component of a resonator that can be used in the invention can be varied (e.g., shortened, lengthened, tilted, or bent), yet maintaining its general shape. As used herein, the "general shape" is considered to be maintained if the lengths and relative angles of the horizontal and vertical components of the shape are varied no greater than about 50% (such as no greater than about 30%, no greater than about 15%, no greater than about 10%, or no greater than about 5%) of the original values, respectively. For example, as shown in FIGS. 2(*g*)-2(*i*), components 12, 14, 16, 18 and 20 of resonator 10 can be varied, yet maintaining the "y-type shape" of resonator 10. In a specific embodiment, the width of a resonator that can be employed in the invention is less than about 30% of the half of the height of the resonator.

In the methods of the invention, the applied EM radiation is typically in an X-ray, radio, microwave, visible, ultraviolet or infrared region. Depending upon the largest dimension of at least one resonator, as described above, the frequency region of the applied EM radiation can be suitably varied. In a preferred embodiment, the applied EM radiation is a computationally-simulated, plane-polarized EM radiation. Plane-polarized EM radiation is generally considered as the basis for a wide range of chemists' measurements of the optical rotation of chiral compounds-such as drugs. For example, optical rotation measurements are used throughout the pharmaceutical, chemical, essential oil, flavor and food industries. There are also applications of plane-polarized EM radiation measurements in biomedical imaging.

In the invention, a parameter of a metamaterial, such as a parameter of a chiral metamaterial, is determined by forming a metamaterial model that includes array(s), preferably periodic array(s), of discrete resonators as described above. Typically, the largest dimension (e.g., width or length) of at least one resonator of the metamaterial model is smaller than at least one wavelength of EM radiation that will be applied to the chiral metamaterial model. In one embodiment, the metamaterial model, including chiral metamaterial model, is numerically formed and the EM radiation is a simulated EM radiation, such as a computationally-simulated EM radiation.

To modulate EM interaction of a metamaterial model of the invention, preferably a chiral metamaterial model, with an applied EM radiation, at least one characteristic of the metamaterial model, as described above; and/or at least one wavelength of the applied EM radiation is varied. The effect(s) of at least one characteristic of the metamaterial model and/or at least one wavelength of the applied EM radiation on EM interaction of the metamaterial model with the applied EM radiation is then assessed, whereby a parameter of a metamaterial to be formed using the metamaterial model is determined. In one embodiment, at least one characteristic of the metamaterial model is varied. In another embodiment, at least one characteristic of the metamaterial model; and at least one wavelength of the applied EM radiation are varied.

In one specific embodiment, a parameter of a metamaterial, preferably a chiral metamaterial, is determined by forming a metamaterial model that includes array(s), preferably periodic array(s), of discrete resonators, wherein at least one of the discrete resonators each has a shape that is independently selected from the group consisting of: an F-type shape; an E-type shape; and a y-type shape. In another specific embodiment, a parameter of a chiral metamaterial is determined by numerically modeling a chiral metamaterial, wherein the chiral metamaterial model includes array(s), preferably periodic array(s), of discrete resonators wherein at least one of the discrete resonators each has a shape that is independently selected from the group consisting of: an F-type shape; an E-type shape; and a y-type shape. In this specific embodiment, preferably, a simulated plane-polarized EM radiation in a visible, ultraviolet or near-infrared region is employed.

In one embodiment, the metamaterial models of the invention are formed to have negative effective permittivity and/or negative effective permeability in a frequency region, such as an applied frequency region of EM radiation. In a preferred embodiment, the metamaterial models of the invention are formed to have simultaneously negative effective permittivity and negative effective permeability in substantially the same frequency region. As used herein, having "simultaneously negative effective permittivity and negative effective permeability in substantially the same frequency region" means that a frequency region where the negative effective permittivity occurs and a frequency region where the negative effective permeability occurs are substantially overlapped with each other. In another preferred embodiment, the metamaterial models of the invention are chiral. In a more preferred embodiment, the chiral metamaterial models are formed to have simultaneously negative effective permittivity and negative effective permeability in substantially the same frequency region. In a particularly preferred embodiment, the chiral metamaterial models are formed to have simultaneously double negative transmission and/or reflection passband(s) in a terahertz (THz) frequency regime, i.e., an infrared (e.g., near-infrared), visible and ultraviolet region. In another particularly preferred embodiment, the chiral metamaterial models are formed to have simultaneously double negative transmission and/or reflection passband(s) in a visible region. In yet another particularly preferred embodiment, the chiral metamaterial models are formed to have simultaneously double negative transmission and/or reflection passband(s) in a microwave frequency regime. In yet another particularly preferred embodiment, the chiral metamaterial models are formed to have simultaneously double negative transmission passband(s) in a range between about 10 THz (terahertz) and about 1500 THz, such as between about 100 THz and about 1500 THz; between about 400 THz and about 1200 THz; between about 400 THz and about 1000 THz; or between about 400 THz and about 700 THz.

The metamaterial models and their EM interaction with EM radiation, preferably a plane-polarized EM radiation, can be formed by any suitable methods known in the art, for example, by using computational technologies known in the art.

Figure 3A:
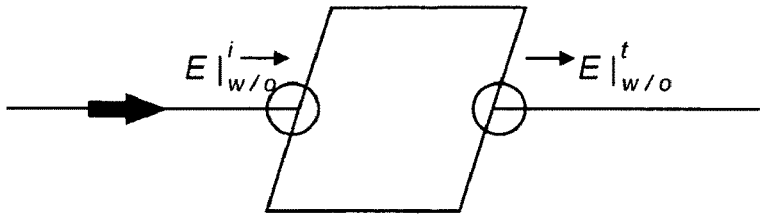
FIGS. 3(*a*) and 3(*b*) are schematic representations for incident ($E|^{t}_{w/o}$) and transmitted ($E|^{t}_{w}$) or reflected ($E|^{t}_{w}$) fields without and with a slab of resonators, respectively, in one simulated electromagnetic interaction system of the invention.
Figure 3B:
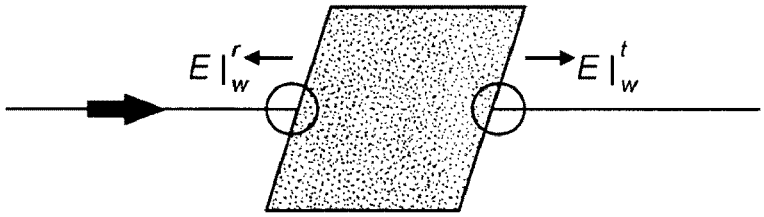
Figure 3C:
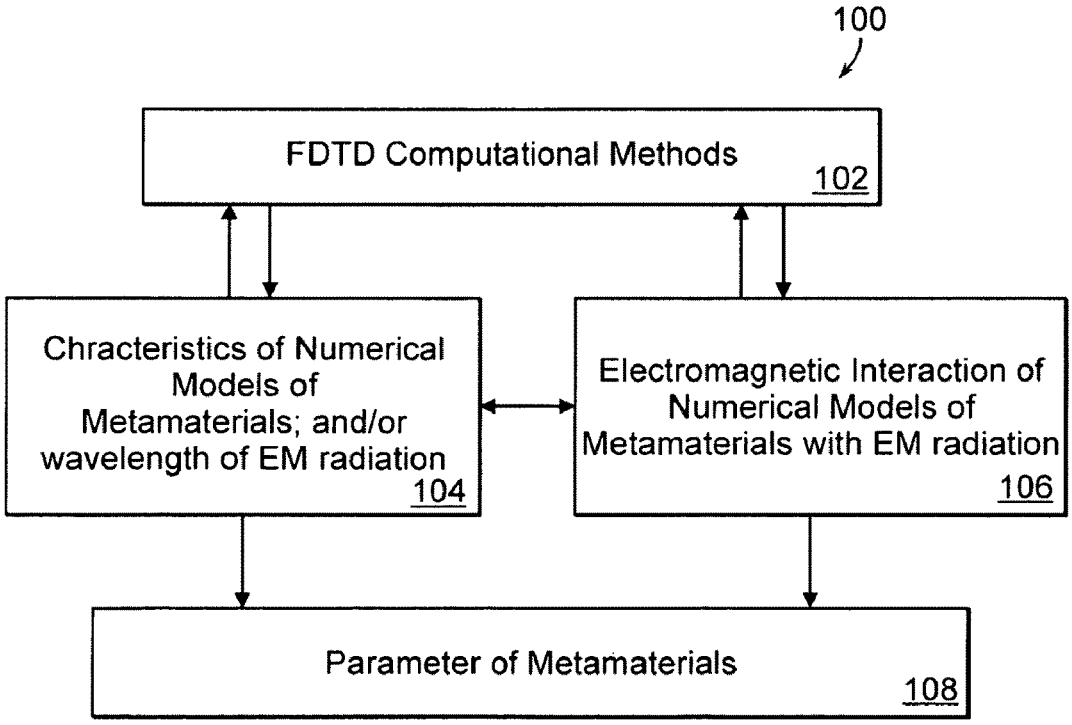
Figure 4B:
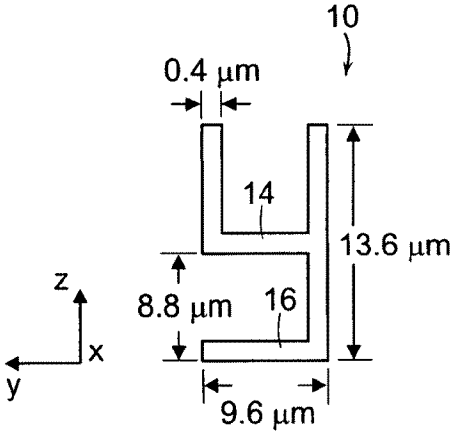
FIG. 4(*a*) is a schematic representation of a three-dimensional Finite-Difference Time-Domain (FDTD) model of the invention that includes a slab of y-type shaped resonators.
Figure 4A:
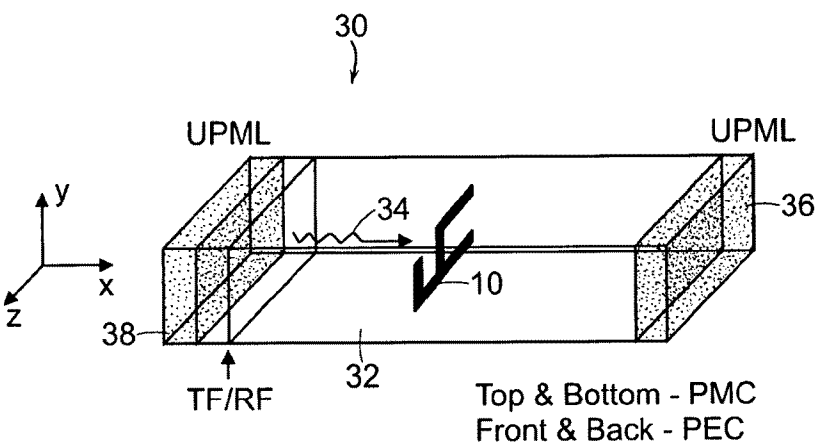
Figure 5B:
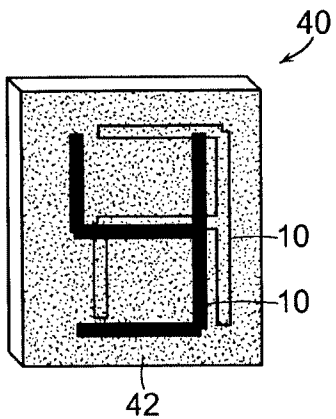
FIGS. 5(*a*)-5(*b*) are schematic representations of slabs (resonator plane) employed in one embodiment of the invention, which include: (a) one type of a y-type shaped resonator at the front side of the slab; and (b) two different types of a y-type shaped resonator at the front and back sides of the slab.
Figure 5A:
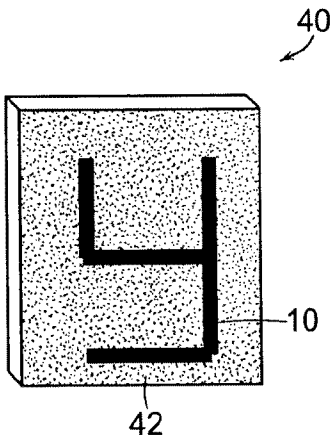
Figure 5C:
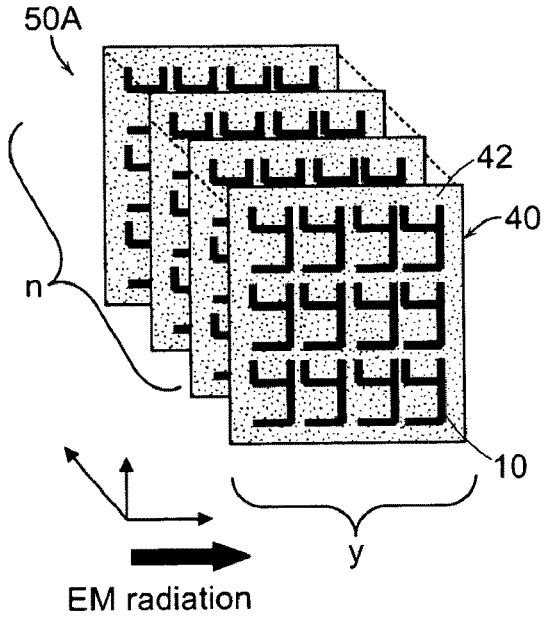
Figure 5D:
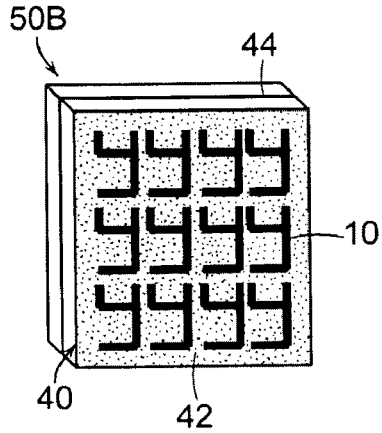

In one embodiment, a numerical method based on the three-dimensional Finite-Difference Time-Domain (FDTD) technique is utilized in the invention for forming numerical metamaterial models and analyzing their EM interaction to determine a parameter of metamaterials, including a number of discrete resonators, to be formed. The FDTD technique generally allows for determining the behavior of electromagnetic interaction in finite or periodic 3-D media composed of an arbitrary or periodic arrangement of resonators. A free space measurement system can be simulated to test the FDTD models, as shown in FIGS. 3(*a*) and 3(*b*). Free space simulations without a metamaterial (slab(s)) are taken to establish a reference. As shown in FIG. 3(*c*), in method 100 of one embodiment of the invention, at least one characteristic of numerical models of metamaterials and/or at least one wavelength of EM radiation applied to the numerical models is varied (104) and the FDTD computational method (102) is used for analyzing EM interaction of the numerical models of metamaterials (106), thereby to determine parameter(s) of metamaterials (108). In one example of this embodiment, as shown in FIGS. 4(*a*)-4(*b*), FDTD metamaterial model 30 is composed of a semi-infinite periodic array of resonators (an array of an effectively finite resonators along the propagation axis of EM radiation, and infinite resonators along the two axes perpendicular to the direction of propagation of EM radiation), such as y-type shaped resonators 10, at free space 32 inside a waveguide. Perfect electric conductor (PEC) walls and perfect magnetic conductor (PMC) walls are located in the transverse direction and in the direction of periodicity, from the boundary conditions of the models. Gaussian beam 34, normally propagating through the waveguide, is used as a source of the plane-polarized EM radiation irradiation at one of the two input ports. Uniaxial perfectly matched layers 36 and 38 (UPML) are set at the ends of the ports of FDTD model 30 to absorb the outgoing waves. Maxwell's three dimensional equations can be used to calculate electromagnetic fields in Cartesian coordinates, as shown below in equation (1):

$$-\frac{\partial B_x}{\partial t} = \frac{\partial E_x}{\partial Y} - \frac{\partial E_y}{\partial z} \quad -\frac{\partial D_x}{\partial t} = \frac{\partial H_x}{\partial y} - \frac{\partial H_y}{\partial z} - J_x \tag{1}$$

$$-\frac{\partial B_y}{\partial t} = \frac{\partial E_x}{\partial z} - \frac{\partial E_z}{\partial x} \quad -\frac{\partial D_x}{\partial t} = \frac{\partial H_x}{\partial y} - \frac{\partial H_y}{\partial z} - J_x$$

$$-\frac{\partial B_z}{\partial t} = \frac{\partial E_y}{\partial x} - \frac{\partial E_x}{\partial y} \quad -\frac{\partial D_x}{\partial t} = \frac{\partial H_x}{\partial y} - \frac{\partial H_y}{\partial z} - J_x$$

where B, D, E and J represent the magnetic field density, the electric field density, the electric field, and the surface current density, respectively.

FDTD maps the curl equations into the discrete space by the Yee-scheme. Faraday's law can be expressed in a discretized form as:

$$H_{x_{i,j,k}}^{n+\frac{1}{2}} = H_{x_{i,j,k}}^{n-\frac{1}{2}} + \frac{\Delta t}{\mu \Delta z}\left[E_{y_{i,j,k+1}}^{n} - E_{y_{i,j,k}}^{n}\right] - \frac{\Delta t}{\mu \Delta y}\left[E_{z_{i,j+1,k}}^{n} - E_{z_{i,j,k}}^{n}\right] \quad (2)$$

$$H_{y_{i,j,k}}^{n+\frac{1}{2}} = H_{y_{i,j,k}}^{n-\frac{1}{2}} + \frac{\Delta t}{\mu \Delta x}\left[E_{z_{i+1,j,k}}^{n} - E_{z_{i,j,k}}^{n}\right] - \frac{\Delta t}{\mu \Delta z}\left[E_{x_{i,j,k+1}}^{n} - E_{x_{i,j,k}}^{n}\right]$$

$$H_{z_{i,j,k}}^{n+\frac{1}{2}} = H_{z_{i,j,k}}^{n-\frac{1}{2}} + \frac{\Delta t}{\mu \Delta y}\left[E_{x_{i,j+1,k}}^{n} - E_{x_{i,j,k}}^{n}\right] - \frac{\Delta t}{\mu \Delta x}\left[E_{y_{i+1,j,k}}^{n} - E_{y_{i,j,k}}^{n}\right]$$

where H, E and μ represent the magnetic field, the electric field and the effective magnetic permeability, respectively.

Ampere's law can be expressed in a discrete form as:

$$E_{x_{i,j,k}}^{n+1} = E_{x_{i,j,k}}^{n} - \frac{\Delta t}{\varepsilon \Delta z}\left[H_{y_{i,j,k}}^{n+\frac{1}{2}} - H_{y_{i,j,k-1}}^{n+\frac{1}{2}}\right] + \frac{\Delta t}{\varepsilon \Delta y}\left[H_{z_{i,j,k}}^{n+\frac{1}{2}} - H_{z_{i,j-1,k}}^{n+\frac{1}{2}}\right] \quad (3)$$

$$E_{y_{i,j,k}}^{n+1} = E_{y_{i,j,k}}^{n} + \frac{\Delta t}{\varepsilon \Delta x}\left[H_{z_{i,j,k}}^{n+\frac{1}{2}} - H_{z_{i-1,j,k}}^{n+\frac{1}{2}}\right] + \frac{\Delta t}{\varepsilon \Delta z}\left[H_{x_{i,j,k}}^{n+\frac{1}{2}} - H_{x_{i,j,k-1}}^{n+\frac{1}{2}}\right]$$

$$E_{z_{i,j,k}}^{n+1} = E_{z_{i,j,k}}^{n} + \frac{\Delta t}{\varepsilon \Delta y}\left[H_{x_{i,j,k}}^{n+\frac{1}{2}} - H_{x_{i,j-1,k}}^{n+\frac{1}{2}}\right] + \frac{\Delta t}{\varepsilon \Delta x}\left[H_{y_{i,j,k}}^{n+\frac{1}{2}} - H_{y_{i-1,j,k}}^{n+\frac{1}{2}}\right]$$

where H, E and μ represent magnetic field, electric field and effective electric permittivity, respectively.

Equations (2) and (3) are used in the three dimensional FDTD implementation. The initial electric and magnetic fields in all three dimensions are set to zero in the first time step and updated in each subsequent time step. The effective electric permittivity and effective magnetic permeability in free space are set to one. A Gaussian pulse plane wave is the specified incident field. The plane wave is not only simple to implement, but also generally provides a smooth roll off in frequency specific band as well as a capability of modeling arbitrary angles of incidence. The plane wave can be set up using the total-field/scattered field (TF/SF) technique. The TF/SF formulation can realize a plane-wave source that avoids difficulties caused by using either a hard source or an initial-condition approach. The TF/SF formulation is based on the linearity of Maxwell's equations. It assumes that the physical (measurable) total electric and magnetic fields $\vec{E}_{total}$ and $\vec{H}_{total}$ can be decomposed in the following manner:

$$\vec{E}_{total} = \vec{E}_{inc} + \vec{E}_{scat}$$

$$\vec{H}_{total} = \vec{H}_{inc} + \vec{H}_{scat} \quad (4)$$

The FDTD calculations generally require the computational domain to be terminated with boundaries that prevent non-physical reflections form bouncing back into the computational domain. The UPML boundary is generally one of the most popular techniques used to absorb the electromagnetic fields. The number of time steps is set at, for example, 20,000 to make sure that there is no leftover field inside the simulation model. The electric fields are collected at the input and output ports. These electric fields versus time data are transformed into the frequency domain using fast Fourier transform (FFT). A reflection or transmission coefficient at each frequency is calculated by dividing the corresponding transforms for the reflected ($(E|^{r}_{w})$), or transmitted ($E|^{t}_{w}$), respectively, and incident fields ($E|^{i}_{w/o}$). These fields are shown in FIGS. 3(*a*) and 3(*b*).

The reflection (R) and transmission (T) coefficients can be calculated from equations (5) and (6), respectively:

$$R = \frac{FFT(E|_{w}^{r} - E|_{w/o}^{i})}{FFT(E|_{w/o}^{i})} \quad (5)$$

$$T = \frac{FFT(E|_{w}^{t})}{FFT(E|_{w/o}^{i})} \quad (6)$$

The chirality of metamaterial models of the invention can be assessed by cross-polarization field properties of metamaterial models, such as cross-polarized transmission. Generally, the cross-polarization field produces the cross-polarized transmission coefficient(s) which can be smaller or larger than the co-polarized transmission coefficient(s). The rotation of the polarization of the incident EM wave is caused by the chirality of materials. In one embodiment, cross-polarized transmission coefficient(s) and co-polarized transmission coefficient(s) can be calculated by the three-dimensional electric fields described in Equations (1)-(6). By analyzing the cross-polarized transmission coefficient(s) and co-polarized transmission coefficient(s), the chirality of metamaterial models of the invention can be assessed, e.g., difference between the cross-polarized and co-polarized transmission coefficients that is caused by the chirality of metamaterial models.

Typically, the frequency of operation of the metamaterial model is set by the dimensions of the resonators included in the metamaterial model. In one embodiment, the applied frequency region is larger than the largest dimension of resonators of the metamaterial models. For example, for generating a double negative (DNG) passband at about 0.5 THz, for the x, y and z directions, the metamaterial model is set to have the dimensions of 51, 29, and 39 grid cells in x, y and z directions, respectively, where one grid cell is equal to 0.4 microns.

Referring back to FIG. 4(*a*)-4(*b*), horizontal components 14 and 16 of resonator 10 can be placed perpendicular or parallel to the direction of propagation of electromagnetic radiation 34.

Referring to FIGS. 5(*a*)-5(*b*), a resonator plane, Slab 40, can include array(s) of one type of resonators or alternatively two different types of resonators. In one example, as shown in FIG. 5(*a*), slab 40 includes array(s) of resonators having a y-type shape at one side of slab 40. In anther example, as shown in FIG. 5(*b*), slab 40 includes array(s) of resonators having a y-type shape at one side of slab 40 and the inversion image of the y-type shape at the other side of slab 40.

Typically, the metamaterial models include a finite number of discrete resonators, preferably periodically-arrayed resonators, along a propagation axis of EM radiation. Along a direction perpendicular to the propagation direction of EM radiation, the metamaterial models can be treated as having an infinite periodic array. In some embodiments, only along a propagation direction of EM radiation, the metamaterial models are treated to include a finite number of discrete resonators. In other embodiments, along a propagation direction of EM radiation and along at least one of the directions perpendicular to the propagation direction of EM radiation (e.g., "y" and "z" directions in FIG. 4(*a*)), the metamaterial models are treated to include a finite number of discrete resonators.

A number of discrete resonators of metamaterials that are arrayed in a direction perpendicular to a propagation axis of EM radiation can also be determined by the use of the metamaterial models of the invention. Varying the number of discrete resonators of the metamaterial models that are arrayed in a direction perpendicular to a propagation axis of an applied EM radiation modulates EM interaction of the metamaterial models with the applied EM radiation. The number of discrete resonators of the metamaterial models that are arrayed in a direction perpendicular to a propagation axis of an applied EM radiation to obtain substantially the same EM interaction as that of the metamaterial models having an infinite periodic array of the discrete resonators in the same perpendicular direction can thus be determined by the methods of the invention described above. Thus, the number of discrete resonators of metamaterial models along an axis perpendicular to the EM radiation propagation axis (e.g., number "n" of slab 40 in FIG. 5(*c*)) is varied and their EM interaction is analyzed until provision of additional discrete resonators along the perpendicular axis does not substantially change EM interaction of the metamaterial model. The number of discrete resonators can be determined in either one of the directions (i.e. the axis of the electric (E) or magnetic (H) field) perpendicular to the propagation axis (i.e., the "k" axis). As used herein, a metamaterial that includes a "semi-infinite" periodic array of discrete resonators means that the metamaterial includes an effectively infinite periodic array of the discrete resonators along both of the direction(s) perpendicular to the propagation direction of EM radiation; and a finite number of discrete resonators in the propagation direction of EM radiation.

Using the numerical metamaterial models and simulation methods, as described above, the number of the resonators of the chiral metamaterial models along a propagation axis of EM radiation can also be varied and EM interaction of the models can be simulated. For example, an optimized number of discrete resonators arrayed along the EM radiation propagation axis to obtain a desired EM interaction (e.g., DNG transmission band(s)) can thus be determined.

The present invention also is directed to a method of designing a chiral metamaterial that has simultaneously effective negative electric permittivity and effective negative magnetic permeability in a frequency region (i.e., a chiral DNG metamaterial), preferably in a visible, ultraviolet, or near-infrared region. Circuit-equivalent(s) (circuit-equivalent 60 in FIGS. 7(*a*)-7(*c*)) of resonator(s) (resonators 10A and 10B in FIGS. 7(*a*)-7(*c*)) of resonators at a dielectric media is formed. At least one characteristic of the resonator(s), such as the dimension and/or the shape of the resonator(s), is varied to thereby derive negative effective permittivity and negative effective permeability in a desired frequency region from the circuit-equivalent(s). In one embodiment, the effective electric permittivity of a resonator is calculated using the Drude-Lorentz model. For example, the effective permittivity ($\in_{eff}$) of a rod-type resonator (see FIG. 6(*a*)) in the Drude-Lorentz model can be given as below:

$$\varepsilon_{eff} = 1 - \frac{\omega_{ep}^2 - \omega_{e0}^2}{\omega^2 - \omega_{e0}^2 + i\gamma\omega} \tag{7}$$

where $\omega_{e0}$ is the electric resonant frequency introduced by the interruption in the rod and is determined by the inductance of the wire strips $L_e$ and the capacitance $C_e$ of the interruption; $\omega$ is the frequency; i is the imaginary number (sqrt (−1)); $\gamma$ is the damping factor; and $\omega_{ep}$ is the plasma resonant frequency (see, for example, Sievenpiper, D. F. et al., *Phys. Rev. Lett.*, Vol. 80, 2829-2832, 1998). In one specific example, varying the shape of the simple rod resonator, e.g., introducing horizontal components (arms) that can increase the value of $C_e$, can increase or lower the electric resonant frequency $\omega_{e0}$ of the rod resonator, as desired, thereby designing a resonator that can be included in a metamaterial of the invention. In a preferred embodiment, the resonator designed by the method described above is an F-type shaped, E-type shaped, or y-type shaped resonator, as described above.

Similarly, the magnetic resonant frequency of a circuit equivalent of a resonator to be designed can be calculated using the Drude-Lorentz model. In one specific embodiment, the magnetic resonant frequency of circuit-equivalent 60 of y-type shaped resonators 10A and 10B (see FIGS. 7(*a*)-7(*c*)) is calculated as below:

$$L = \mu\frac{\left[(w-2h)\left(\frac{(H_1+H_2)-3h}{2}\right)\right]}{l_p} \approx \mu\frac{w(H_1+H_2)}{2l_p} \tag{8}$$

$$L_T = \frac{1}{\frac{1}{L}+\frac{1}{L}} = \frac{L}{2}$$

$$C_1 = \frac{\varepsilon_0 hw}{d} + \frac{\varepsilon_0 hw}{l-d}$$

Figure 7A:
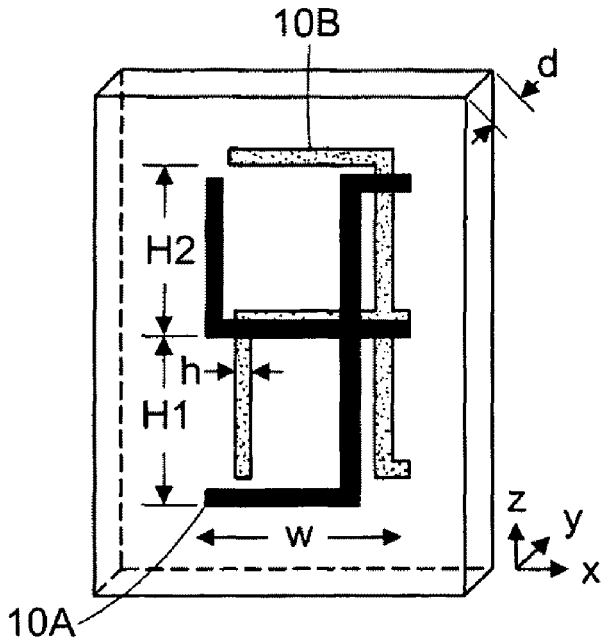
FIGS. 7(*a*)-7(*c*) are schematic representations of: (a) y-type shaped resonators; and (b)-(c) equivalent circuits of the y-type shaped resonators of FIG. 7(*a*).
Figure 7B:
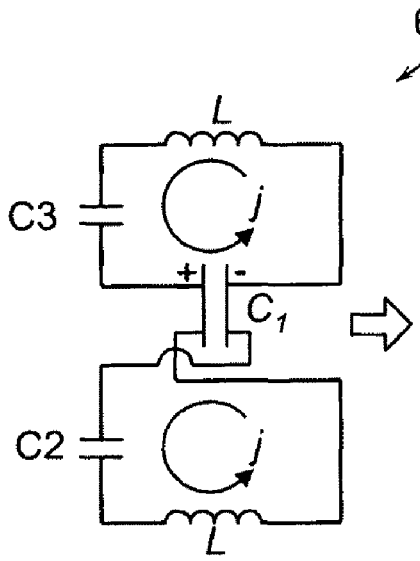
Figure 7C:
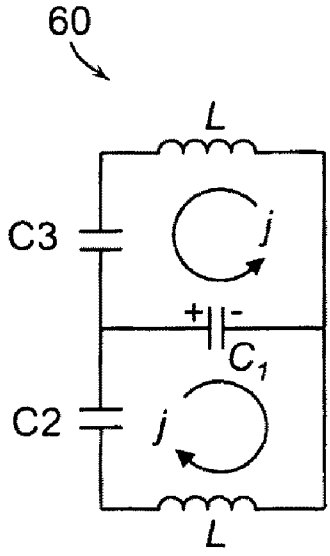

($l$ is a period of the structure array in $y$-direction)

$$C_2 = \frac{\varepsilon_0 hH_1}{d} + \frac{\varepsilon_0 hH_1}{l-d};\ C_3 = \frac{\varepsilon_0 hH_2}{d} + \frac{\varepsilon_0 hH_2}{l-d}$$

$$C_T = \frac{1}{\frac{1}{C_1}+\frac{1}{C_2+C_3}} = \frac{C_1(C_2+C_3)}{C_1+C_2+C_3}$$

$$\text{If } C_1 = C_2 = C_3,\ C_T = \frac{2C}{3}\ (\text{if } C_1 << C_2 \text{emf} = 0)$$

$$\omega_{mo} = \sqrt{\frac{1}{L_T C_T}} = \sqrt{\frac{1}{(L/2)(2C/3)}} = \sqrt{\frac{3}{LC}}$$

where L is an inductance of each half ring of the "y-type shaped" resonator shown in FIG. 7(*a*); w, $H_1$, $H_2$ and h are the width, heights and thickness of the resonator, respectively; C1, C2 and C3 are capacitances as indicated in FIG. 7(*b*)-7(*c*); $L_T$ is a total inductance of the resonator; $C_T$ is a total capacitance of the resonator; $\omega_{m0}$ is the magnetic resonant frequency; $\in_0$ and $\mu_0$ are respectively the free space electric permittivity and magnetic permeability. As with the electric resonant frequency, varying at least one characteristic of the resonator(s) (e.g., the dimension and/or the shape of the resonator(s)), such as introducing horizontal components (arms), can vary inductance (L) and/or capacitance (e.g., C1, C2, C3) to thereby increase or lower the magnetic resonant frequency $\omega_{m0}$ of the resonator, as desired.

Such a designed resonator can then be used for forming a metamaterial model that includes array(s) of resonators having at least one characteristic that is substantially the same as the resonator designed from the circuit-equivalent(s). Formation of such a metamaterial model and simulation of its EM interaction can be performed by the methods described above. Metamaterials having at least one characteristic that is essentially the same as the metamaterial models can be fabricated by suitable methods known in the art, as described below.

The present invention also is directed to metamaterials that include a dielectric substrate and an array, preferably periodic array, of discrete resonators, wherein each of the discrete resonators has a shape that is independently selected from the group consisting of: an F-type shape; an E-type shape; and a y-type shape. Features of a resonator having at least one of these shapes and features of an array of such resonators, including the dimension and distance(s) (period(s)) between resonators, are as described above for the metamaterial models. In one embodiment, the largest dimension of the discrete resonators is smaller than a wavelength of EM radiation in a visible, ultraviolet, infrared, microwave or X-ray region, such as a visible, ultraviolet, infrared or microwave region; or a visible, ultraviolet or infrared region. Preferably, the largest dimension of the discrete resonators is smaller than a wavelength of EM radiation in a visible, ultraviolet or near-infrared region, more preferably in a visible region.

In one specific embodiment, as shown in FIGS. 5(*c*)-5(*d*), metamaterial 50 (collectively referred to for metamaterials 50A and 50B of FIGS. 5(*c*)-5(*d*)) of the invention includes dielectric substrate 42 and array(s) of discrete resonators 10 at dielectric substrate 42. The dielectric substrate 42 can be in layers or alternatively in a block form. Metamaterials 50 of the invention can include multiple layers of slab 40 (resonator plane) or alternatively a block of slab 40. As shown in FIG. 5(*d*), when multiple layers of slab 40 are employed, optionally suitable spacer material 44, which could be the same dielectric material as substrate 42 or a different dielectric material, can be used between the layers.

In some embodiments, the metamaterials of the invention can include one or more defects in an array, for example, along an EM radiation propagation axis, preferably the defects being close to the edge of the array. As used herein, the "one or more defects" mean missing resonators in an array. The number of missing resonators in an array can be any number as long as EM interaction (e.g., transmission characteristics) of the metamaterials having the defects are substantially the same as that of the metamaterials having no defects. For example, in a metamaterial having 20 discrete resonators, such as y-type shaped resonators, that are arrayed along an EM radiation propagation axis, the number of missing resonators in the metamaterial can be one, two, three, four or five. All of the missing resonator(s) can be at neighboring positions in an array, or alternatively each at different positions. In one example, in a metamaterial having 20 discrete resonators that are arrayed along an EM radiation propagation axis, the missing resonator(s) can be at any position(s) 3-17.

Any suitable types of dielectric materials can be used for dielectric substrate 42. Examples of dielectric materials that can be used in the invention include polymers, such as Teflon, polystyrene, polycarbonate and polyesters (e.g. MYLAR®); ceramics, quartz; glass; silicon dioxide; and sapphire substrates. The dielectric substrate can be in layers or alternatively in a block form.

In one embodiment, the metamaterials of the invention are chiral metamaterials. In another embodiment, the metamaterials of the invention have negative effective permittivity and/or negative effective permeability in a frequency region, such as an applied frequency region of EM radiation. In one preferred embodiment, the metamaterials of the invention are chiral and have simultaneously both negative effective permittivity and negative effective permeability in substantially the same frequency region, such as in a visible, ultraviolet, infrared, microwave or X-ray region. In a particularly preferred embodiment, the metamaterials of the invention are chiral and have simultaneously double negative transmission and/or reflection passband(s) in a terahertz (THz) frequency regime, i.e., an infrared (e.g., near-infrared), visible and ultraviolet region. In another particularly preferred embodiment, the metamaterials of the invention are chiral and have simultaneously double negative transmission and/or reflection passband(s) in a visible region. In yet another particularly preferred embodiment, the metamaterials of the invention are chiral and have simultaneously double negative transmission and/or reflection passband(s) in a microwave frequency regime. In yet another particularly preferred embodiment, the metamaterials of the invention chiral and have simultaneously double negative transmission passband(s) in a range between about 10 THz (terahertz) and about 1500 THz, such as between about 100 THz and about 1500 THz; between about 400 THz and about 1200 THz; between about 400 THz and about 1000 THz; or between about 400 THz and about 700 THz.

Metamaterials of the invention can be prepared by any suitable methods known in the art, for example, standard lift-off and photolithography techniques. For example, pattern(s) (shape(s): e.g., y-type shapes) of a conductive material, such as Ag, Au, Al, Cu, Pt, Pd, Si, and their metal alloys; preferably Al, Cu and their alloys, are formed on the layer(s) or block of the dielectric material described above. The pattern(s) of conductive materials can be formed by the use of a thin film deposition technology, such as the chemical vapor deposition, atomic layer chemical vapor deposition, electron-beam evaporation or sputtering technology. Once the conductive materials have been deposited, the material not being used is etched away using standard micro-photolithography etching, or other techniques.

The invention is illustrated by the following examples which are not intended to be limiting in any way.

EXEMPLIFICATION

Example 1

Simulation and Modeling of Metamaterials Having "Y-Type" Shaped Resonators

Three-dimensional (3D) Finite-Difference Time-Domain (FDTD) analysis of the electromagnetic wave interaction of an array of "y-type shaped" resonator was conducted to obtain transmission and reflection coefficients in the terahertz (THz) frequency regime. Referring to FIGS. 4(*a*)-4(*b*), FDTD model 30 was composed of a semi-infinite periodic array of "y-type shaped" resonators 10 embedded within free space 32 inside a waveguide. Perfect electric conductor (PEC) walls and perfect magnetic conductor (PMC) walls located in the transverse direction and in the direction of periodicity, respectively, formed the boundary conditions of FDTD model 30. Gaussian beam 34, normally propagating through the waveguide was used as a source of the excitation at one of the two input ports. Uniaxial perfectly matched layers (UPML) 36 and 38 were set at the ends of the ports to absorb the outgoing waves.

Maxwell's three dimensional curl equations, Faraday's law and Ampere's law used to calculate electromagnetic fields in Cartesian coordinates are as described above in equations (1)-(3).

Equations (2) and (3) were used in the three dimensional FDTD implementation. The initial electric and magnetic fields in all three dimensions were set to zero in the first time step and updated in each subsequent time step. The effective permittivity and permeability in free space were set to one. A Gaussian pulse plane wave was the specified incident field. The plane wave was set up using the total-field/scattered field (TF/SF) technique. The TF/SF formulation resulted from attempts to realize a plane-wave source that avoids the difficulties caused by using either a hard source or an initial-condition approach. The TF/SF formulation was based on the linearity of Maxwell's equations. It assumed that the physical (measurable) total electric and magnetic fields $\vec{E}_{total}$, and $\vec{H}_{total}$ can be decomposed in the manner described above in Equation (4).

The FDTD calculations required the computational domain to be terminated with boundaries that can prevent non-physical reflections form bouncing back into the computational domain.

The number of time steps was set at 20,000 to make sure that there was no leftover field inside the simulation model. Electric fields were collected at the input and output ports. These electric fields versus time data were transformed into the frequency domain using fast Fourier transform (FFT). The complex reflection (and transmission) coefficient at each frequency was calculated by dividing the corresponding transforms for the reflected (transmitted) and incident fields. These fields are shown in FIGS. 3(*a*)-3(*b*). The reflection and transmission coefficients were calculated from Equations (5) and (6) described above, respectively.

FDTD models 30 were designed to generate the double negative (DNG) passband at around 500 GHz (or 0.5 THz). The frequency of operation of (UPML) FDTD models 30 was set by the dimensions of the models. For the x, y and z directions, FDTD models 30 had the dimensions of 51, 29, and 39 grid cells respectively, where one grid cell was equal to 0.4 μm ($0.4\times10^{-6}$ meters). UPML layers 36 and 38 each independently had a thickness of 10 grid cells. The excitation was set in the y-z plane, where x=12 grid cells, using the TF/SF technique; therefore, the wave propagated along the x-direction. Slab 40 (resonator plane) was placed perpendicular to the direction of propagation. The electric field was along the z-axis, which was parallel to the long axis of the "y-type shaped" structure so that the magnetic field (along y-axis) was parallel to the base arm of the resonator. The "y-type shape" resonator 10 was modeled as a perfect electric conductor (PEC) where the tangential electric field was set to zero. The thickness of resonator 10 was 0.4 μm (1 grid cell). The height (long axis) and the width (short axis) of resonator 10 were 13.6 μm and 9.6 μm, respectively. Centered axis 14 began at 8.8 μm from base 16. Each line width was 0.4 μm.

Example 2

Figures 6A, 6B, 6C, 6D:
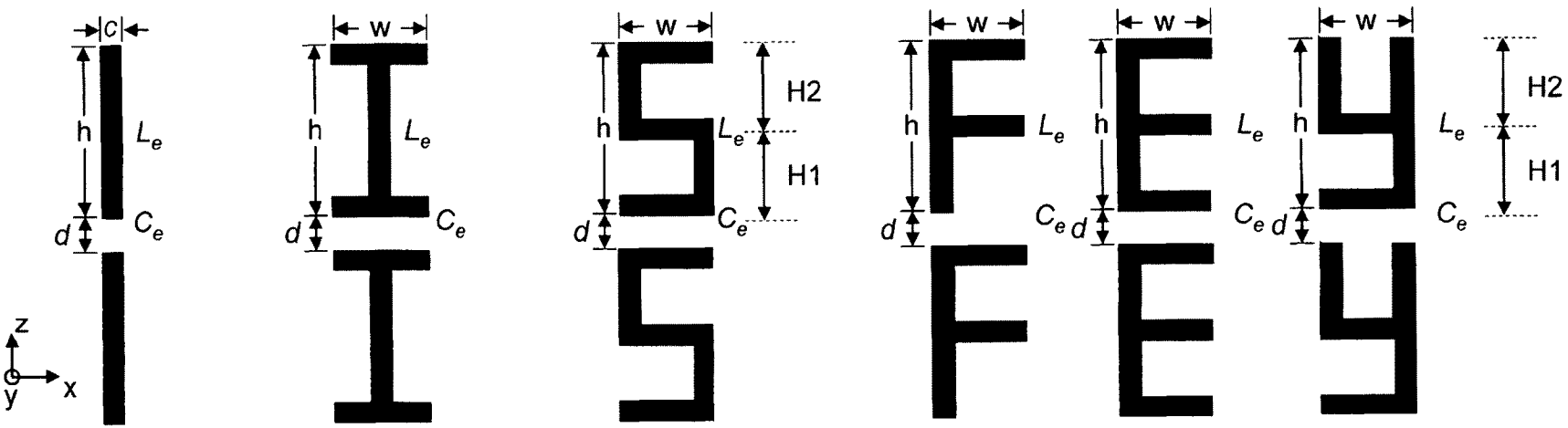
FIGS. 6(*a*)-6(*d*) are schematic representations of rod-type, I-type, S-type, F-type, E-type, and y-type resonators that can be employed in a method of one embodiment of the invention.

Designing Double Negative Metamaterials: Prediction of Electric Resonant Frequency and Magnetic Resonant Frequency of "F-Type", "E-Type" and "Y-Type" Shaped Resonators The Drude-Lorentz model of the effective permittivity for a resonator including an array of rods is given as described above in Equation (7). As shown in FIG. 6(*b*), the two horizontal lines introduced in each break of the rod shape of FIG. 6(*a*) can enlarge the surface area of the capacitance, Ce. This will lower the electric resonant frequency $\omega_{e0}$. Similarly, by bending the vertical rod of FIG. 6(*a*) and creating the "S" shape as shown in FIG. 6(*c*), $\omega_{e0}$ and $\omega_{ep}$ can be further lowered. F-type, E-type, and y-type shaped resonators are all constructed with main vertical axes (vertical components) combined with arms (horizontal components) that can increase the value of $C_e$ (see FIG. 6(*d*)). Thus, it is expected that these shapes will scale down the location of the negative permittivity ($-\in$), based upon the observations reported in the art for the resonators of FIGS. 6(*a*)-6(*c*) showing negative permittivity (see, for example, Pendry, J. B. et al. *Phys. Rev. Lett.*, Vol. 76, 4773-4776, 1996; and Sievenpiper, D. F. et al., *Phys. Rev. Lett.*, Vol. 80, 2829-2832, 1998).

The magnetic resonant frequencies of the "F-type shaped", "E-type shaped", and "y-type shaped" resonators were calculated as described above in Equation (8). In this calculation, it was assumed that an inductance L of each half ring was directly proportional to the area enclosed by each ring. Because the width "w" and the heights "$H_1$" and "$H_2$" were set to be equal, the capacitances $C_1$, $C_2$ and $C_3$ were supposed to have the same value. On the other hand, if the capacitance $C_1$ was set non-existent or very small, the capacitance $C_1$ could be treated as an open circuit. In this case, Faraday's law indicated that when a time-varying external magnetic field was applied, the total electromotive force around the circumference of the figure-eight pattern ((FIG. 7(*a*)) became zero, as the magnetic fluxes in the top half and bottom-half areas of the figure-eight-pattern structure (FIG. 7(*a*)) always canceled each other. However, here $C_1$ was supposed to be large and equal to $C_2$ and $C_3$, so that the existence of $C_1$ enables the current to flow in each half ring, as shown in FIG. 7(*c*).

The magnetic resonant frequencies of F-type and E-type shaped resonators were also calculated using the methods described above for F-type shaped resonator. The calculated magnetic resonant frequencies are summarized in Table 1, including those for simplified split-ring resonator (SRR) and S-type shaped resonator.

TABLE 1

Magnetic resonant frequencies for various types of resonators

| | Resonators | Magnetic Resonant frequency |
|---|---|---|
| 1. | Simplified SRR | $\sqrt{\frac{1}{LC}}$ |
| 2. | S-shaped resonator | $\sqrt{\frac{3}{LC}}$ |
| 3. | F-shaped resonator | $\sqrt{\frac{3}{LC}}$ |
| 4. | E-shaped resonator | $\sqrt{\frac{3}{LC}}$ |
| 5. | y-shaped resonator | $\sqrt{\frac{3}{LC}}$ |

As shown above, the calculated magnetic resonant frequency for the simplified SRR structure is $\sqrt{1/LC}$ while the S-type shaped resonator has the frequency $\sqrt{3}$ times higher than that of the simplified SRR. Similarly, the magnetic resonant frequencies of F-type, E-type and Y-type shaped resonators are each times higher than that of the simplified SRR. With this high resonance, the F-type, E-type and Y-type shaped resonators can produce a DNG passband.

Example 3

Transmittance Properties of Metamaterial Models

Three-dimensional Finite-Difference Time-Domain (FDTD) analysis of the electromagnetic wave interactions with metamaterials models was conducted to obtain the transmission/reflection coefficients for chiral metamaterials with resonators in the nanoscale dimension range (visible, ultraviolet, near-IR regions). An FDTD model was composed of an infinite periodic array of S-type, F-type, E-type or y-type shaped resonators embedded within a dielectric slab located inside a waveguide. Perfect electric conductor (PEC) walls and perfect magnetic conductor (PMC) walls located in the transverse direction and in the direction of periodicity respectively, form the boundary conditions of the model. A Gaussian beam, normally propagating through a slab was used as the source of excitation, at one of the two input ports.

Figure 8B:
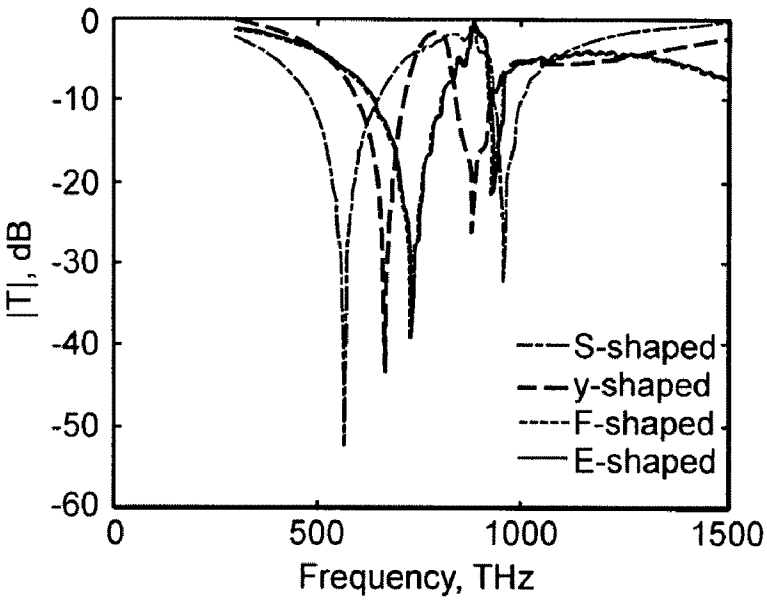
FIGS. 8(*a*) and 8(*b*) are graphs showing simulated transmission coefficients of chiral metamaterial models that include an array of S-type shaped resonators (solid line), y-type shaped resonators (dotted line), F-type shaped resonators (dashed line), and E-type shaped resonators (dash-dot line), each of the resonators having the dimension of: (a) width (w)=H1=H2=60 nm and (b) w=60 nm, H1=80 nm and H2=40 nm.
Figure 8A:
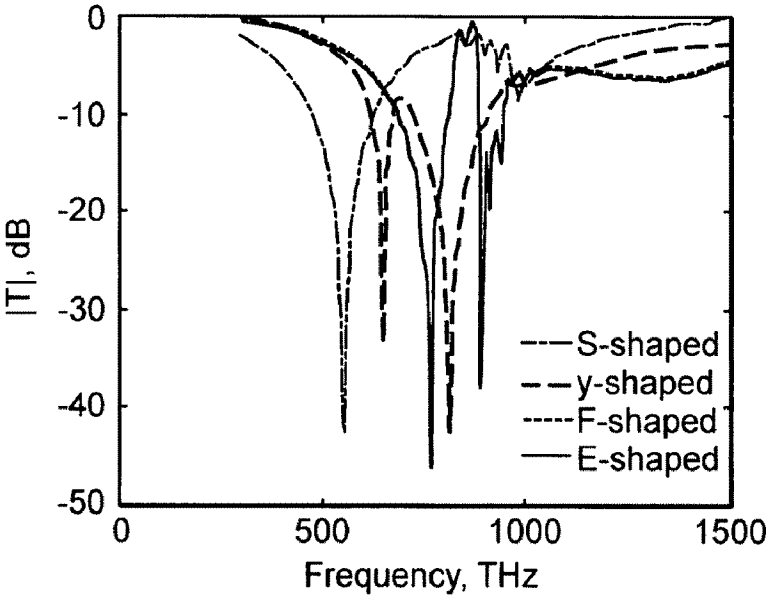

The results shown in FIG. 8(*a*) were obtained from the computation of the S-type, F-type, E-type and y-type shaped resonators where the width, "w" and heights "H1" and "H2" are set to be equal to 60 nm ($60\times10^{-9}$ meters), using the method described above in Example 1. The width and the thickness of each line were 8 nm. The passbands for all four structures occurred at the same visible frequency regime of 500-1000 THz.

The bandwidth of the transmission coefficient of the S-type shaped resonator was widest at about 480 THz. The F-type, E-type and y-type shaped resonators had about the same width of the passband at 170 THz. However, the F-type and E-type shaped resonators had better transmission bands, which were close to 0 dB while the y-type shaped resonator produced the band at −8 dB. When the ratio of H1 to H2 varied (see FIGS. 1(*a*)-1(*c*)), the resonators improved their passbands. FIG. 8(*b*) shows the results of S-type, F-type, E-type, and y-type shaped resonators when H1 was two times longer than H2. (w=60 nm, H1=80 nm, and H2=40 nm). The results show that the four DNG resonators have very effective passband that are close to 0 dB.

As shown in FIGS. 8(*a*) and 8(*b*), the transmission coefficients of the F-type and E-type shaped resonators were similar.

Figure 9A:
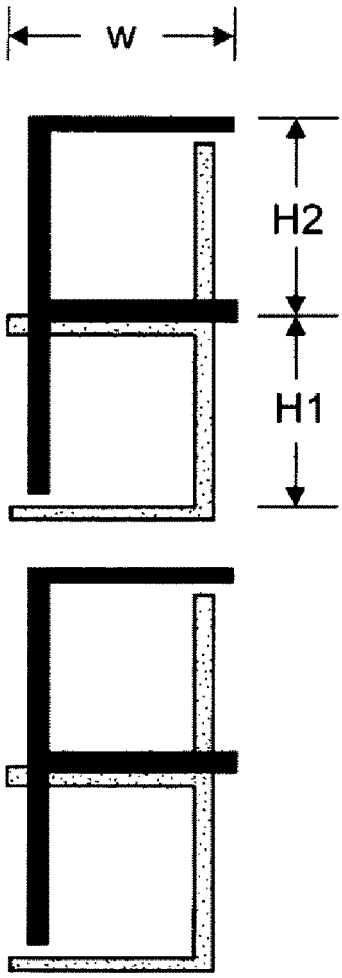
FIGS. 9(*a*) and 9(*b*) are schematic representations of patterns of: (a) F-type shaped resonators; and (b) E-shaped resonators, in each case one shape (black) of the resonator (F-type shape in (a) and E-type shape in (b)) is at the front side of a slab (resonator plane) and its inversion shape (grey) is at the back side of the slab.
Figure 9B:
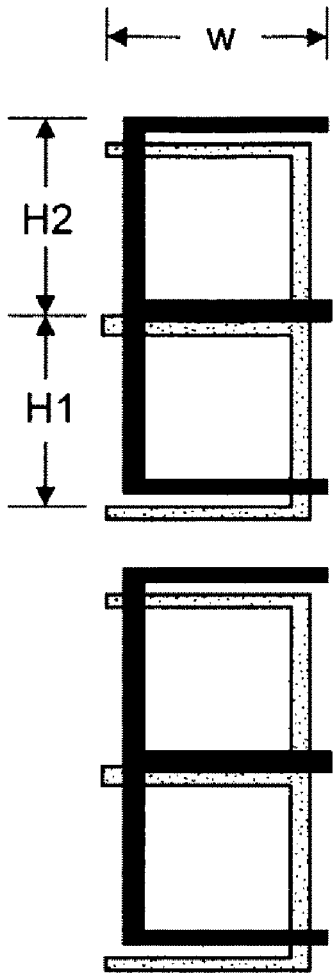
Figure 9C:
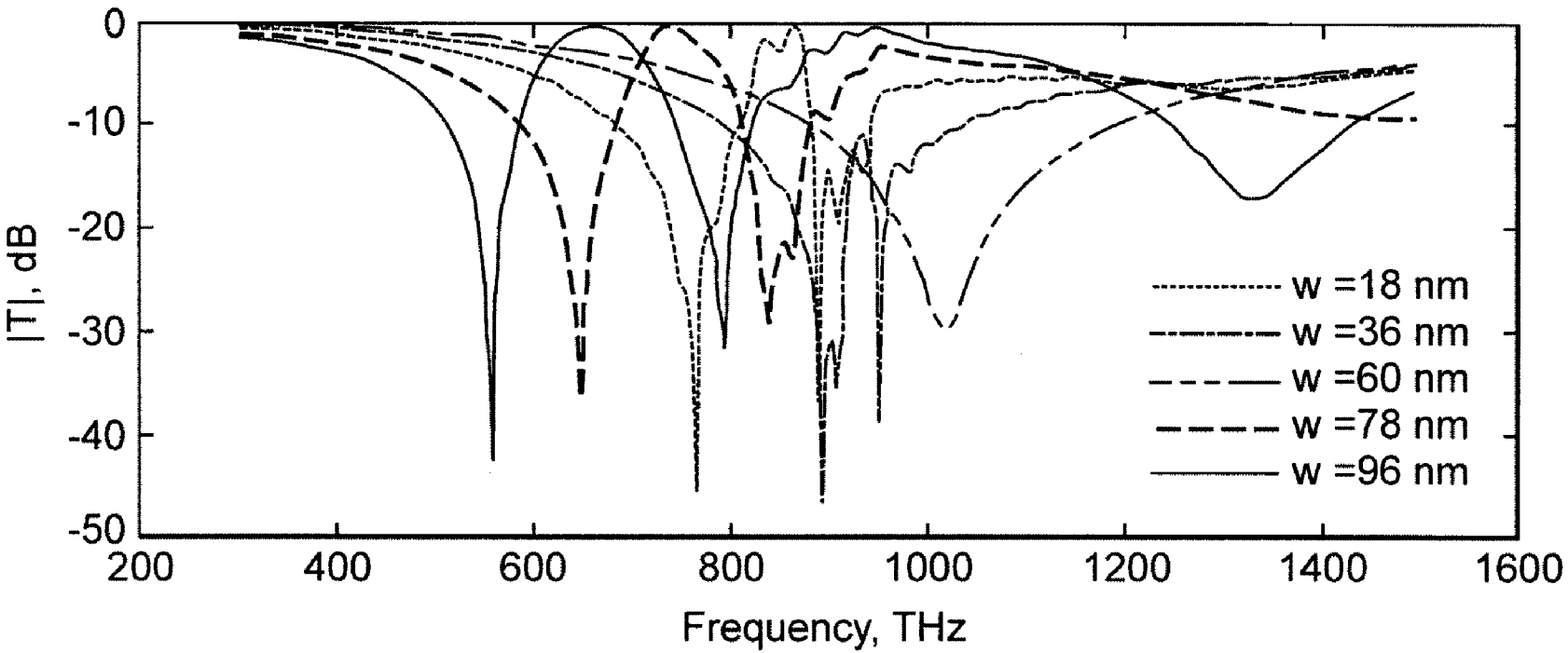

One of the main advantages of the F-type and E-type shaped resonators was that the DNG passband was tunable to different frequencies. It could be adjusted to be narrow or broad passband in frequency covered or even be just a stopband at different frequencies. FIG. 9 illustrates the transmission coefficients of the F-type and E-type shaped resonators when the widths of the resonators were 18, 36, 60, 78, and 96 nm, respectively. The height H1 and H2 were equal at 60 nm.

It was observed that when the width of the repeating resonators was larger, the passband frequency width became broader, and in addition, the bands also moved down to the lower frequency regimes. However, there was a limitation in how much the width could expand. At 60 nm, or 160% of the width that was equal to each height (60 nm), it started to show some disturbance. Table 2. summarizes comparison of the results shown in FIGS. 10(*a*) and 10(*b*).

TABLE 2

Location and width of the passband of F/E-resonator for different widths

| | Width | Location of band (THz) | Width of band (THz) |
|---|---|---|---|
| a. | 18 nm | — | — |
| b. | 36 nm | 890-940 | 50 |
| c. | 60 nm | 780-890 | 110 |
| d. | 78 nm | 635-835 | 200 |
| e. | 96 nm | 570-800 | 230 |

Figure 10B:
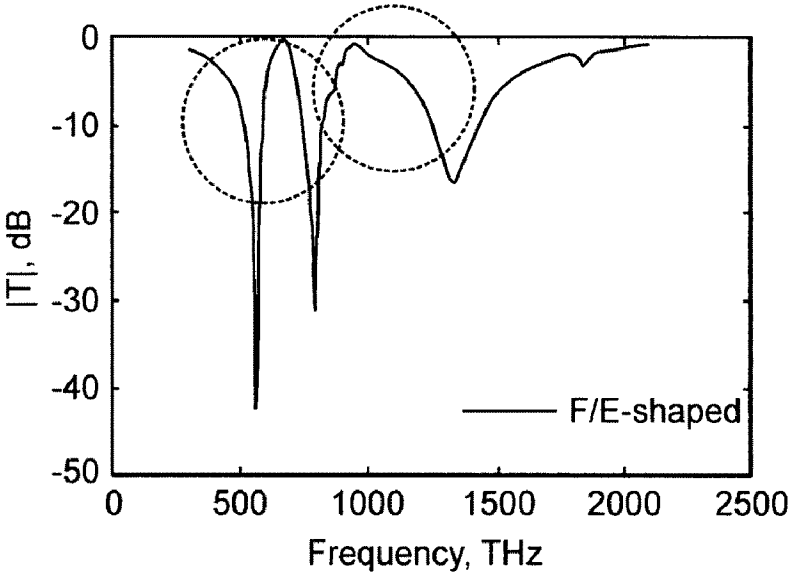
FIGS. 10(*a*) and 10(*b*) are graphs showing simulated transmission coefficients of chiral metamaterial models that include an array of F/E-type shaped resonators having the dimension of: (a) width-36 nm and H1=H2=60 nm; (b) width=96 nm, and H1=H2=60 nm.
Figure 10A:
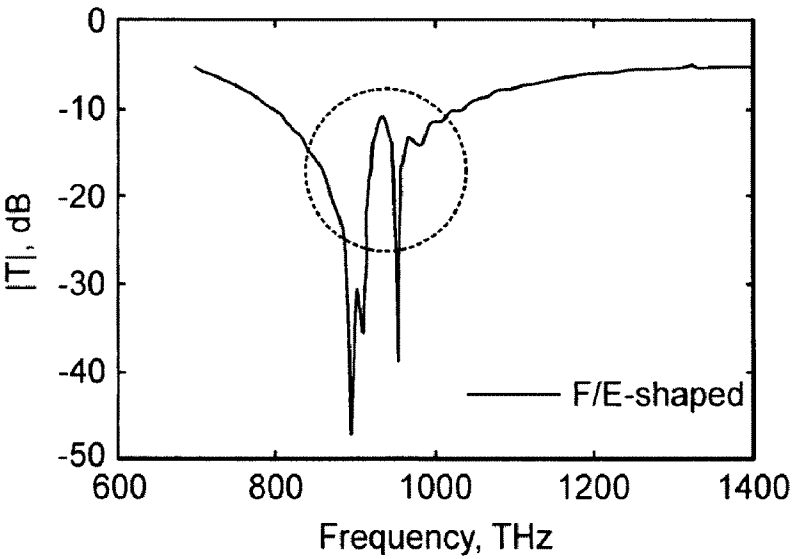

The DNG transmission bandwidth could be adjusted to be significantly narrow at 50 THz, as shown in FIG. 10(*a*). The result was from the F/E-type shaped resonator of w=36 nm, and H1=H2=60 nm. The 50 THz band width could move up or down in frequency when the dimension was scaled down and up, respectively (see Table 2). Also, the number of passbands could also be tuned by varying the dimension of the resonator. For example, when the width expanded to 96 nm and each height had the same value at 60 nm, the resonator could produce two passbands at different frequencies, as illustrated in FIG. 10(*b*).

Example 4

Effect of Relative Ratio of Components of Resonators on Transmittance Characteristics Transmittance characteristics of y-type shaped resonators were studied in this example when the direction of propagation was parallel and perpendicular to the resonators. Also, the directions of the electric and magnetic field were also changed. The effect of polarization with respect to the angle of the resonators was also studied.

4A. Parallel Propagation

Figure 11:
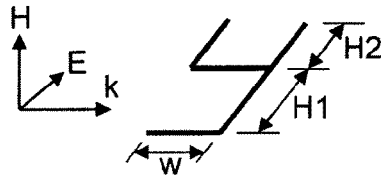
FIG. 11 is a schematic representation of a y-type shaped resonator where the direction of propagation of the applied electromagnetic radiation is parallel to the horizontal components of the y-type shaped resonator.
Figure 12A:
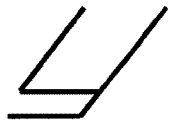
FIGS. 12(*a*)-12(*e*) are schematic representations of y-type shaped resonators having different height ratio (H2:H1): (a) 1:5; (b) 1:2; (c) 1:1; (d) 2:1; and (e) 5:1.
Figure 12B:
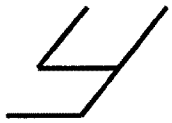
Figure 12C:
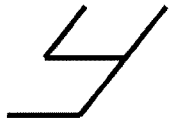
Figure 12D:
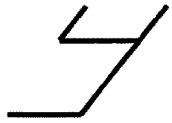
Figure 12E:
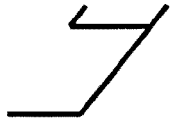
Figure 13A:
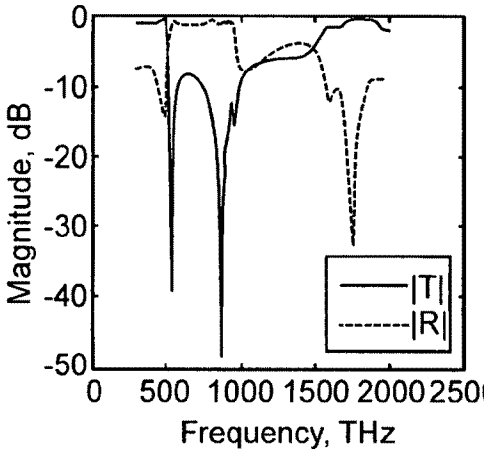
FIGS. 13(*a*)-13(*e*) are graphs showing simulated transmission and reflection coefficients of metamaterial models that include an array of the y-type shaped resonators of FIGS. 12(*a*)-12(*e*), respectively.
Figure 13B:
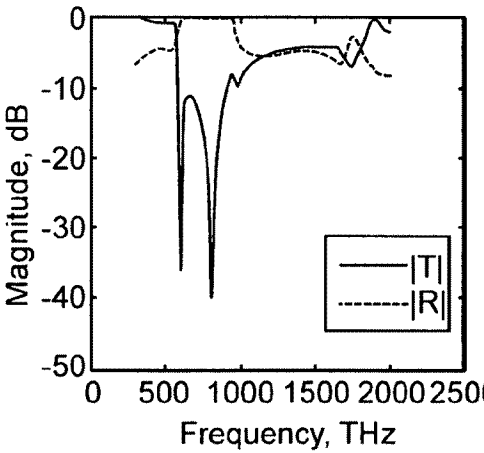
Figure 13C:
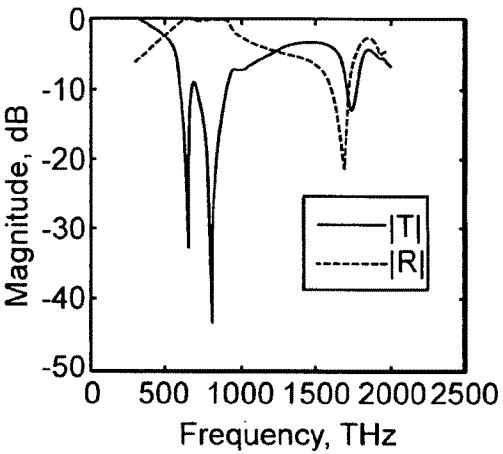
Figure 13D:
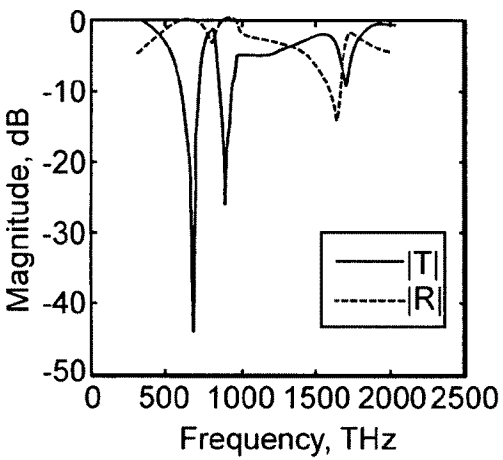
Figure 13E:
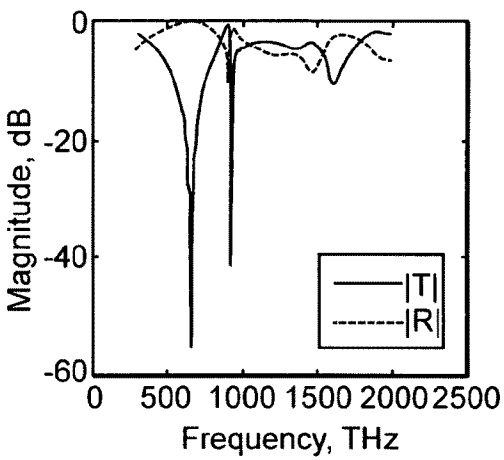

The direction of propagation (i.e., the k axis) was parallel to the horizontal components of the y-type shaped resonator, as shown in FIG. 11. The ratio of heights, "H1" and "H2" of the y-type resonator of FIG. 11 was varied to have five different y-type shaped resonators shown in FIGS. 12(*a*)-12(*e*): 12(*a*), H1:H2=1:5; 12(*b*), H1:H2=1:2; 12(*c*), H1:H2=1:1; 12(*d*), H1:H2=2:1; and 12(*e*), H1:H2=5:1. The transmission pass band results of the y-type resonators of FIGS. 12(*a*)-12(*e*) are shown in FIGS. 13(*a*)-13(*e*), respectively. The transmission pass band results showed that when the ratio was 1:1, the frequency range of the pass band was narrowest. The passband became broader when the ratio varied, e.g. 400 THz for 1:5 and 5:1. The transmission improved to be 0 dB when the ratio was 5:1.

Figure 14B:
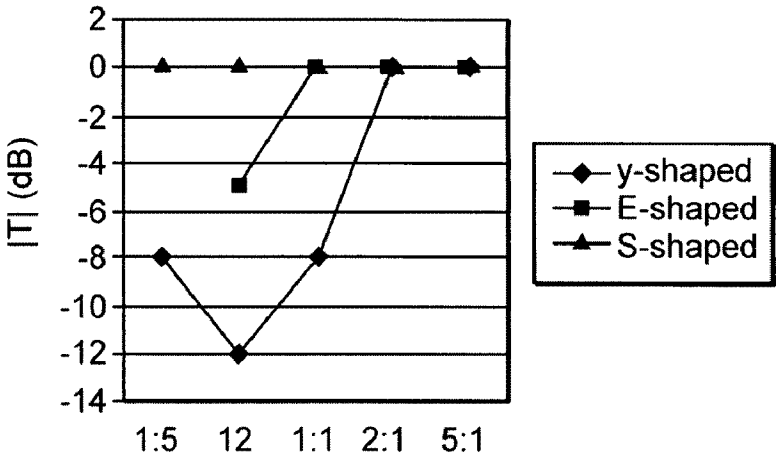
FIGS. 14(*a*) and 14(*b*) are graphs showing: (a) half-power bandwidth and (b) intensity of a double negative transmission passband of the transmission coefficients of metamaterial models that include y-type, S-type and E-type shaped resonators.
Figure 14A:
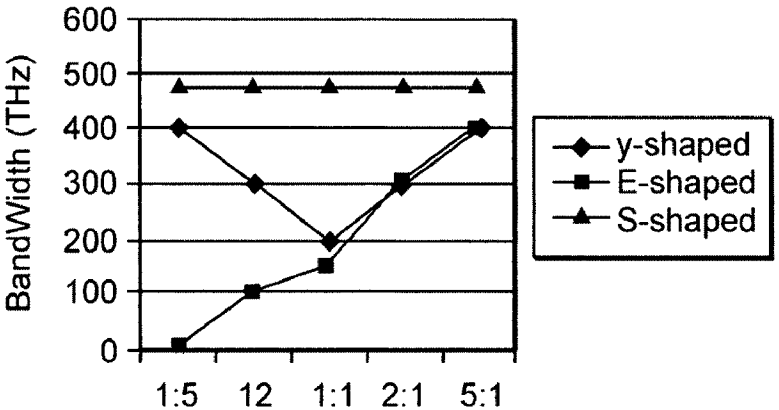

Referring to FIGS. 14(*a*) and 14(*b*), the transmission results of the y-type shaped resonators are compared to those of S-type and E-type shaped resonators. As shown in FIGS. 14(*a*) and 14(*b*), the height ratio did not affect the transmission characteristics of the S-type shaped resonators. The band width and the quality of the transmission of the S-type shaped resonators were constant (width=480 THz, 0 dB). On the other hand, for the E-type shaped resonators, the width of the transmission passband was at 0 THz when the ratio was 1:5, and became broader at 400 THz when the height H2 increased. In particular, the y-type shaped resonators showed superior properties of an adjustable frequency bandwidth and wide-ranged transmission values could be achieved through the adjustment of the H1 to H2 values, as shown in FIG. 14(*b*).

The width of the resonators was also varied while the height ratio was fixed at 1:1. Five different values of width were 30%, 60%, 100%, 130%, and 160% of H1 (or H2). The quality of the pass band was generally improved when the width was larger as shown in table. 3.

TABLE 3

Quality of the passband as a function of the width.

| Width | Quality of the Pass band |
|---|---|
| 30% | −16 dB |
| 60% | −14 dB |
| 100% | −8 dB |
| 130% | −5 dB |
| 160% | −3 dB |

4B. Perpendicular Propagation

Figure 15:
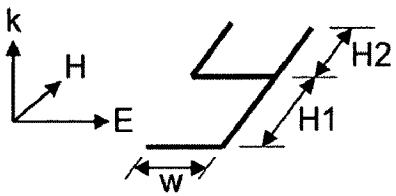
FIG. 15 is a schematic representation of a y-type shaped resonator where the direction of propagation of an applied electromagnetic radiation is perpendicular to the resonator.
Figure 16A:
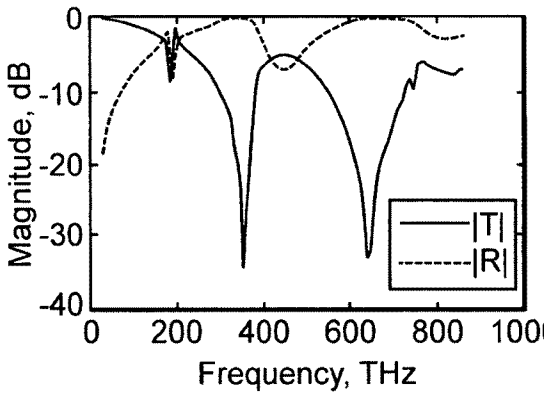
FIGS. 16(*a*)-16(*e*) are graphs showing simulated transmission and reflection coefficients of chiral metamaterial models that include an array of the y-type shaped resonators of FIGS. 12(*a*)-12(*e*), respectively, where the direction of propagation of the applied electromagnetic radiation is perpendicular to the horizontal components of the y-type shaped resonator, as shown in FIG. 15.
Figure 16B:
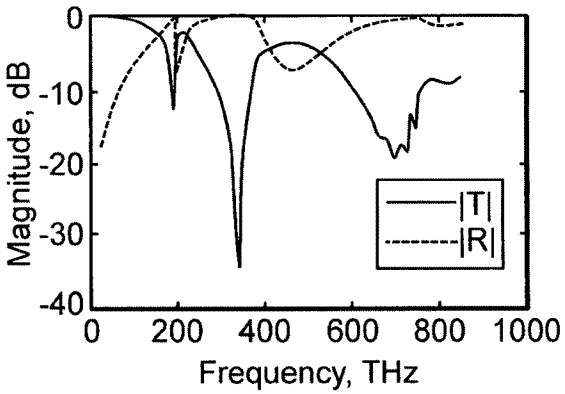
Figure 16C:
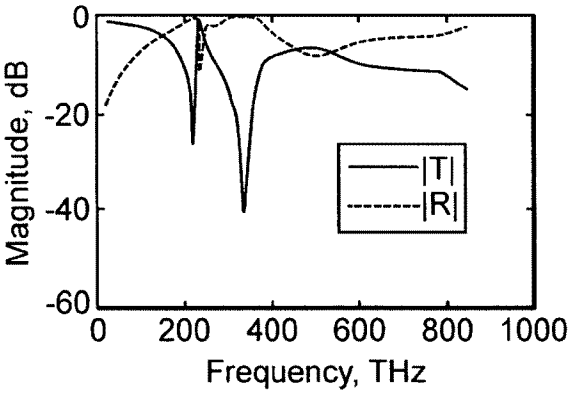
Figure 16D:
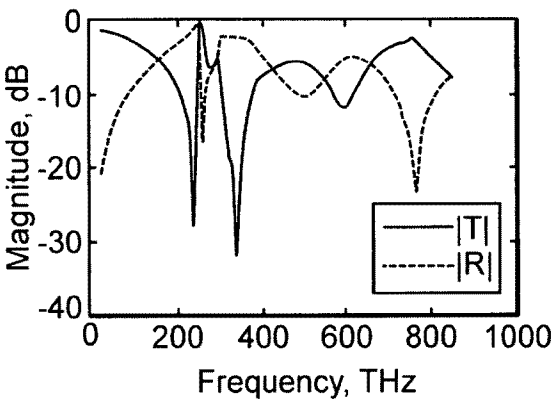
Figure 16E:
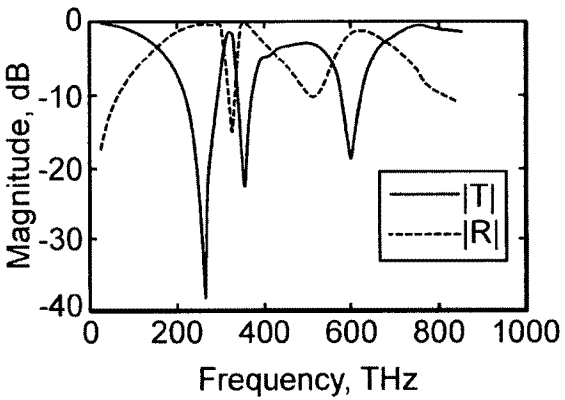

The direction of propagation (i.e., the k axis) was perpendicular to the horizontal components of the y-type shaped resonator, as shown in FIG. 15. The ratio of heights, "H1" and "H2" of the y-type resonator of FIG. 15 was varied to have five different y-type shaped resonators as shown in FIGS. 12(*a*)-12(*e*): 12(*a*), H1:H2=1:5; 12(*b*), H1:H2=1:2; 12(*c*), H1:H2=1:1; 12(*d*), H1:H2=2:1; and 12(*e*), H1:H2=5:1. The transmission pass band results of the y-type resonators of FIGS. 12(*a*)-12(*e*) when the direction of propagation was perpendicular to the resonators are shown in FIGS. 16(*a*)-16(*e*), respectively.

It has been found that the passband(s) could be formed perfectly when the ratio of H1:H2 was 5:1. The width of the pass band was broader when the width of the structure increased while the height ratio was fixed at 1:1, as shown in table. 4. Five different values of the width were 30%, 60%, 100%, 130%, and 160% of H1 (or H2).

TABLE 4

Width of the passband as a function of width.

| Width | Width of Pass band |
|---|---|
| 30% | 5 THz |
| 60% | 10 THz |
| 100% | 15 THz |
| 130% | 25 THz |
| 160% | 30 THz |

Figures 17A, 17B, 17C, 17D, 17E:
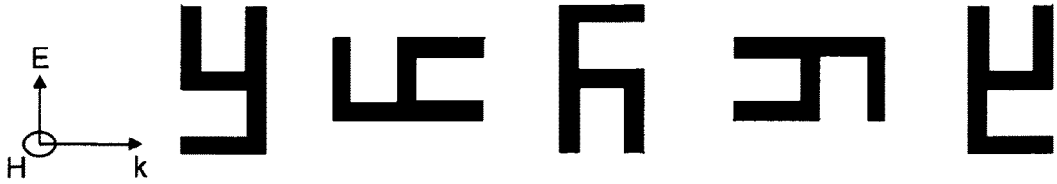
FIGS. 17(*a*)-17(*e*) are schematic representations of y-type shaped resonators having different angles with respect to the propagation axis of an applied electromagnetic radiation: (a) 0°; (b) 90°; (c) 180°; (d) 270°; and (e) horizontal flip.

4C. Effects of Relative Orientations of Resonators with Respect to the Axis of Propagation of EM radiation on Transmission Characteristics of the Resonators Y-type resonators were rotated while the axis and the plane were fixed, as shown in FIGS. 17(*a*)-17(*e*). In one set of experiments, the incident EM wave was set to be parallel to the resonator plane, and then the y-type resonators were flipped to observe the transmission variance with respect to the different polarizations: FIG. 17(*a*): 0°; FIG. 17(*b*): 90°; FIG. 17(*c*): 180°; FIGS. 17(*d*): 270°; and 17(*e*): vertically flip-over.

Figure 18:
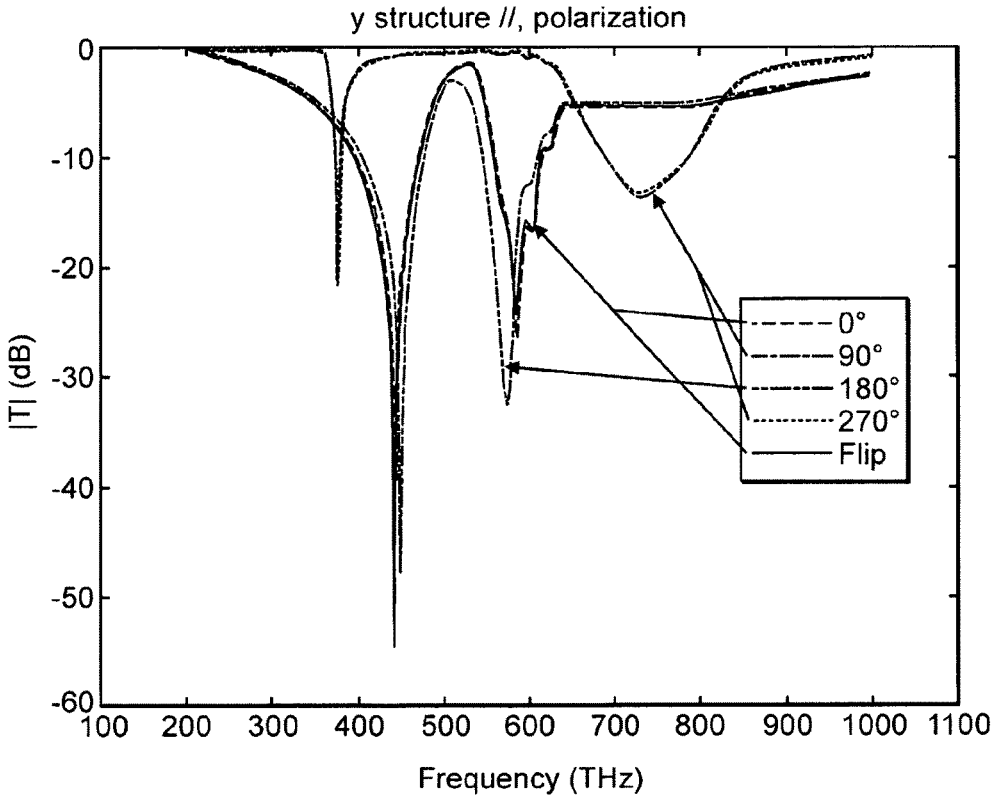
FIG. 18 is a graph showing simulated transmission coefficients of chiral metamaterial models that include an array of the y-type shaped resonators of FIGS. 17(*a*)-17(*e*).

As shown in FIG. 18, the transmission results of the 0° and the horizontal flip angles were the same. They showed a good DNG transmission (−2 dB) with a 150 THz band width. The 180° angle has a similar result to that of the original orientation. It was noted that all three cases had the long axis in the direction of the electric field. The 90° and the 270° produced the resonance located before the pass band of the other three cases. This indicates a DNG hypothesis of the y-shaped structure in the same way that the long axis (which needs to be set to be parallel with the E field) creates the negative $\in$ and the uncompleted gaps produce the resonance or negative $\mu$. The DNG property will be generated if the negative permittivity and permeability are overlapped.

Figures 19A, 19B, 19C, 19D, 19E:
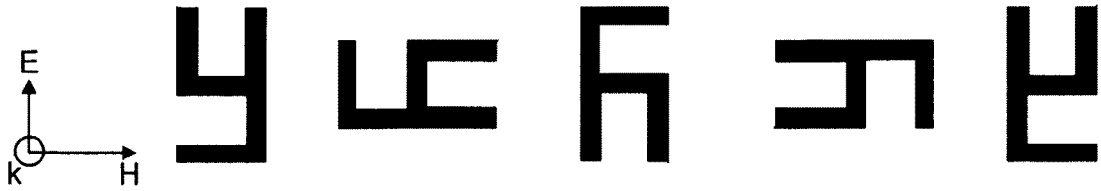
FIGS. 19(*a*)-19(*e*) are schematic representations of y-type shaped resonators having different angles with respect to the direction of the magnetic field (H) of an applied electromagnetic radiation: (a) 0°; (b) 90°; (c) 180°; (d) 270°; and vertical flip.
Figure 20:
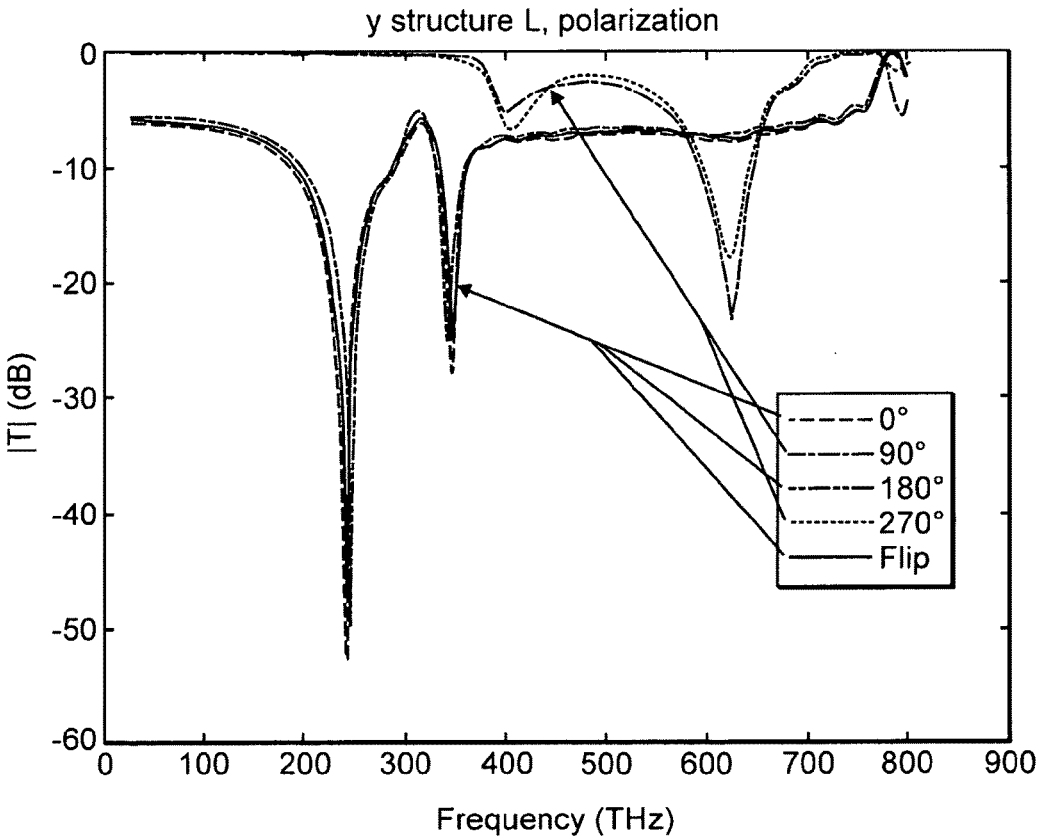
FIG. 20 is a graph showing simulated transmission coefficients of chiral metamaterial models that include an array of the y-type shaped resonators of FIGS. 19(*a*)-19(*e*).

In another set of experiments, the incident EM wave was set to be perpendicular to the resonator plane, and then the y-type resonators were flipped to observe the transmission variance with respect to the different polarizations: FIG. 19(*a*): 0°; FIG. 19(*b*): 90°; FIG. 19(*c*): 180°; FIGS. 19(*d*): 270°; and 19(*e*): horizontal flip-over. As shown in FIG. 20, the transmission results of the 0°, 180° and the horizontal flip angles Were the same. They showed a DNG transmission (−6 dB) with the 150 THz band width. It was noted that all three cases had the long axis in the direction of electric field. The 90° the 270° produced the resonance located after the pass band of the mentioned three cases. Although one may say that the resonance was established far from the DNG pass band, this can be explained by "the true" left-handed transmission peaks in metamaterials. It has been shown that the part which produces the magnetic resonance (negative permeability) can also generate the effective plasma frequency (negative permittivity) and vice versa. Therefore, the results observed for properties of each part separately may not match the outcome of the combined structure.

Example 5

Determining the Number of Resonators to Obtain Substantially Homogeneous Electromagnetic Interaction (Bulk Property)

Figure 21:
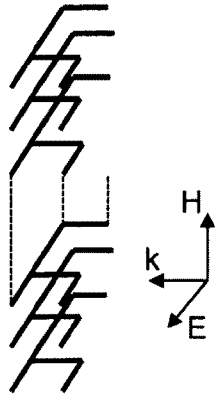
FIG. 21 is a schematic representation showing an array of y-type shaped resonators employed in one embodiment of the invention, where the magnetic field is along the resonator and the direction of propagation of an applied electromagnetic radiation is perpendicular to the resonator.
Figure 22A:
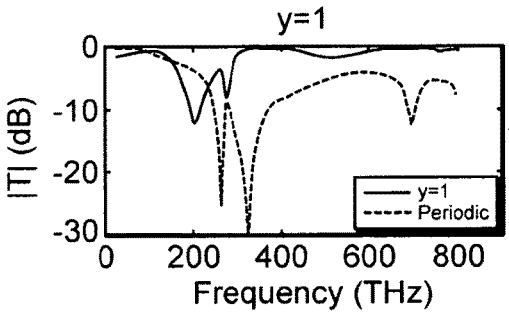
FIGS. 22(*a*)-22(*c*) are graphs showing simulated transmission coefficients for chiral metamaterial models that include: (a) one y-type shaped resonator; (b) five y-type shaped resonators; and (c) ten y-type shaped resonators as shown in FIG. 21, and comparing their transmission coefficients with that of a chiral metamaterial model having a semi-infinite number of y-type shaped resonators.
Figure 22B:
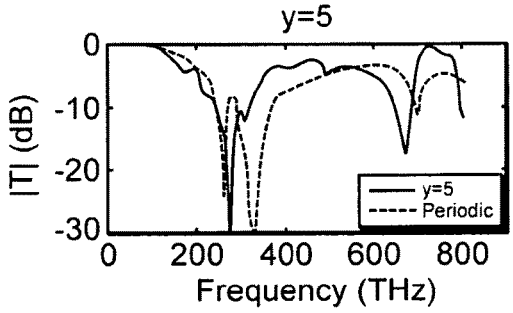
Figure 22C:
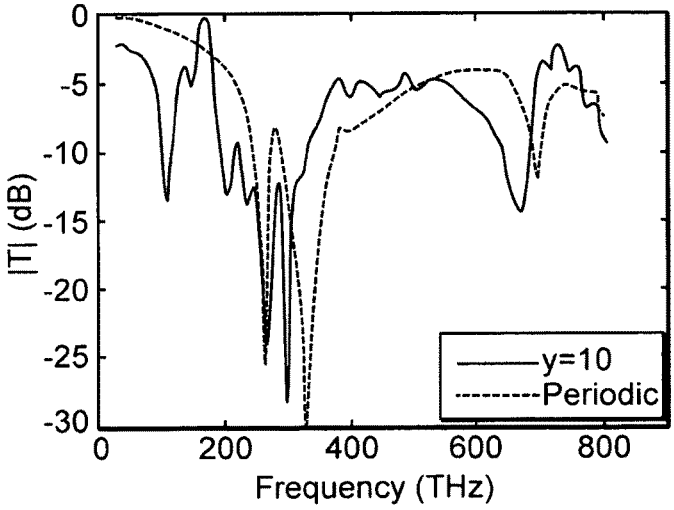

5A. Number of Discrete Resonators Along an Axis Perpendicular to the Propagation Axis of EM Radiation As shown in FIG. 21, with the setup of the boundary condition of the FDTD models as described in Example 1, the simulations of finite numbers of y-type resonators along the H axis perpendicular to the EM propagation axis, k, were implemented. FIGS. 22(*a*)-22(*c*) show transmission bands of y-type shaped resonators when the number of the y-type shaped resonators is one (y=1), five (y=5) and ten (y=10), and they are compared to the results for the semi-infinite periodic structure (Periodic). As shown in FIG. 22(*c*), a minimum ten number of resonators along the H axis perpendicular to the EM propagation axis, k, began to behave substantially homogenously, close to the semi-infinite periodic resonators.

5B. Number of Discrete Resonators Along the Propagation Axis of EM Radiation

Figure 23B:
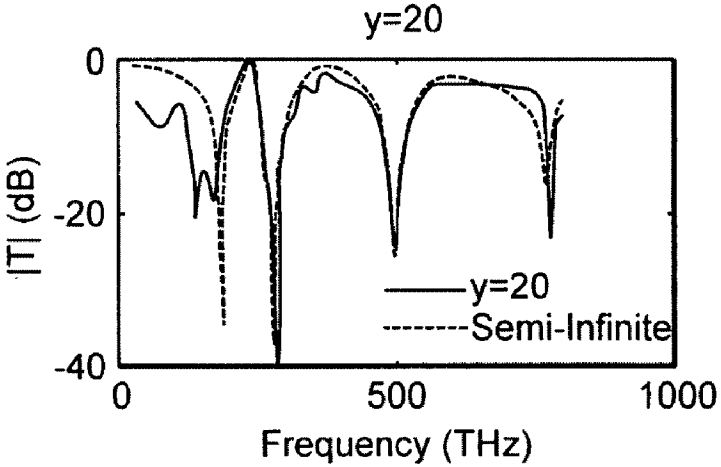
FIGS. 23(*a*) and 23(*b*) are graphs showing simulated transmission coefficients for chiral metamaterial models that include five y-type shaped resonators; and twenty y-type shaped resonators arrayed along the direction of propagation of electromagnetic radiation, and comparing their transmission coefficients with that of a chiral metamaterial model having a semi-infinite number of y-type shaped resonators.
Figure 23A:
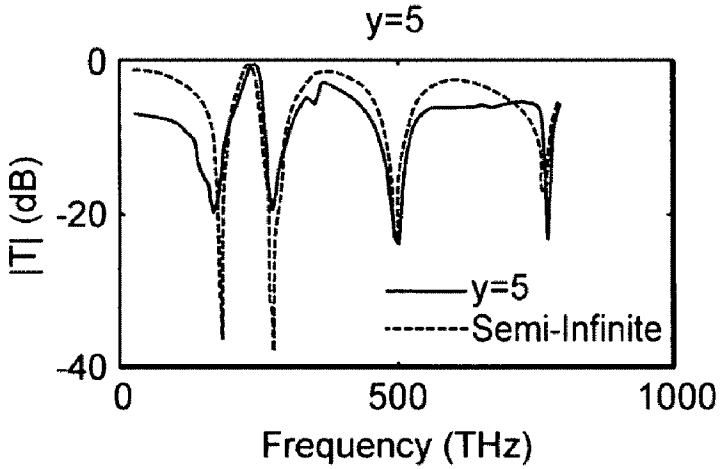

Optimized number(s) of the resonators which showed a DNG band was also studied. The simulation results showed that one row of twenty resonators could present a very similar transmission result to that of the semi-infinite periodic resonators, as illustrated in FIGS. 23(*a*)-23(*b*).

Example 6

Effects of Defects (unit cell deletions) in the Repeating Array of Resonators on Their Transmission Characteristics The effects of defects in a repeating resonators pattern, e.g., missing structures, in non-periodic arrays were studied in this example.

The transmission properties of an array of y-type shaped resonators when defects exist and these transmission properties were compared to those of those of periodically-arrayed semi-infinite y-type shaped resonators and of periodically-arrayed twenty y-type shaped resonators having no defects. The incident EM wave was set to be perpendicular to the resonator plane, as shown in FIG. 15.

Figure 24:
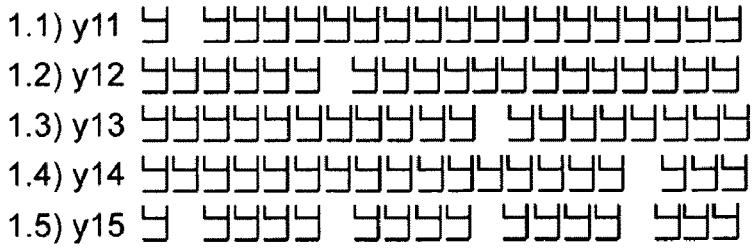
FIG. 24 shows schematic representations of various arrays of y-type resonators. where one or more resonators are missing from a periodic array of twenty y-type shaped resonators: y11, a resonator at position 2 is missing; y12, a resonator at position 7 is missing; y13, a resonator at position 12 is missing; y14, a resonator at position 17 is missing; and y15, four resonators are missing at positions 2, 7, 12 and 17.
Figure 25:
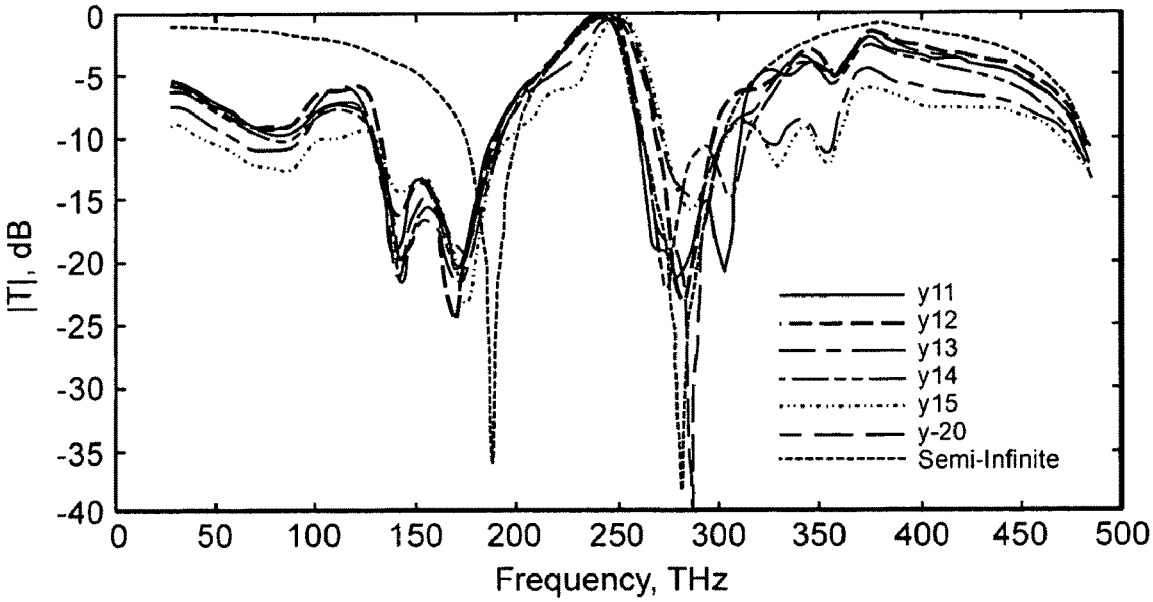
FIG. 25 is a graph showing simulated transmission coefficients of chiral metamaterial models of the invention that include the various arrays of y-type resonators as shown in FIG. 24.

In a first study, as shown in FIG. 24, the structures at locations 2, 7, 12, and 17 were taken off from the following patterns: y11, y12, y13, and y14, respectively. Transmission coefficients of the resonators having the defects shown in FIG. 24 are shown in FIG. 25. The results of only one missing resonator were very similar to those of the semi-infinite and the "y=20" cases. When four resonators at 2, 7, 12, and 17 were taken off in the pattern y15, the results in the transmission peak varied from those of the semi-infinite and the "y=20" cases particularly around the pass band peak at 200-250 THz.

Figure 26:
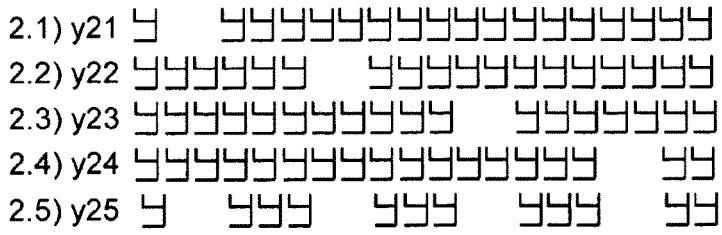
FIG. 26 shows schematic representations of various arrays of y-type resonators, where two or more resonators are missing from a periodic array of twenty y-type shaped resonators: y21, two resonators at positions 2 and 3 are missing; y22, two resonators at positions 7 and 8 are missing; y23, two resonators at positions 12 and 13 are missing; y24, two resonators at positions 17 and 18 are missing; and y25, eight resonators are missing at positions 2, 3, 7, 8, 12, 13, 17 and 18.
Figure 27:
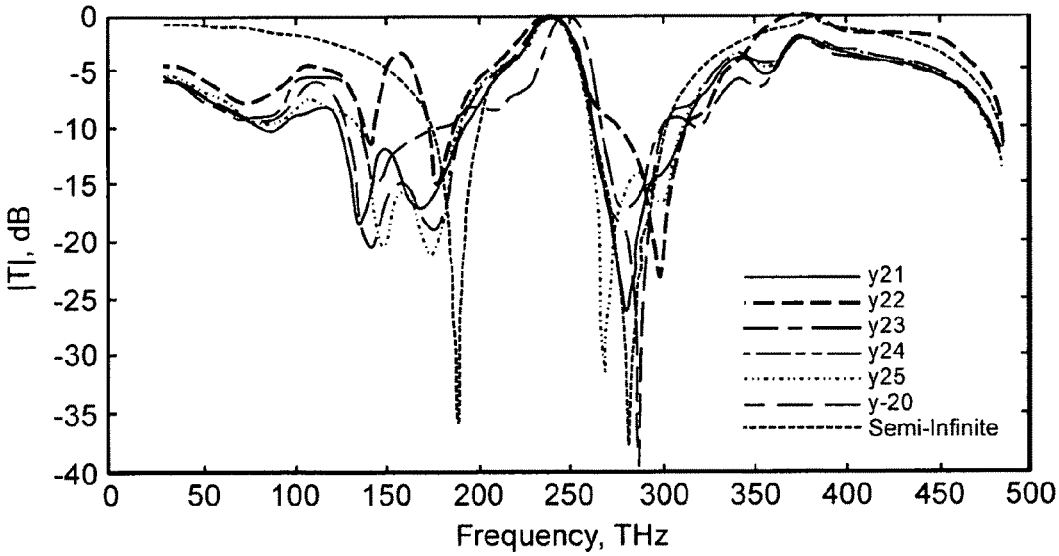
FIG. 27 is a graph showing simulated transmission coefficients of chiral metamaterial models of the invention that include of the various arrays of y-type resonators as shown in FIG. 26.

In a second study, as shown in FIG. 26, two neighboring resonators were taken out in y21, y22, y23, and y24, at the locations 2-3, 7-8, 12-13, and 17-18, respectively. Transmission coefficients of the resonators having the defects shown in FIG. 26 are shown in FIG. 27. The transmission coefficients of these cases remained similar to those of the semi-infinite and the "perfect" (i.e. "y=20") cases. The resonators at 2-3, 7-8, 12-13, and 17-18 were taken off in y25. The result was close to that of the "y=20" case, probably because the pattern of the structures still had a periodic shape (only the gap was wider), as shown in FIG. 26. It was also observed that the y25 having 12 y-type shaped resonators produced the substantially same transmission spectrum as that of the semi-infinite case.

Figure 28:
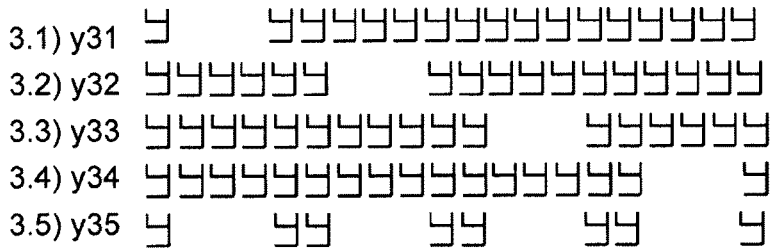
FIG. 28 shows schematic representations of various arrays of y-type resonators, where three or more resonators are missing from a periodic array of twenty y-type shaped resonators: y31, three resonators at positions 2-4 are missing; y32, three resonators at positions 7-9 are missing; y33, three resonators at positions 12-14 are missing; y34, three resonators at positions 17-19 are missing; and y35, twelve resonators are missing at positions 2-4, 7-9, 12-14 and 17-19.
Figure 29:
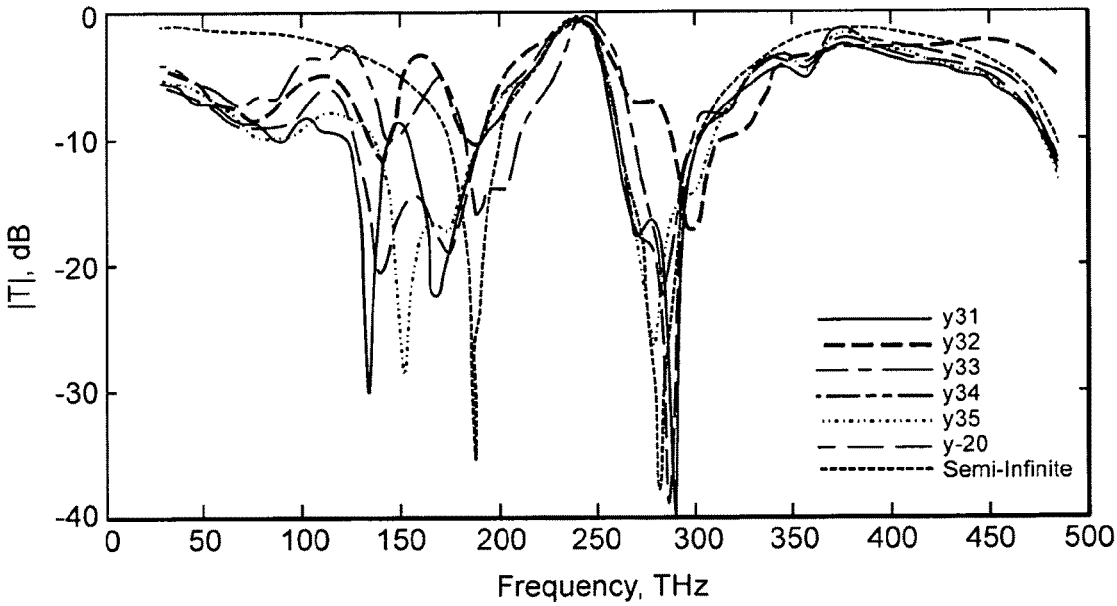
FIG. 29 is a graph showing simulated transmission coefficients of chiral metamaterial models of the invention that include of the various arrays of y-type resonators as shown in FIG. 28.

In a third study, as shown in FIG. 28, three neighboring resonators at 2-4, 7-9, 12-14, and 17-19 were taken out from the patterns y31, y32, y33, and y34, respectively. In y35, resonators at 2-4, 7-9, 12-14, and 17-19 were taken off Transmission coefficients of the resonators having the defects shown in FIG. 28 are shown in FIG. 29. It can be seen from FIG. 29 that the results are shifted up in frequency. However, the difference between the "three" missing in y31 and y34, and the "y=20" case was not significant. Note that the results of "y32" and "y33" where the three missing structures were located close to the center of the pattern showed a minor variation in their transmission coefficients.

Figure 30:
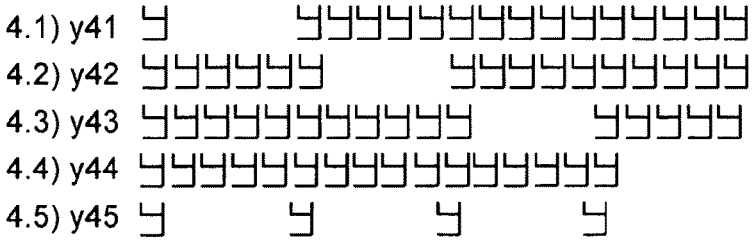
FIG. 30 shows schematic representations of various arrays of y-type resonators where four or more resonators are missing from a periodic array of twenty y-type shaped resonators: y41, four resonators at positions 2-5 are missing; y42, four resonators at positions 7-10 are missing; y43, four resonators at positions 12-15 are missing; y44, four resonators at positions 17-20 are missing; and y45, sixteen resonators are missing at positions 2-5, 7-10, 12-15 and 17-20.
Figure 31:
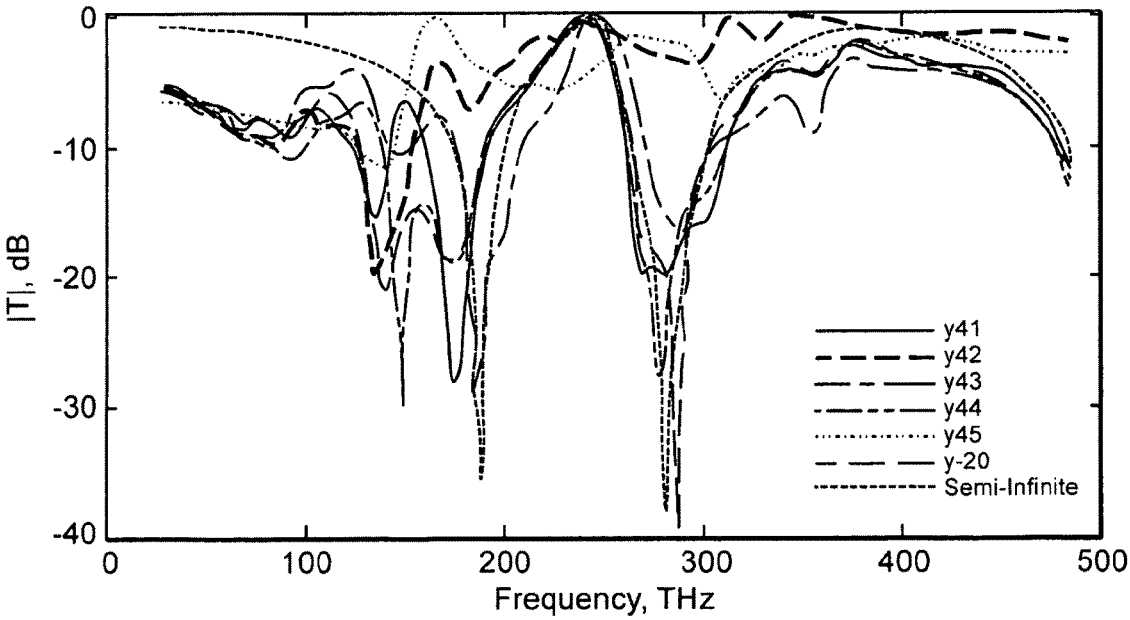
FIG. 31 is a graph showing simulated transmission coefficients of chiral metamaterial models of the invention that include of the various arrays of y-type resonators as shown in FIG. 30.

In a fourth study, as shown in FIG. 30, four neighboring resonators at locations 2-5, 7-10, 12-15, and 17-20 were taken out from the patterns y41, y42, y43, and y44, respectively. In y45, resonators at locations 2-5, 7-10, 12-15, and 17-20 were taken off. Transmission coefficients of the resonators having the defects shown in FIG. 30 are shown in FIG. 31. The difference between the "four" missing and the "y=20" cases was not significant in y41 and y44 where the missing parts were close to the edge. However, the results of "y42" and "y43" where the four missing were located close to the center of the pattern were different from the semi-infinite case. When resonators at 2-5, 7-10, 12-15, and 17-20 were taken off in y45, the transmission curve was no longer the same as that of the semi-infinite case.

Figure 32:
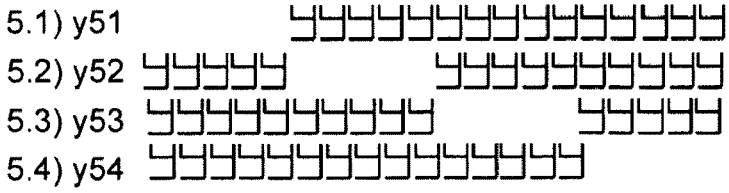
FIG. 32 shows schematic representations of various arrays of y-type resonators, where five or more resonators are missing from a periodic array of twenty y-type shaped resonators: y51, five resonators at positions 1-5 are missing; y52, five resonators at positions 6-10 are missing; y53, five resonators at positions 11-15 are missing; and y54, five resonators at positions 16-20 are missing.
Figure 33:
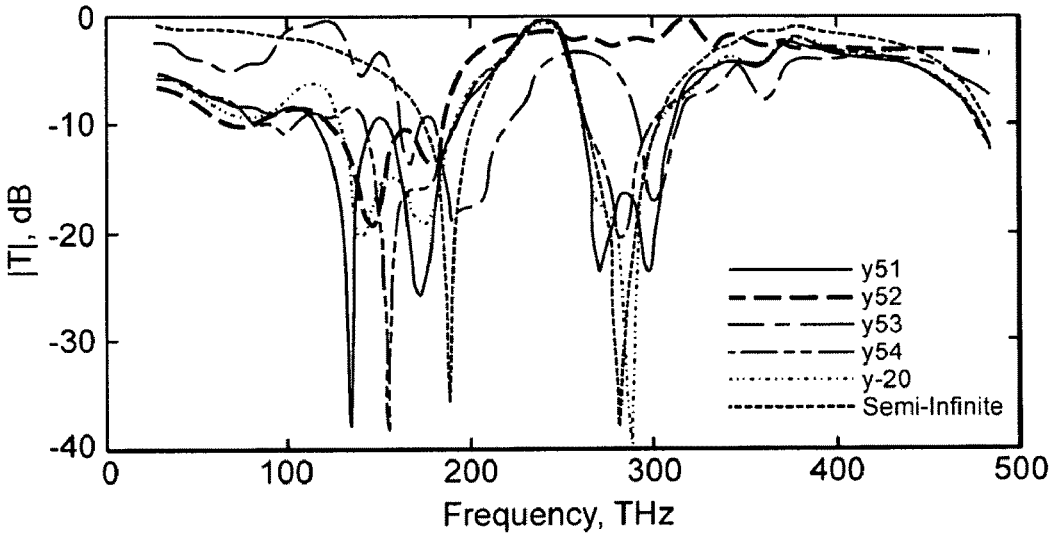
FIG. 33 is a graph showing simulated transmission coefficients of chiral metamaterial models of the invention that include of the various arrays of y-type resonators as shown in FIG. 32.
Figure 34A:
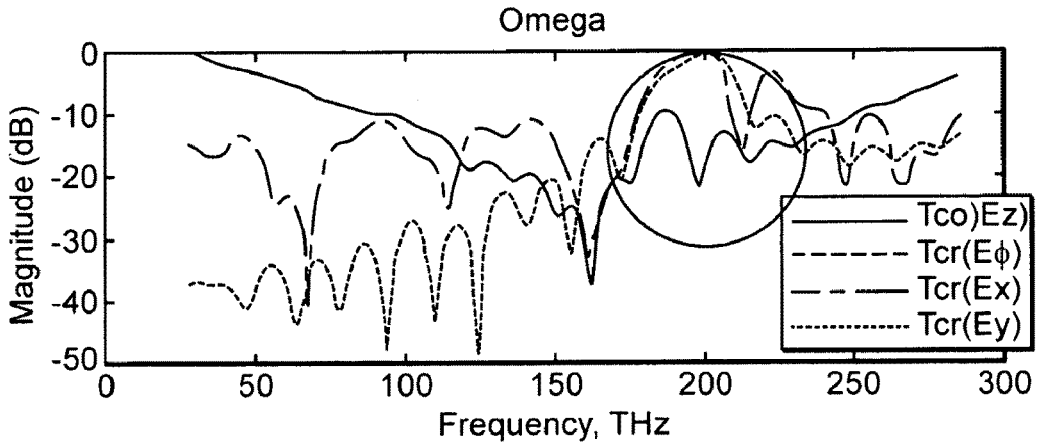
FIGS. 34(*a*)-34(*e*) are graphs showing simulated co- and cross-polarized transmission coefficients of chiral metamaterial models of the invention that include an array of: (a) omega-type shaped resonators; (b) y-type shaped resonators; (c) F-type shaped resonators; (d) E-type shaped resonators; and (e) S-type shaped resonators.
Figure 34B:
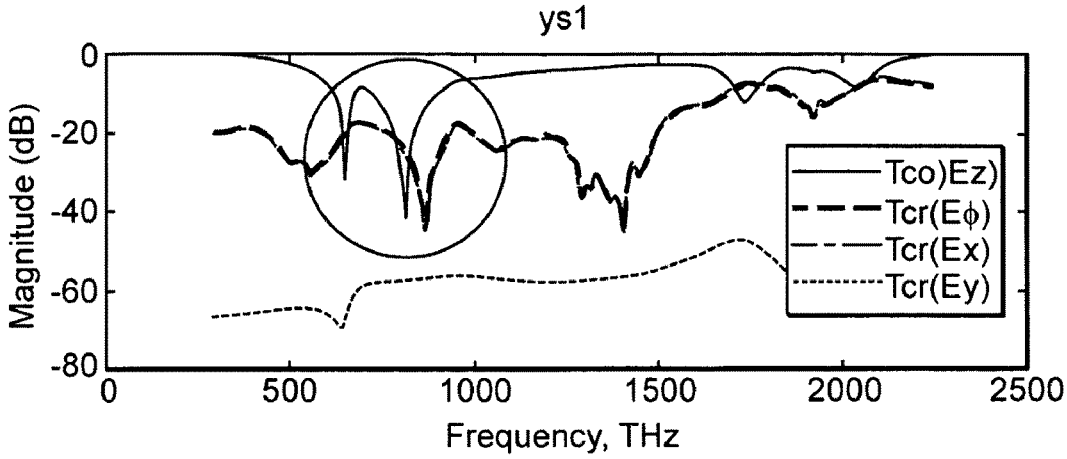
Figure 34C:
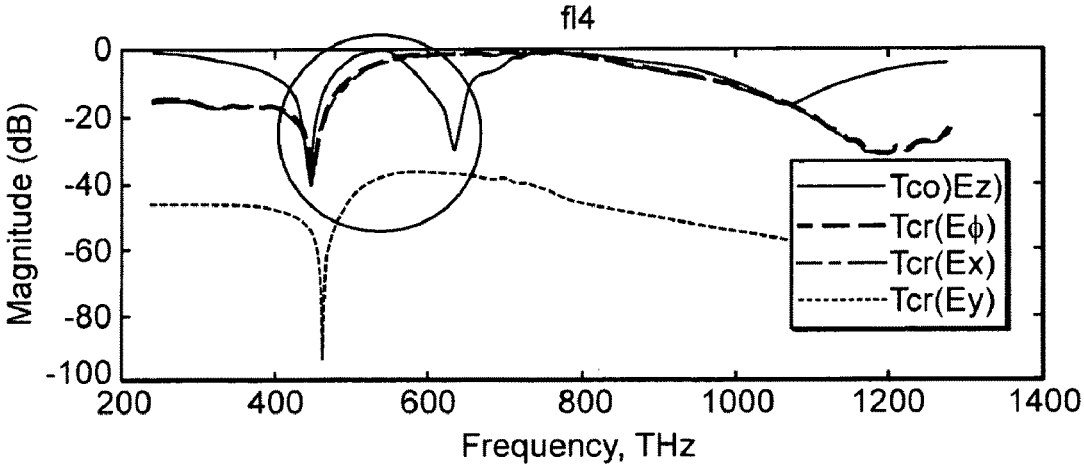
Figure 34D:
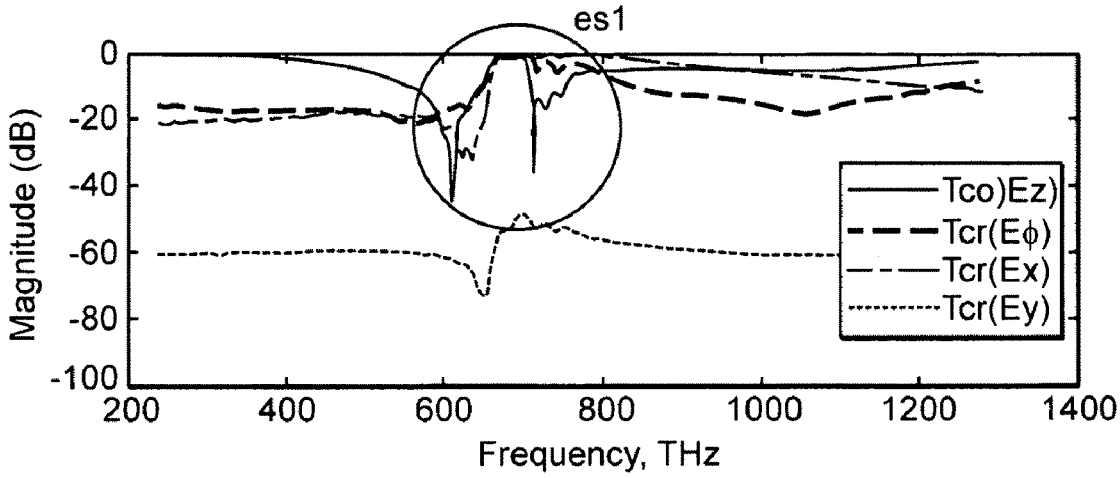
Figure 34E:
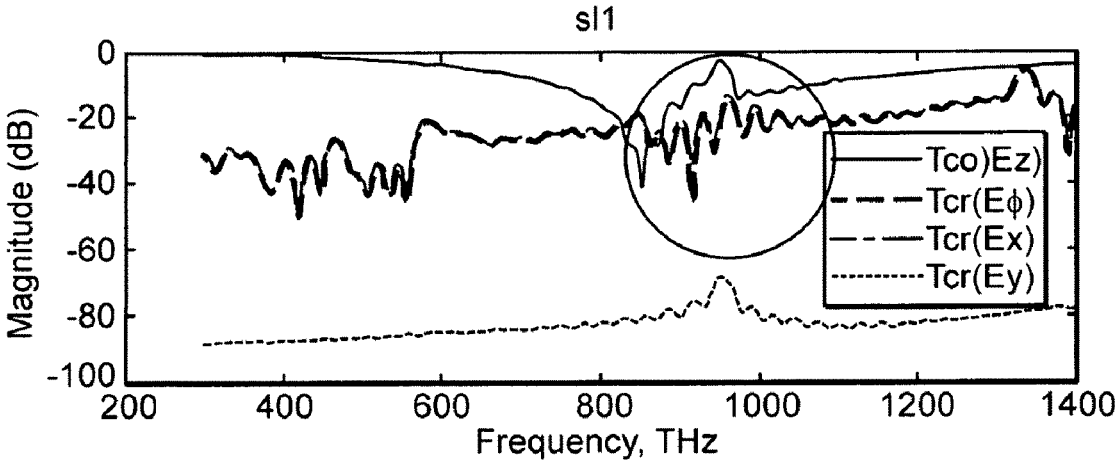
Figure 35B:
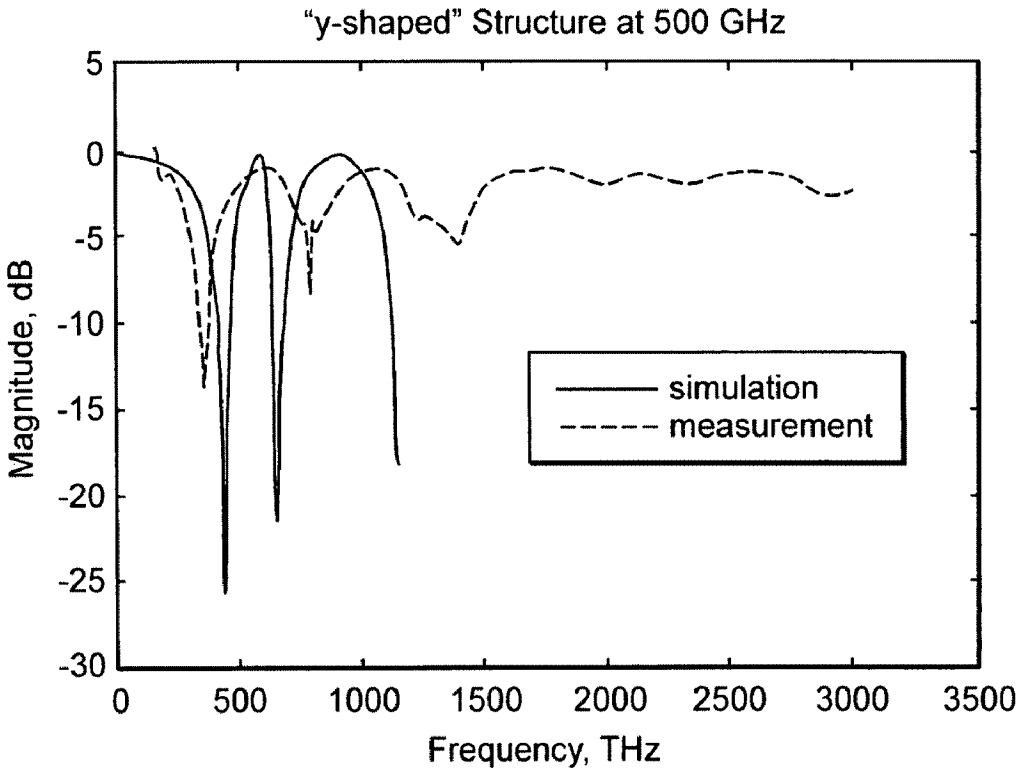
FIG. 35(*a*) is a light microscope photographic image of a chiral metamaterial of the invention that includes arrays of y-type shaped resonators.
Figure 35A:
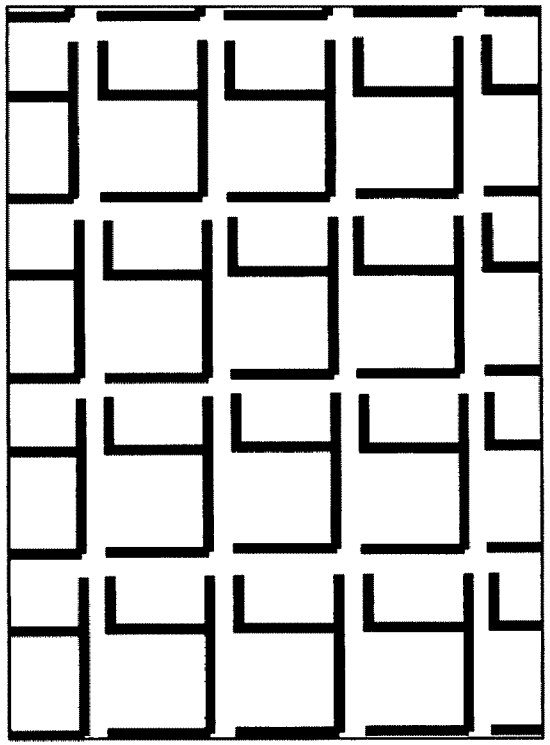
Figure 35C:
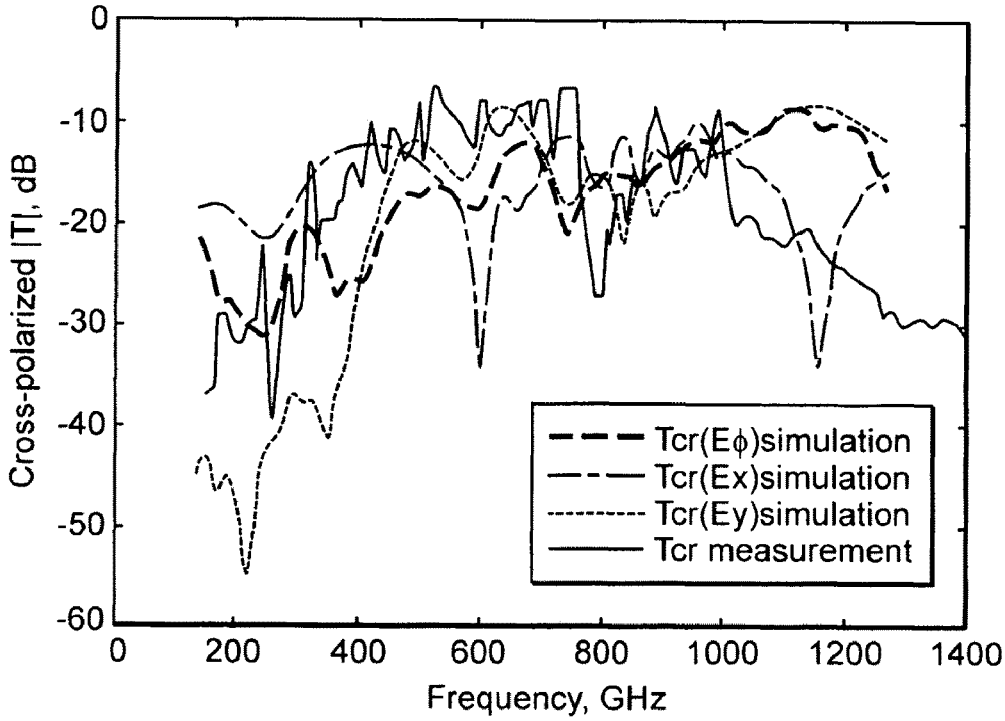
Figure 35D:
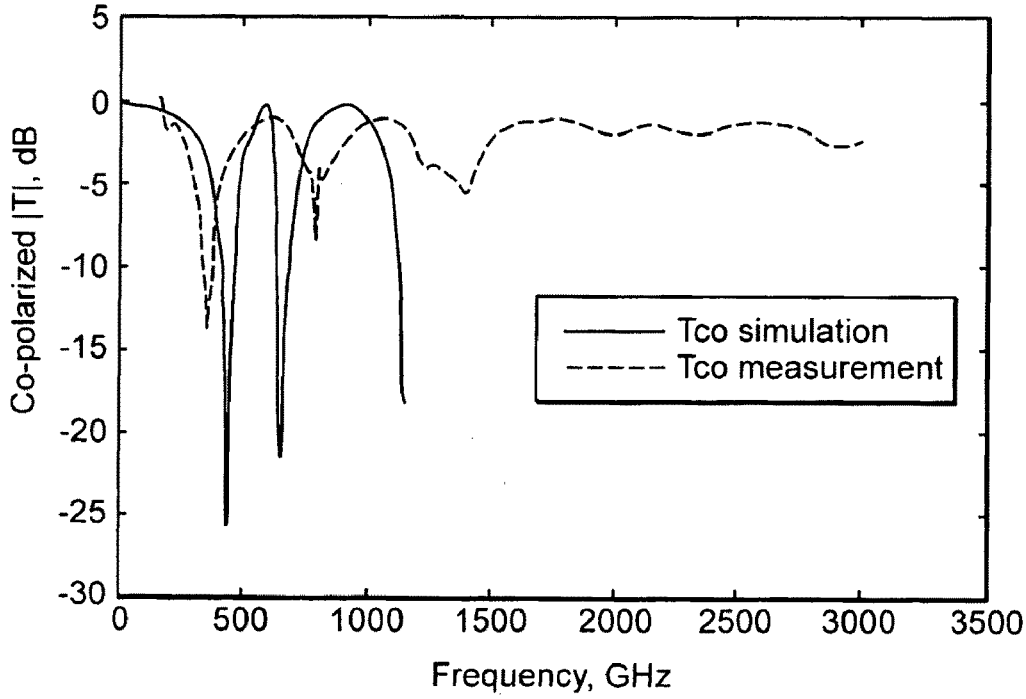

In a fifth study, as shown in FIG. 32, five neighboring resonators of patterns y51, y52, y53, and y54, were out from locations 1-5, 6-10, 11-15, and 16-20, respectively. In y55, resonators at locations 1-5, 6-10, 11-15, and 16-20 were taken off. Transmission coefficients of the resonators having the defects shown in FIG. 32 are shown in FIG. 33. The difference between the "five" missing and the "y=20" was not significant in y51 and y54 where the missing parts were close to the edge. However, the results of "y52" and "y53" where the five missing were located close to the center of the pattern were very different from the ideal cases as illustrated in FIG. 26.

Through the studies described above, for the pattern with twenty resonators, it was found that the number of the missing neighboring structures could be up to five such that the transmission properties remained similar to that of the pattern with no defects ("y=20" case). However, the missing part needed to be close to the edge not at the center. When resonators had defects in a periodic manner, the resonators provided the substantially same transmission properties as that of the semi-infinite one, provided that the gap was not too wide. For example, the "y25" case where 8 resonators were taken off still showed the substantially same bulk property.

Example 7

Comparison of Cross-polarized Transmission Coefficients with the Co-polarized Transmission Coefficients Three-dimensional electric fields were collected to calculate the co- and cross-polarized transmission coefficients ($E_z$ for the co-polarized term, $E_x$ and $E_y$ for the cross-polarized term), as described above using Equations (1)-(6). The cross-polarized value of the combination of $E_x$and $E_y$, represented by $E_\Phi$, was also calculated.

As controls, the co- and cross-polarized transmission coefficients of a metamaterial model having an array of wire-type resonators, which is not chiral, were also calculated: simulated results show that the cross-polarized transmission can be neglected.

The results of the co- and cross polarized transmission coefficients for chiral metamaterial models that include an array of omega-type, y-type, F-type, E-type and S-type shaped resonators are illustrated in FIGS. 34(*a*)-34(*e*), respectively. As shown in FIGS. 34(*a*)-34(*e*), the omega-type, y-type, F-type, E-type and S-type metamaterial models showed chirality. The cross-polarized transmission peaks for the y-type, E-type, F-type and S-type metamaterial models were higher than that for the omega-type metamaterial model. For the omega-type metamaterial model, the cross-polarized transmission peak was at a higher frequency than the co-polarized transmission peak. For the y-type, F- and E-type metamaterial models, the cross-polarized transmission peak and the co-polarized transmission peak were at similar frequencies with each other.

Example 8

Validation of Simulation Results: Comparison with Experimental Results from the Fabrication of the Repeating "Y-Type" Structure The metamaterials composed of the "y-type" shaped configuration were fabricated using standard lift-off and photolithography techniques on a 50 μm thick MYLAR® substrate. On one side, 1.8 μm thick photoresist was applied, and baked at 90° C. for 30 minutes. The edge bead was removed, the "y-type" shaped resonator pattern exposed and the photoresist coated MYLAR® soaked in chlorobenzene for 10 minutes. The photoresist pattern was developed out and a 100 nm thick aluminum (Al) film applied with electron-beam evaporation. The MYLAR® was then soaked in acetone and the excess metal removed by the lift-off process. Finally, each sample had the "y-shaped" pattern on one side of the sheet and no pattern on the other side. The pattern had aluminum with the thickness of 0.2 μm. The dimension of the samples was 1.5 cm by 2 cm or approximately 20,000 unit cells. The transmission coefficients of sample were measured with a commercial Bruker Fourier transform infrared (FT-IR) spectrometer. A light microscope photograph of the fabricated sample was presented in FIG. 35(*a*).

A comparison of the measured transmission coefficients of the fabricated sample with those calculated in the simulation results for the identical structures is shown in FIG. 35(*b*). These results show a close correspondence and provide proof that the simulation method is producing accurate results for all of the conditions studied.

A comparison of the measured cross-polarized transmission coefficients of the fabricated sample with those calculated in the simulation results for the identical structures is shown in FIG. 35(*c*): $E_z$ for the co-polarized term; $E_x$ and $E_y$ for the cross-polarized term; and $E_\Phi$ for the cross-polarized value of the combination of $E_x$ and $E_y$). As shown in FIG. 35(*c*), the measured cross-polarized transmission coefficients relatively match with those of the simulation: the dominated cross-polarized transmission terms, $E_y$ and $E_\Phi$, have two peaks (500 and 700 GHz for the simulation and 550 and 750 GHz for the experimental one). The bands of the experiment were generally wider than those of the simulation. This was also observed in the co-polarized transmission coefficients (see FIG. 35(*d*)). In both experimental and simulated results, the co- and cross-polarized transmission coefficients occurred in essentially the same frequency band (400-750 GHz for the simulation and 380-800 GHz for the experiment). This observation indicates that the metamaterial composed of the "y-type" shaped configuration, as shown in FIG. 35(*a*), has a strong cross-polarized transmission coefficients (i.e., chirality) in essentially the same frequency region as the passband of the co-polarized transmission.

Example 9

Structure Design: Calculation of Electric and Magnetic Parameters of Chiral Metamaterials 9.A. Classification of Chiral and Bi-anisotropic Properties by Group Theory The bi-anisotropic properties of chiral metamaterials could be determined by the group theory known in the art. The group theory, a formalism used to classify the symmetry of molecules, was used to identify the isotropy of magnetic resonators of metamaterials. After the structure of a metamaterial was categorized into a group, an electromagnetic (EM) basis was assigned to the structure by applying a wave polarization concept. By investigating and transforming this basis according to the symmetries of the group, the EM mode, spatial independence, magnetoelectric and cross-couplings were calculated.

To generate a structure which has a high probability of being chiral, the Cs group was selected. This group had only the identity and the perpendicular reflection plane $\sigma_h$ symmetries. The character table and the irreducible representation for this group are shown in Table 5.

TABLE 5

Character table for the $C_s$ point group.

| $C_s$ | E | $\sigma^h$ | Linear | Quadratic |
|---|---|---|---|---|
| A' | 1 | 1 | x; y; $R_z$ | $x^2$; $y^2$; $z^2$; xy |
| A" | 1 | −1 | z; $R_x$; $R_y$ | xz; yz |
| $\Gamma_y$ | 5 | 5 | | |

The representative A' contained two electric fields polarized in the x and y axes directions and according to the rotation function $R_\alpha$, there was one magnetic field in the z direction (Both can be seen in the Linear column of Table I.). On the other hand, A" had the magnetic fields polarized along the x and y directions and the electric field in the z direction, respectively.

Figure 36A:
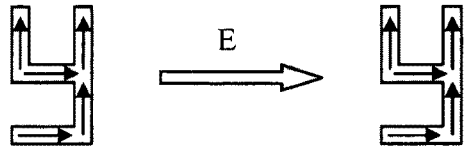
FIGS. 36(*a*) and 36(*b*) show schematic representations of the behavior of a y-type resonator of the invention with respect to the symmetry operations (a) E and (b) $\sigma_h$, with arrows indicating the direction of currents excited by an external electric field.
Figure 36B:
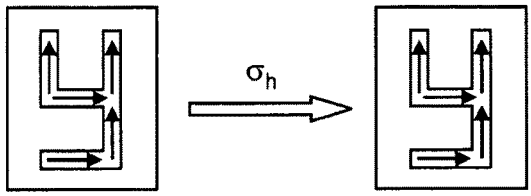

FIGS. 36(*a*) and 36(*b*) show the behavior of the y-type resonator in relation to the symmetry operations within the Cs group. The y-type resonator, interacting with polarized light under the two symmetry operations, had the behavior exhibited in FIGS. 36(*a*) and 36(*b*) that was illustrated by the location and direction of the arrows. In FIGS. 36(*a*) and 36(*b*), the arrows marked the directions of currents due to an external electric field before and after the symmetry operations. These arrows were used to find the representation for each of the symmetry operations. For both E and $\sigma_h$ operations, all of the arrows were unchanged, so the character for each is +1 giving a total of +5. The numbers of each symmetry element of Y were shown in the last row in Table 5.

A basis set was assigned to the model which was reduced to A' or $\Gamma_y$=5A'. This basis set meant that the y-type resonator had a magnetoelectric mode determined by the coupling between the two electric fields (along x and y axes) and the magnetic field in the z direction. These two electric fields also generated the off-diagonal permittivity terms. The material parameters calculated based upon the basis set is as follows:

$$\bar{\bar{\varepsilon}} = \begin{bmatrix} \varepsilon_{xx} & \varepsilon_{xy} & 0 \\ \varepsilon_{yx} & \varepsilon_{yy} & 0 \\ 0 & 0 & 1 \end{bmatrix} \quad \bar{\bar{\mu}} = \begin{bmatrix} 1 & 0 & 0 \\ 0 & 1 & 0 \\ 0 & 0 & \mu_{zz} \end{bmatrix} \tag{1a}$$

The calculated magnetoelectric permittivity was:

$$\bar{\bar{\xi}} = \begin{bmatrix} 0 & 0 & \xi_{xz} \\ 0 & 0 & \xi_{yz} \\ 0 & 0 & 0 \end{bmatrix} \quad \bar{\bar{\zeta}} = \begin{bmatrix} 0 & 0 & 0 \\ 0 & 0 & 0 \\ \zeta_{zx} & \zeta_{zy} & 0 \end{bmatrix} \tag{2a}$$

The material parameters of other chiral MTMs, composed of omega, gammadion and the S structures, were also calculated and they are shown in Table 6. In these calculations, the y-type, gammadion, and S-type resonators were placed on the x-y plane while the omega-type resonator was on the x-z plane. The z-axis was selected as the main axis.

TABLE 6

Material parameters of different chiral metamaterials.

| | | Material Parameters | | | |
|---|---|---|---|---|---|
| | Point | Cross-polarization dyadics | | Co-polarization dyadics | |
| Structure | Group | $\bar{\bar{\xi}}$ | $\bar{\bar{\zeta}}$ | $\bar{\bar{\varepsilon}}$ | $\bar{\bar{\mu}}$ |
| 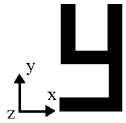  | $C_s$ | $\bar{\bar{\xi}} = \begin{bmatrix} 0 & 0 & \xi_{xz} \\ 0 & 0 & \xi_{yz} \\ 0 & 0 & 0 \end{bmatrix}$ | $\bar{\bar{\zeta}} = \begin{bmatrix} 0 & 0 & 0 \\ 0 & 0 & 0 \\ \zeta_{zx} & \zeta_{zy} & 0 \end{bmatrix}$ | $\bar{\bar{\varepsilon}} = \begin{bmatrix} \varepsilon_{xx} & \varepsilon_{xy} & 0 \\ \varepsilon_{yx} & \varepsilon_{yy} & 0 \\ 0 & 0 & 1 \end{bmatrix}$ | $\bar{\bar{\mu}} = \begin{bmatrix} 1 & 0 & 0 \\ 0 & 1 & 0 \\ 0 & 0 & \mu_{zz} \end{bmatrix}$ |

TABLE 6-continued

Material parameters of different chiral metamaterials.

| Structure | Point Group | Material Parameters: Cross-polarization dyadics $\bar{\bar{\xi}}$ | Cross-polarization dyadics $\bar{\bar{\zeta}}$ | Co-polarization dyadics $\bar{\bar{\varepsilon}}$ | Co-polarization dyadics $\bar{\bar{\mu}}$ |
|---|---|---|---|---|---|
| 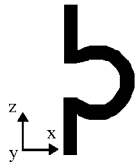 | $C_{2v}$ | $\bar{\bar{\xi}} = \begin{bmatrix} 0 & \xi_{xy} & 0 \\ 0 & 0 & 0 \\ 0 & 0 & 0 \end{bmatrix}$ | $\bar{\bar{\zeta}} = \begin{bmatrix} 0 & 0 & 0 \\ \zeta_{yx} & 0 & 0 \\ 0 & 0 & 0 \end{bmatrix}$ | $\bar{\bar{\varepsilon}} = \begin{bmatrix} \varepsilon_{xx} & 0 & 0 \\ 0 & 1 & 0 \\ 0 & 0 & \varepsilon_{zz} \end{bmatrix}$ | $\bar{\bar{\mu}} = \begin{bmatrix} 1 & 0 & 0 \\ 0 & \mu_{yy} & 0 \\ 0 & 0 & 1 \end{bmatrix}$ |
| 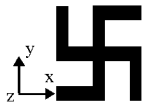 | $C_4$ | $\bar{\bar{\xi}} = \begin{bmatrix} 0 & 0 & 0 \\ 0 & 0 & 0 \\ 0 & 0 & \xi_{zz} \end{bmatrix}$ | $\bar{\bar{\zeta}} = \begin{bmatrix} 0 & 0 & 0 \\ 0 & 0 & 0 \\ 0 & 0 & \zeta_{zz} \end{bmatrix}$ | $\bar{\bar{\varepsilon}} = \begin{bmatrix} \varepsilon_{xx} & 0 & 0 \\ 0 & \varepsilon_{yy} & 0 \\ 0 & 0 & \varepsilon_{zz} \end{bmatrix}$ | $\bar{\bar{\mu}} = \begin{bmatrix} \mu_{xx} & 0 & 0 \\ 0 & \mu_{yy} & 0 \\ 0 & 0 & \mu_{zz} \end{bmatrix}$ |
| 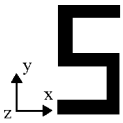 | $C_{2h}$ | — | — | $\bar{\bar{\varepsilon}} = \begin{bmatrix} \varepsilon_{xx} & \varepsilon_{xy} & 0 \\ \varepsilon_{yx} & \varepsilon_{yy} & 0 \\ 0 & 0 & 1 \end{bmatrix}$ | $\bar{\bar{\mu}} = \begin{bmatrix} 1 & 0 & 0 \\ 0 & 1 & 0 \\ 0 & 0 & \mu_{zz} \end{bmatrix}$ |

The chiral structures were categorized based upon the data in Table 6. As shown in Table 6, the y-type resonator with $C_s$ symmetry and the omega-type resonator structure with $C_{2v}$ symmetry were both bi-anisotropic, which meant they could have both cross-coupling and material properties that depended upon direction. The planar gammadion with $C_4$ symmetry was grouped into bi-isotropic media because the co- and cross-polarization terms were oriented along the diagonal. Without the cross-polarization terms, the S-type resonator with $C_{2h}$ symmetry was achiral and could be grouped into anisotropic media.

Example 10

Realistic Device Behavior Simulations in the Microwave and Terahertz Frequencies: FDTD Modeling FDTD modeling was used to determine the transmission properties of the y-type resonator metamaterial. The y-type resonator was modeled as gold using the Drude model with the recursive convolution (RC) technique (see Examples 1 and 2, and R. F. Marques, et al., *Microwave and Opt. Tech. Lett.* 35, 405 (2002) (the entire teachings of which are incorporated herein by reference) in the FDTD model. The parameters for gold and other noble metals listed in Bayindir et al., *App. Phys. Lett.,* 81(1), 120-122 (2002) (the entire teachings of which are incorporated herein by reference) were used for the PDTD modeling. These parameters are Plasma frequency: $\omega_p=1.48\times10^{16}$ rad/s and Damping constant: $\gamma_p=1.16\times10^{13}$ rad/s.

Figure 37A:
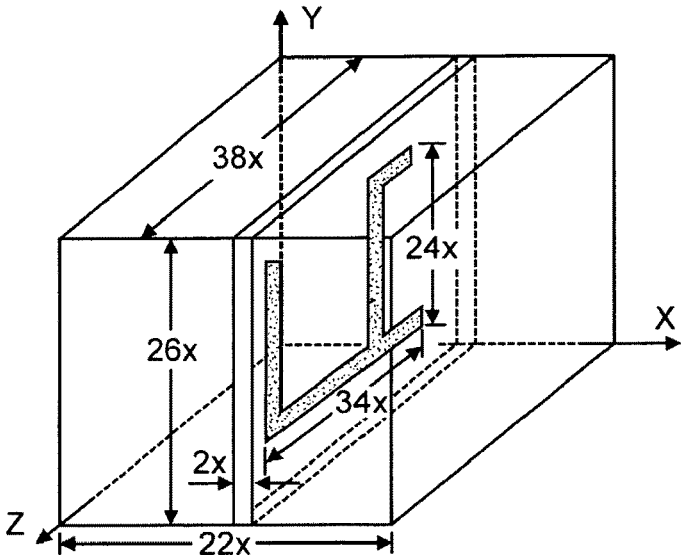
FIGS. 37(*a*) and 37(*b*) are schematic representations showing: (a) a unit cell used for the FDTD simulations of the 3D metamaterial and (b) dimensions of a y-type resonator of the invention that has a negative index passband for a normal incidence.
Figure 37B:
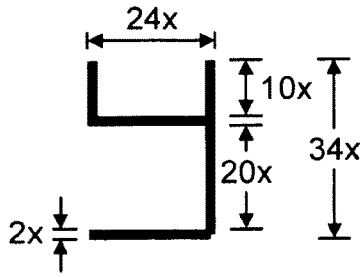

The unit cell and the dimensions of the y-type resonator are shown in FIGS. 37(*a*) and 37(*b*), respectively. The resonator had the thickness of 2x where x was the grid cell size. An incident plane wave propagated along the x-axis. Electric and magnetic fields were set at z- and y-axes, respectively. The unit cell was implemented with appropriate periodic boundary conditions as described in Example 2 to essentially simulate a semi-infinite slab of the y-type resonator (see also García-García et al., *J. Appl. Phys.,* 98(3), 033013, 2005; Koschny, et al., *Phys. Rev. B.,* 71(12), 121103, 2005; Ozbay, et al., *IEEE Trans. Antenna Propagat.,* 51(10), 2592-2595, 2003, all of which are incorporated herein by reference by their entirety). Electric fields (on x-y planes) were collected at port 1 and port 2, 10× before and after the y-type resonator. Scattering parameters were then obtained by taking Fast Fourier Transform (FFT) within any frequency of interest depending on the source.

In experiments, for parallel propagation (in-plane propagation), several number of layers of the metamaterial were stacked to provide full coverage for the incident beam. In THz frequencies, if a tunable laser source having a operating wavelength of 1.5-1.65 microns was used, about 100 layers were required. The construction of multilayer metamaterials was challenging since correct alignment could be difficult to achieve and the fabrication of uniform nano-scale structures required very high resolution photolithography. Therefore, for the purpose of comparison with experiments, perpendicular propagation, where the direction of propagation was normal to the structure plane was initially considered. The electric field was parallel to the long axis while the magnetic field was parallel to the base of the structure. Further numerical analysis on parallel propagation as well as perpendicular propagation is described in Example 11 below.

Figure 38B:
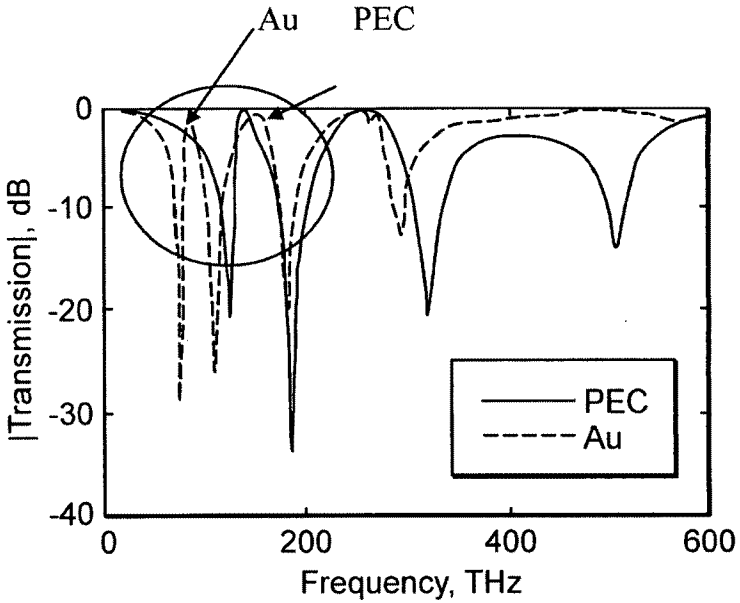
FIGS. 38(*a*) and 38(*b*) are graphs showing simulated transmission responses of 3D stacks of y-type resonator arrays for two different materials, i.e. PEC (perfect electric conductor, solid line) and Au (dotted line) in: (a) a microwave regime and (b) a THz (terahertz) regime, wherein the grid sizes of the y-type resonator are 254 microns and 13.5 nm, respectively and wherein the perpendicular propagation direction is normal to the stacks of the y-type resonator arrays.
Figure 38A:
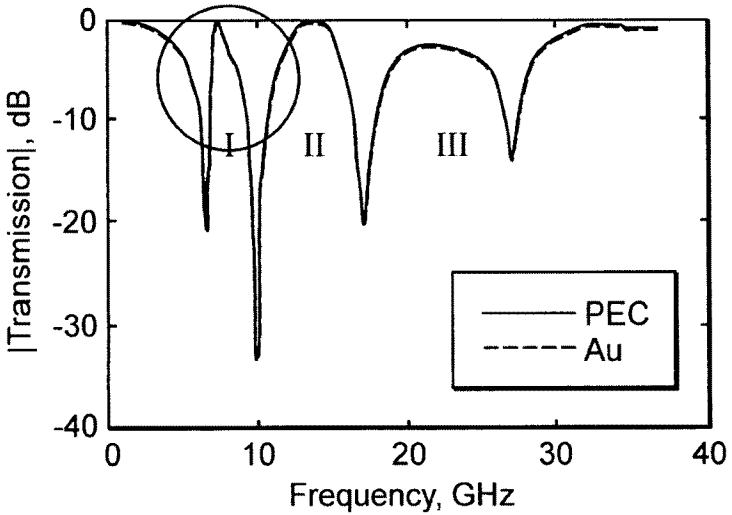

The grid size (x) of the y-type resonator was 254 microns. The resonator was then scaled down to the nanoscale with the grid dimension of 13.5 nm, where the passband was expected to occur in THz regime. FIGS. 38(*a*) and 38(*b*) illustrates the transmission and reflection coefficients of the Y-structure arrays when either PEC or Au was presented as the structure materials.

FIGS. 38(*a*) and 38(*b*) show simulated transmission responses of 3D y-type resonator arrays of two different material compositions i.e. PEC (solid line) and AU (dotted line) in the (a) microwave and (b) THz (terahertz regines, wherein the grid sized of the y-type resonator are 254 microns and 13.5 nm, respectively. The perpendicular propagation direction is normal to the stacks of the y-type resonator arrays. There were three passbands generated for both materials as marked in FIG. 38(*a*). The transmission shapes of the PEC y-structures were similar in both the micronscale and nanoscale sizes. In the microwave band, the metamaterials composed of PEC and Au responded identically. However, the transmission range in the THz regime shifted down significantly compared to that of the non-dispersive material.

Example 11

Numerical Results—Comprehensive Study of the Y-Shaped Resonator

Figure 39:
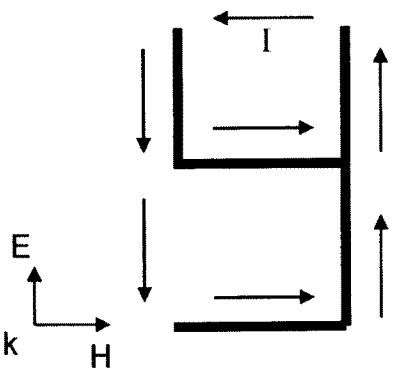
FIG. 39 is a schematic representation of a circular current evident in a y-type resonator of the invention where arrows denote current.

Various changes in the dimensions of a y-type resonator as well as its orientation were examined by simulations. Behavior of the y-type resonator when the direction of wave propagation was either perpendicular or parallel to the resonator was considered. Drude model results for perpendicular propagation were shown in the Example 10 above. Regularly, for the parallel propagation case where a magnetic field direction was normal to the structure plane, the magnetic resonance of the structure was excited by an incident EM wave through the magnetic field. Probably due to its asymmetric structure, the circular current generated in the y-resonator as shown in FIG. 39 induced the magnetic resonance which could cause the NRI property of the resonator.

11A. Perpendicular Propagation

Figure 40B:
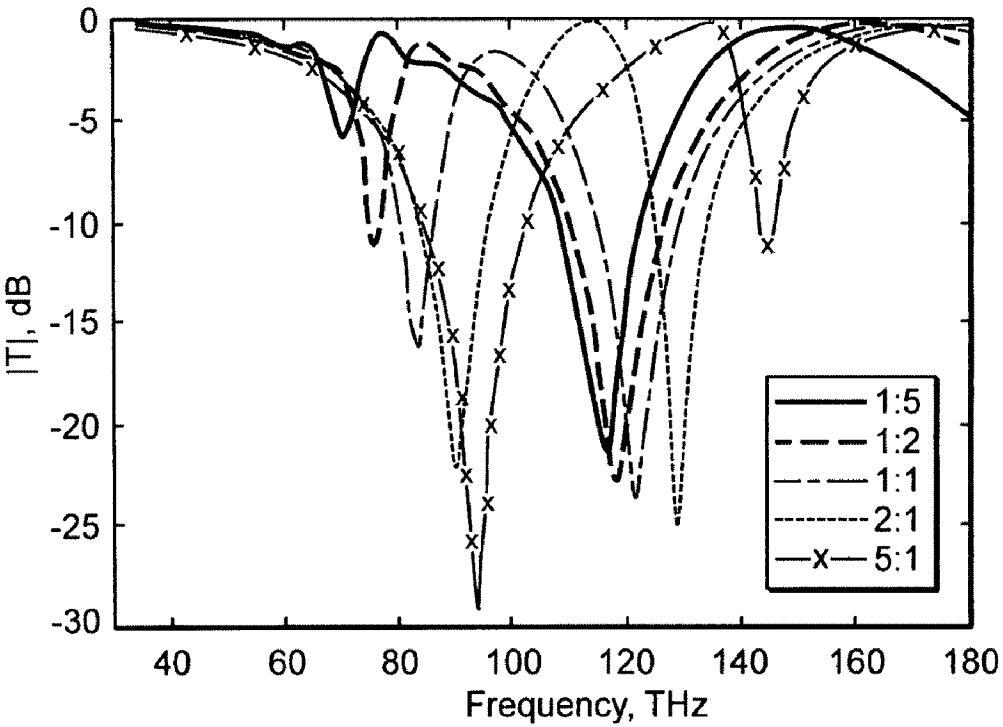
FIG. 40(*a*) is a schematic representation of a unit cell used in the FDTD simulations of the y-type resonator of the invention studied in a THz regime with perpendicular propagation.
Figure 40A:
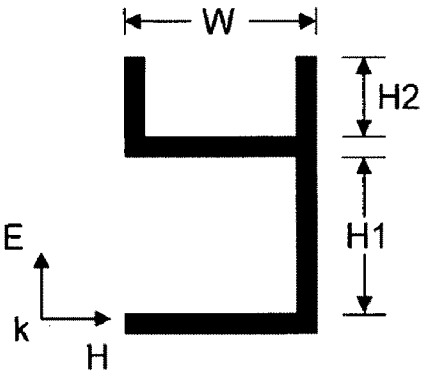

Initially, the case where the electromagnetic field propagation was perpendicular to a metamaterial composed of the y-type resonator shown in FIG. 40(*a*) was studied using the same model as displayed in FIGS. 36(*a*) and 36(*b*).

The ratio of the heights, H1 and H2, in the y-shaped resonator was varied, to study the change of its transmission band, using the FDTD model. The y-type resonators were implemented as Au using the Drude model. The width and the total height (H1+H2) of the resonator were fixed at 324 nm and 450 nm, respectively. The dimensions of the y-type resonators are shown in FIG. 40(*a*). The simulated transmission coefficients of metamaterials having the y-type resonators as a function of frequency for the perpendicular wave propagation orientation are presented in FIG. 40(*b*). In FIG. 40(*b*), the y-type resonators have, respectively, an H2:H1 ratio of: (a) 1:5, (b) 1:2, (c) 1:1, (d) 2:1, and (e) 5:1. These results indicated that passband would be perfectly formed when the ratio of H1:H2 was 2:1.

10B. Parallel Propagation

Figure 41B:
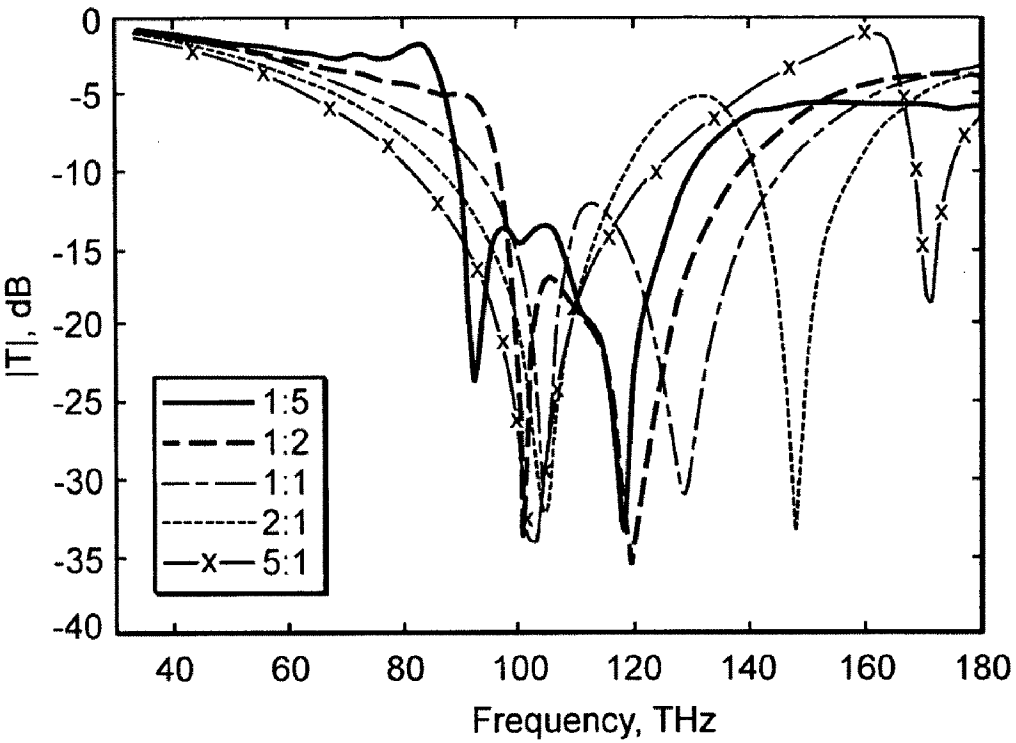
FIG. 41(*a*) is a schematic representation of a unit cell used in the FDTD simulations of the y-type resonator of the invention studied in a THz regime with parallel propagation.
Figure 41A:
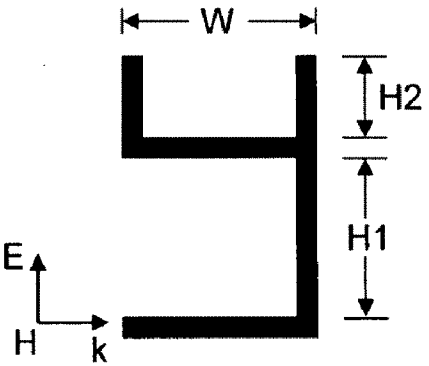

For the case of parallel propagation orientation of the y-type resonator, the transmission properties of the resonator were investigated by varying the height ratio, similarly to the experiments described for parallel propagation above. The dimensions of the y-type resonators are shown in FIG. 41(*a*). The simulated transmission coefficients of metamaterials having the y-type resonators as a function of frequency for the parallel wave propagation orientation are presented in FIG. 41(*b*). In FIG. 41(*b*), the y-type resonators have, respectively, an H2:H1 ratio of: (a) 1:5, (b) 1:2, (c) 1:1, (d) 2:1, and (e) 5:1. These results indicated that the passband would be perfectly formed when the ratio of H1:H2 was 2:1. The transmission passband simulation results, shown in FIG. 41(*b*), showed that when the ratio was 1:2, the frequency range of the passband was narrowest and had the lowest transmission level (about −17 dB). The passband became broader when the ratio varied from 1:2 to 5:1. The transmission quality improved when H1 increased. The passband had a peak close to 0 dB when the ratio was 5:1. However, the structure with 2:1 ratio provided the best result in terms of the passband profile, with high transmission quality (−3 dB).

Figure 42A:
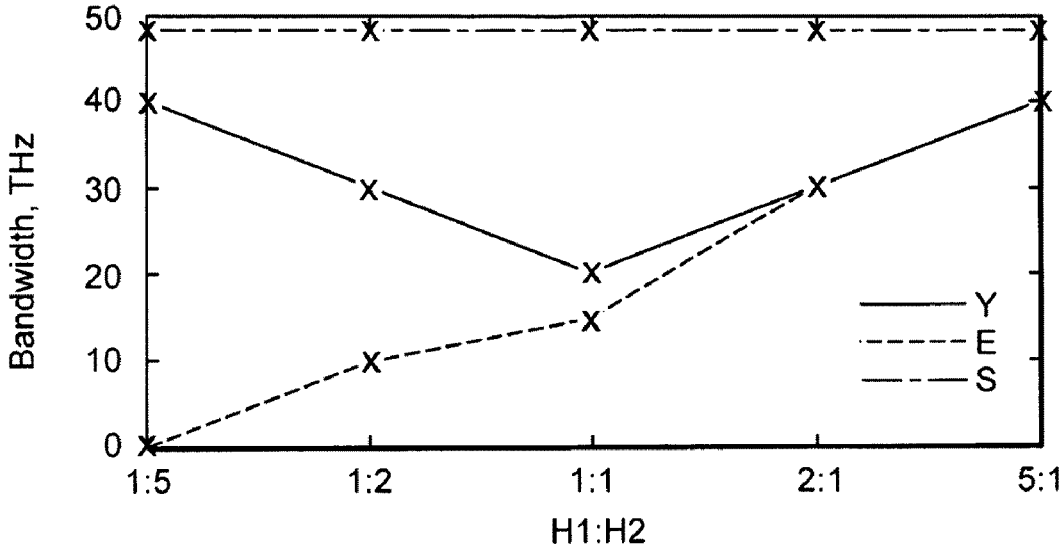
FIGS. 42(*a*) and 42(*b*) are graphs showing simulated (a) band width and (b) transmission level comparisons of y-, S-, and E-type resonators with parallel propagation, as a function of their H1:H2 height ratios.
Figure 42B:
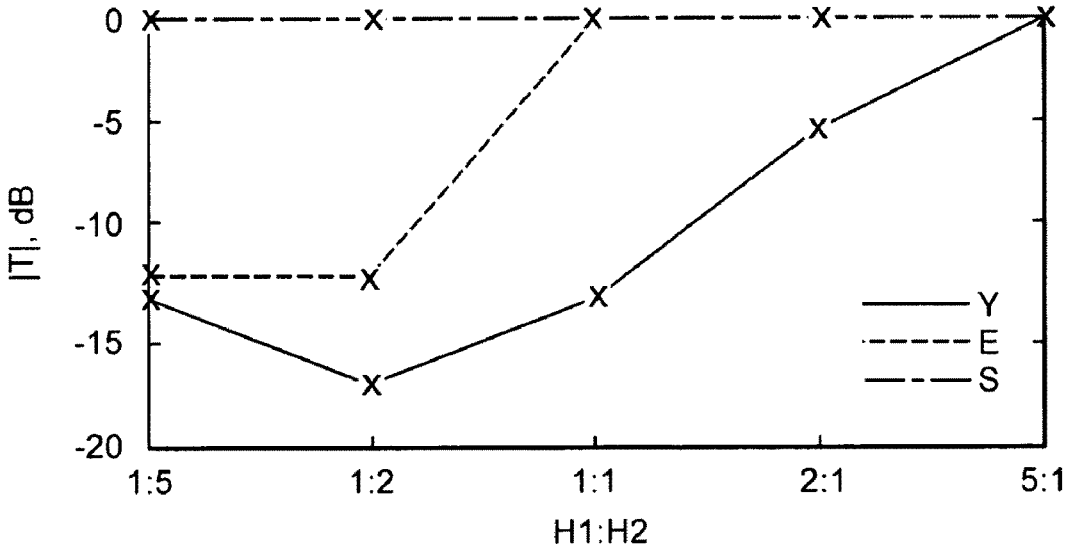

Next, the transmission results of the y-type resonator were compared to those of S- and E-type resonators, as shown in FIGS. 42(*a*) and 42(*b*). FIG. 42(*a*) shows band width comparison of y-, S-, and E-type resonators with parallel propagation, as a function of their H1:H2 height ratios. FIG. 42(*a*) shows transmission level comparison of y-, S-, and E-type resonators with parallel propagation, as a function of their H1:H2 height ratios. As shown in FIGS. 42(*a*) and 42(*b*), the height ratio did not affect the S-type resonator behavior. The band width and the quality of the transmission of the S-type resonator were constant (width=48 THz, ITS=0 dB). For the E-type resonator, the width of the passband started from 0 when the ratio was 1:5, and became broader (40 THz) when the height H2 increased. On the other hand, the advantages of the Y-shaped resonator structure were clear in the data presented. Both the frequency bandwidth and the transmission coefficient levels could be varied in a wide range through the adjustment of the H1 to H2 values. The width of the band was broadest at 40 THz when the ratios were 1:5 and 5:1 and narrowest at 20 THz with 1:1 ratio, as is shown in FIG. 42(*b*).

Example 12

Demonstration and Validation of Negative Refractive Index Behavior

In this example, Snell's law experiments, similar to those described in Kafesaki, et al. *J. Opt. A: Pure Appl. Opt.,* 7, S12-S22 (2005) (the entire teachings of which are incorporated herein by reference), were carried out on wedge-shaped models composed of y-type resonators, using FDTD in both the X and THz bands. Oblique incidence on these structures was also studied. To avoid the complexity of the simulations using the FDTD method, a prism-shaped structure was used to study different incident angles. In this example, perpendicular propagation was used.

12A. Wedge and Prism Models by FDTD Implementations

Figure 43A:
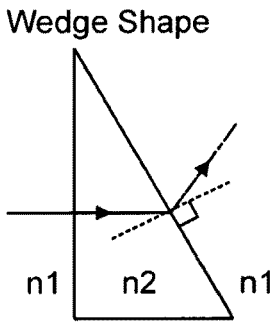
FIGS. 43(*a*) and 43(*b*) are schematic drawings showing negative index validation 3D-models of (a) wedge-shaped and (b) prism-shaped structures.
Figure 43B:
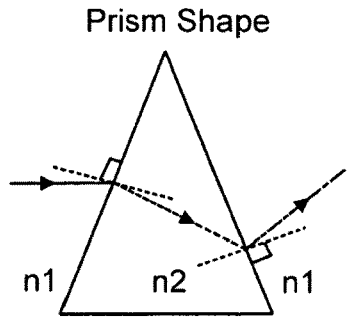

Propagation directions within wedge- and prism-shaped models, which were 3-D models comprised of multiple layers of 2-D arrays of the proposed metamaterials are illustrated in FIGS. 43(*a*) and 43(*b*). FIG. 43(*a*) shows negative index validation models for wedge-shaped metamaterials. FIG. 43(*b*) shows negative index validation models for prism-shaped metamaterials.

Figure 44:
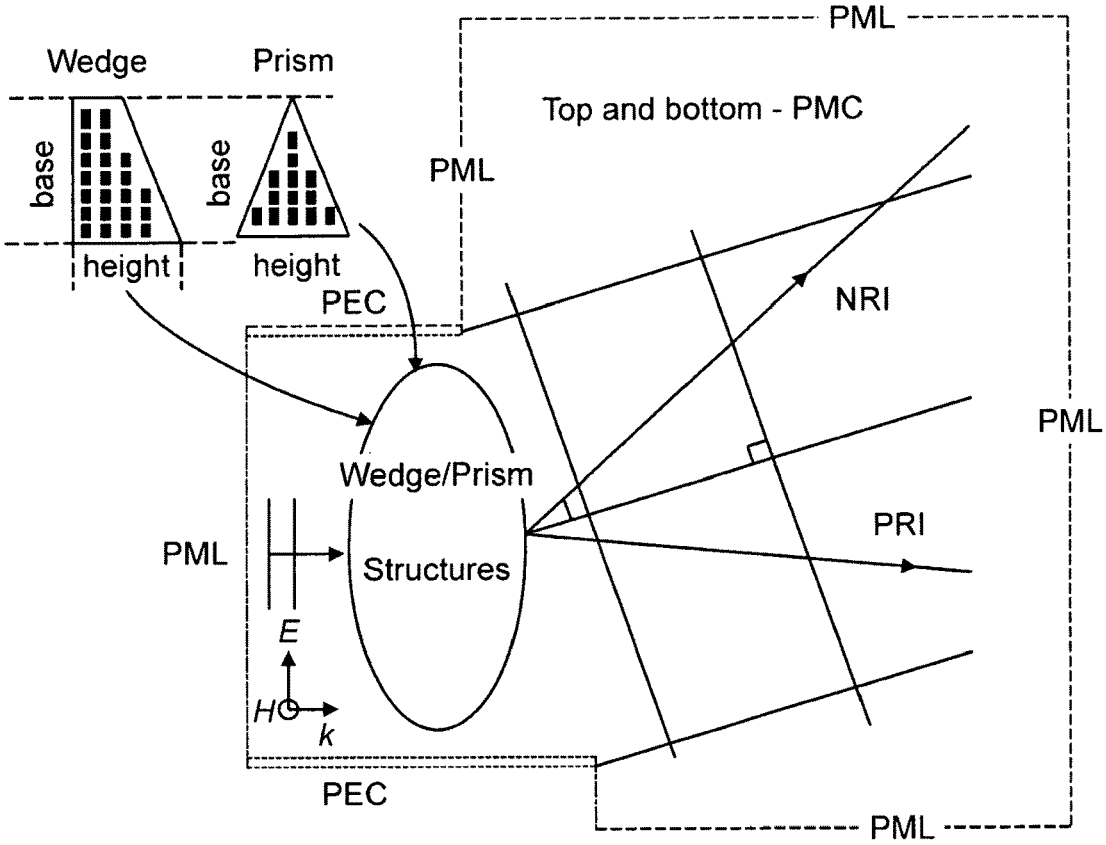
FIG. 44 is a schematic representation of models of wedge- and prism-shaped structures for FDTD simulations for perpendicular propagation in one embodiment of the invention, wherein boundary conditions and the directions of propagations of refracted waves for a positive refractive index (PRI) material and a negative refractive index (NRI) material are indicated.

In any positive refractive index (PRI) material under the Snell's law, the wave would propagate in the direction of the second largest angle of the wedge (90° being the largest). On the other hand, for negative refractive index (NRI) materials, the wave would propagate in the direction of the angle of elevation. The wave directions in both materials for the FDTD simulation are shown in the wedge and prism models in FIG. 44. FIG. 44 shows models of wedge- and prism-shaped metamaterials for FDTD simulations for perpendicular propagation. The appropriate boundary conditions as well as the directions of propagations for the refracted wave for a positive refractive index (PRI) material and negative refractive index (NRI) were indicated. The boundaries (PMC, PEC, and PML) were set as shown in FIG. 44. Because the PMC walls were set at the top and bottom, only one layer of the metamaterials in between the PMC walls was required. The other two sides where the metamaterials were placed had perfect electric conductor (PEC) boundaries. The remaining boundaries were set by using a perfectly matched layer (PML) boundary condition to absorb the radiated fields. (García-García et al., *J. Appl. Phys.,* 98(3), 033013, 2005;

Koschny, et al., *Phys. Rev. B.,* 71(12), 121103, 2005; Ozbay, et al., *IEEE Trans. Antenna Propagat.,* 51(10), 2592-2595, 2003)

The simulations were implemented in two frequency regimes, the X and THz bands. For the two frequency simulations, the models used were composed of the same pattern of y-type resonators except the grid sizes were different The grid sizes of the structures designed to be operated in X band (~10 GHz) and THz (~110 THz) were 254 μm and 13.5 nm, respectively. These dimensions of the y-type resonator were similar to those in FIGS. 37(*a*) and 37(*b*). The y-type resonators were simulated as gold (Au) using the Drude model. The base and the height of the wedge model had nine and five sets of y-type resonators, respectively. Distance between the 2D y-shaped resonator stacks was 22×. To construct a 24-degree wedge angle, the number of y-type resonators was decreased by two in each consecutive row.

The simulations showed that waves exited the wedge and prism models in the direction below the reference angle with a range of (−)15 to (−)20 degrees (the reference line (grey color) is drawn in FIG. 44 normal to the structure line at 9.75 GHz and 113 THz for the micronscale and nanoscale models, respectively. These results confirmed the negative index behavior of the wedge and prism models. The negative index frequencies agreed with the first passband frequencies discussed in Example 10. There were extra transmissions in the positive refraction angle direction, which could be attributed to the magnetoelectric coupling of the structure or an arrangement of the structures in the wedge structure.

12B. Experimental Results in the X Band

In order to experimentally validate the negative index of refraction of metamaterials having y-type resonators as described above in Example 12A, a wedge-shaped metamaterial having y-shaped resonators was designed and fabricated in a microwave regime. The widths and height of the y-shaped resonator which generated NRI [negative refractive index] behavior in a microwave regime for a perpendicular propagation were 0.24 and 0.34 inch. The line width and the distance between the structures were 0.02 and 0.04 inches respectively.

The wedge-shaped metamaterials were fabricated by a commercial printed circuit board process on one side of Rogers 4350 boards 18"×12"×0.010" with 1 oz gold patterns. The Rogers 4350 substrate ($\in_r$=3.48) had a loss tangent of 0.004. The 24° wedge with a reduction of two structures in each consecutive sheet was constructed to create the wedge angle. The ¼ inch thick ECCOSTOCK® PP (PP4) was inserted in between each board. This flexible material, with the loss tangent of 0.0001 and $\in_r$=1.03, was made of hydrocarbon resin foam. The final wedge model had a dimension of 9⅞"× 3½"×3⅝" with 15 board sheets.

Figure 45:
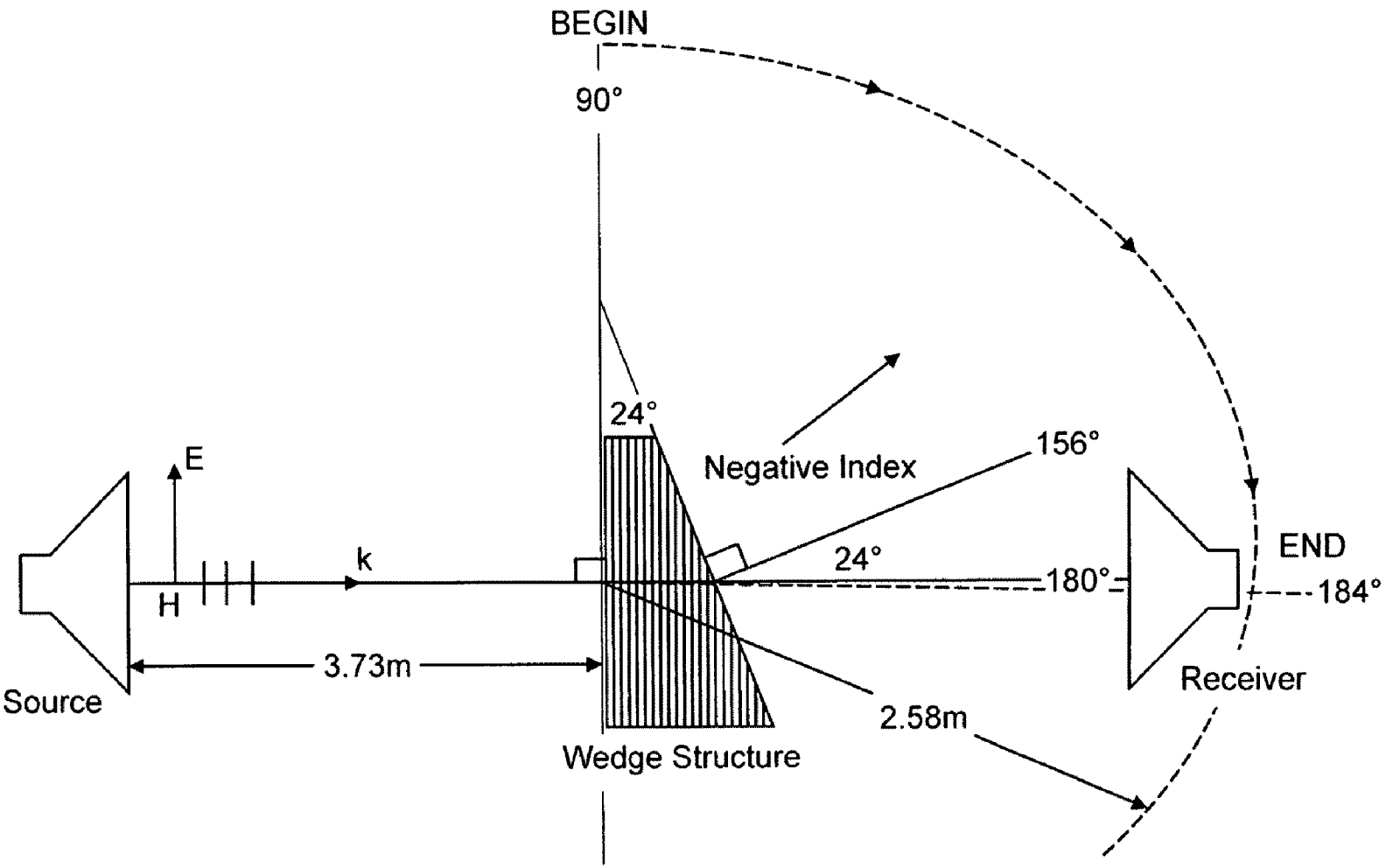
FIG. 45 is a schematic representation of an experimental set up for measuring a negative index of refraction for perpendicular propagation.

FIG. 45 shows an experimental set up for measuring negative index of refraction for perpendicular propagation. The transmitter and receiver horns shown in FIG. 45 had 20 cm×20 cm diagonal mounts, with 14 degree 3 dB beam width. The 3 dB beam width at the wedge was 0.91 m. From this set-up, one could conclude that the input wave was approximately a planar wave. The transmission distance from a receiver horn to the front of the wedge was 3.73 m. The receive distance from that same point to the receiver horn, which was the center of rotation for the radial arm, was 2.58 m. The receiver horn started at 90 degrees and finished at 184 degrees as shown in FIG. 45. The data was collected every 2 degrees with the frequency step of 0.05 GHz, from 8 GHz to 12 GHz. An HP 8530 receiver was used to collect the data.

Figure 46:
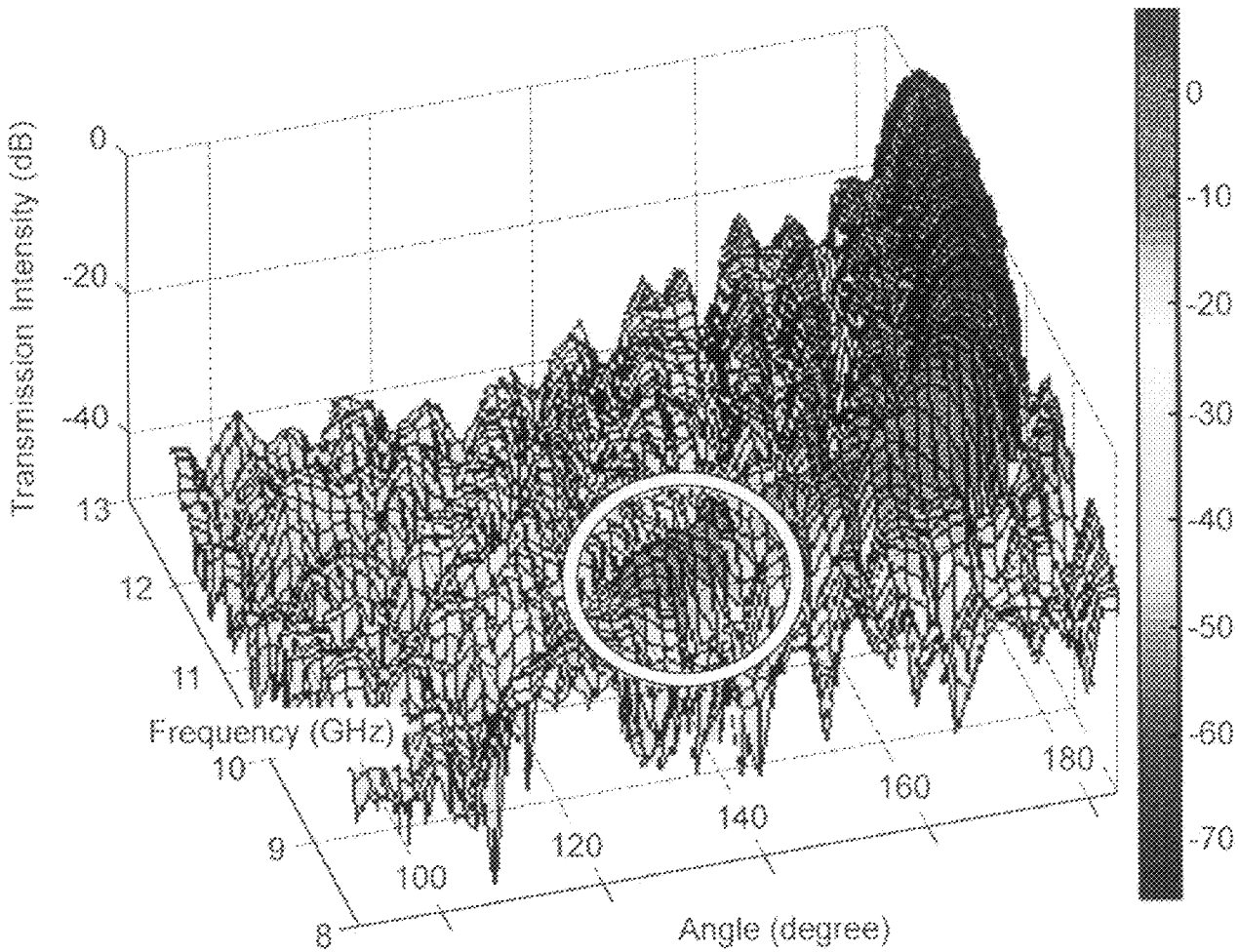
FIG. 46 shows a 3D-plot of data collected from an HP 8530 receiver for a perpendicular propagation experiment, as described in FIG. 45. The negative index peak is found (within the white circle) at 140 degrees (or −16 degrees with respect to the normal line) at 9.75 GHz.

A negative index band was found from 9.0 to 10.7 GHz, as presented in FIG. 46. FIG. 46 shows a 3D plot of the data collected from the HP 8530 receiver for perpendicular propagation. The negative index peak was found (within the white circle in FIG. 46) at 140 degrees (or −16 degrees with respect to the normal line) at 9.75 GHz. The transmission intensity peaks occurred at 140 degrees or about −16 degrees relative to the reference angle. These experimental results were matched with the simulation results described above in Example 12A. Also, these experimental results showed the negative refractive index transmission band centered at 9.75 GHz, with the negative angle approximately −18 degrees relative to the reference angle.

Example 13

Fabrication of THz Chiral Metamaterials and Their EM Propertie

Metamaterials based on the y-resonator were fabricated, and the co- and cross-polarized transmission coefficients were also measured in a THz regime. The y-shaped resonator for the metamaterial had the same dimension ratio mentioned in FIGS. 37(*a*) and 37(*b*) with the grid size of 4 microns. The NRI (negative refractive index) passband centered at 600 GHz was expected.

Figure 47:
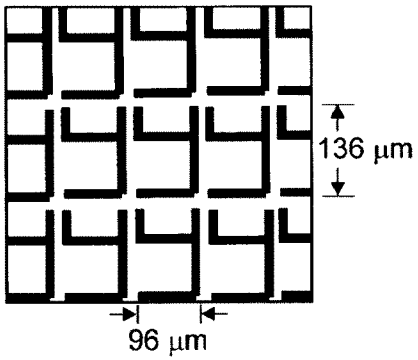
FIG. 47 is a light micrograph of a y-type resonator fabricated device of the invention.

The metamaterials including repeats of the y-shaped resonators were fabricated using standard lift-off and photolithography techniques on a 50 μm thick Mylar sheet. On one side, a 1.8 μm thick photoresist was applied, and baked at 90° C. for 30 minutes. The edge bead was removed, the y-shaped resonator pattern exposed and the photoresist coated Mylar soaked in chlorobenzene for 10 minutes. The photoresist pattern was then developed out and a 100 nm thick aluminum (Al) film was applied by electron-beam evaporation. The Mylar was then soaked in acetone and the excess metal removed by the lift-off process. In the final structure, the y-shaped pattern occurred only on one side of the sheet and no pattern occurred on the other side. The pattern was comprised of aluminum with 0.2 μm thickness. The total extent of the patterned sample area was 1.5 cm by 2 cm or approximately 20,000 unit cells. A light micrograph photo of the final fabricated sample are presented in FIG. 47.

The transmission spectra of the fabricated Y-shaped resonator sample were measured for perpendicular propagation with a commercial Bruker Fourier transform infrared (FT-IR) spectrometer.

Figure 48B:
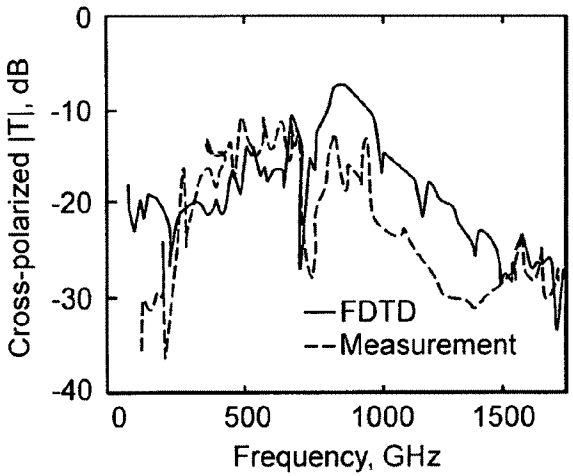
FIGS. 48(*a*) and 48(*b*) are graphs showing transmission coefficients of: (a) co-polarized electric field and (b) cross-polarized electric field, for simulated results compared with experimental results from the fabricated device of FIG. 47.
Figure 48A:
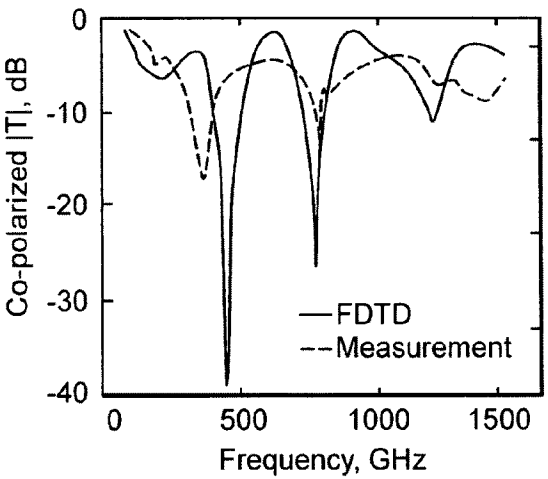

FIGS. 48(*a*) and 48(*b*) show the experimentally measured transmission coefficients, i.e. co- and cross-polarized electric fields, from the fabricated sample compared with those calculated in the simulation results for the identical model. In particular, FIG. 48(*a*) shows transmission coefficients of the co-polarized electric field, and FIG. 48(*b*) shows transmission coefficients of the cross-polarized electric field. A 50 μm thick Mylar substrate with effective permittivity of 3.3 was inserted in the FDTD simulation. The y-shaped resonator placed on the Mylar substrate was implemented as Al in the FDTD simulation.

The co- and cross-polarized transmission coefficients from the simulations matched the general trend and magnitudes of the experimental measurement results as shown in FIGS. 48(*a*) and 48(*b*). The simulation results, thus, could predict the resonant frequencies, as well as the qualitative shape of the transmission spectra of the experimentally fabricated metamaterials with substantial agreements with the measured ones. The co-polarized transmission term, $T_{co}$, had two passbands. The bands of the measurement were wider than those of the simulation, as shown in FIG. 48(*a*). The maximum measured value of the co-polarized transmittance was −6 dB while the simulated co-polarized transmission had a peak maximum at −2 dB. Both simulated and experimental cross-polarized transmission terms, $T_{cr}$ had the first high transmission value from 400 GHz to 750 GHz, as shown in FIG. 48(*b*), which was in the same interval as the first passband of the co-polarized term, while the second peak was centered at 900 GHz. Both the experimental and simulated $T_{cr}$ values decreased at higher frequencies. In both experimental and simulated results, the co- and cross-polarized transmission bands occurred in the same frequency band (400-750 GHz for the simulation and 380-780 GHz for the experiment—for the first band). Some of the discrepancies which appeared between the experimental and numerical results (e.g. the width of the $T_{co}$ passband and the transmission levels) could be attributed to defects in the fabricated structures and the mismatch between the dimensions of the designed and the fabricated metamaterial.

Next, the orientation sensitivity of the y-shaped resonator based metamaterials were studied because of their possible utility in specific applications. Therefore, the transmission properties of y-resonators for perpendicular propagation relative to changes in the propagation direction were analyzed both numerically and experimentally. The entire 2D y-structure was rotated, while the axis and the perpendicular plane remained fixed. The case where the incident EM wave was perpendicular to the structure plane and examined successive rotations through right angles as shown in FIGS. 19(*a*)-19(*e*) was considered using the FDTD model: (a) 0° (b) 90° (c) 180° (d) 270° (e) horizontal flip to opposite handedness.

Figure 49A:
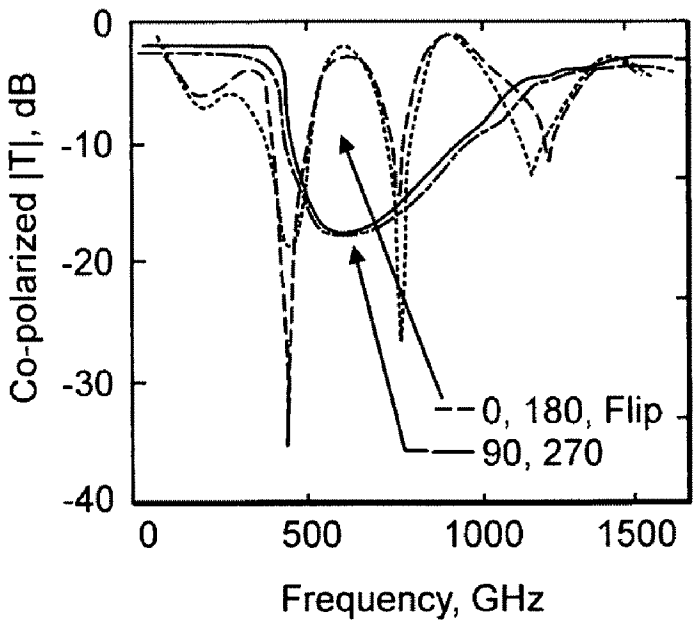
FIGS. 49(*a*) and 49(*b*) are graphs showing transmission coefficients for perpendicular propagation of different rotations of y-type resonators
Figure 49B:
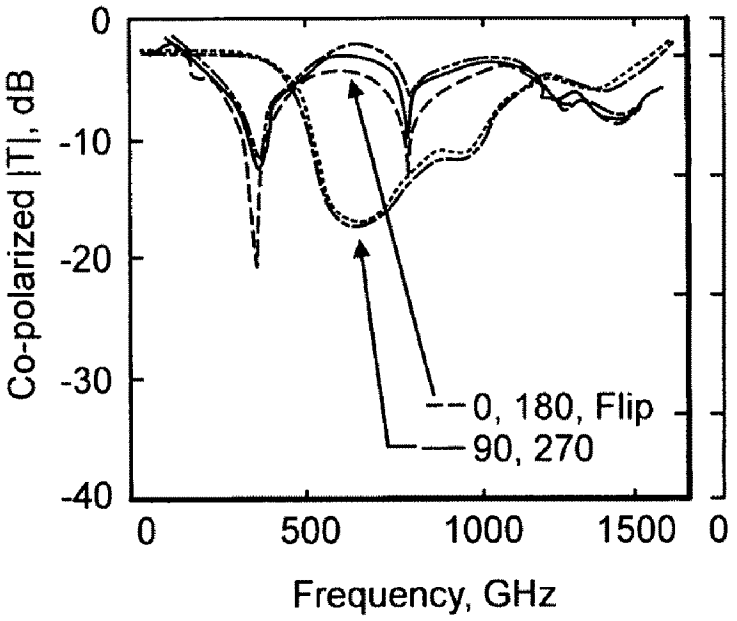

FIGS. 49(*a*) and 49(*b*), respectively, show simulated numerical and experimental transmission coefficients for perpendicular propagation upon different rotations of the metamaterials having y-shaped resonators, as shown in FIG. 44 (wedge structure). Both magnitudes and locations of the passband and stopband, illustrated in FIG. 49(*a*) agree well with their experimental results in FIG. 49(*b*). The transmission results with respect to the 0°, 180° and the flipped, opposite handedness y-structure, were similar. They all exhibited a high quality passband (~−2 dB) centered at 600 GHz. All three cases had their long axes in the direction of the electric field. The 90° and 270° orientations produced the wide stopband (~15-20 dB) located around the pass band identified for the other three orientations. This supports the NRI hypothesis of the y-shaped resonator in the way that the long axis, which needs to be set parallel to the electric field, can create the negative c and the uncompleted gaps produce the resonance or negative μ. The NRI property can be generated if the negative permittivity and permeability regions overlap.

As shown above, the experimental data validated the negative index of refraction in chiral metamaterials in the microwave regime. The wedge simulations (in the microwave and terahertz regimes) and experiments in the microwave regime also showed the property of frequency dependent beam splitting into two different angular paths. This property may be of great utility in optical applications.

EQUIVALENTS

While this invention has been particularly shown and described with references to preferred embodiments thereof, it will be understood by those skilled in the art that various changes in form and details may be made therein without departing from the scope of the invention disclosed herein.

What is claimed is:

1. A metamaterial comprising:

a) a dielectric substrate; and b) an array of discrete resonators at the dielectric substrate, wherein each of the discrete resonators has an alphabetical shape that is independently selected from the group consisting of: an F-type shape; an E-type shape; and a y-type shaper, wherein the resonators are constructed with main vertical axes combined with arms, thereby increasing capacitance of interruption of the metamaterial.

2. The metamaterial of claim 1, wherein the discrete resonators are periodically arrayed.

3. The metamaterial of claim 1, wherein the largest dimension of the discrete resonators is smaller than a wavelength of electromagnetic radiation in an X-ray, microwave, visible, ultraviolet or infrared region.

4. The metamaterial of claim 3, wherein the metamaterial is chiral.

5. The metamaterial of claim 4, wherein the chiral metamaterial has effective electric permittivity and effective magnetic permeability that are simultaneously negative in an applied frequency region of electromagnetic radiation.

6. The metamaterial of claim 1, wherein the metamaterial is in a wedge or prism shape.

7. A method of forming a metamaterial, comprising the steps of:

a) preparing a dielectric substrate; and b) forming an array of discrete resonators at the dielectric substrate, wherein each of the discrete resonators has an alphabetical shape that is independently selected from the group consisting of: an F-type shape; an E-type shape; and a y-type shape, wherein the resonators are constructed with main vertical axes combined with arms, thereby increasing capacitance of interruption of the metamaterial.

* * * * *